US012768537B2

(12) United States Patent
Tomaszewski et al.

(10) Patent No.: US 12,768,537 B2
(45) Date of Patent: Oct. 20, 2026

(54) GAS TURBINE ENGINE AND COMBUSTOR THEREFOR

(71) Applicants: GENERAL ELECTRIC COMPANY, Evendale, OH (US); GE Aerospace Poland sp. z o.o., Warsaw (PL)

(72) Inventors: Bartłomiej Adam Tomaszewski, Warsaw (PL); Maciej Stańczyk, Warsaw (PL); Łukasz Filip Tomaszewski, Zabki (PL); Tomasz Jan Bulsiewicz, Warsaw (PL); Ravindra Shankar Ganiger, Bangalore (IN); Hiranya Kumar Nath, Bangalore (IN); Michael A. Benjamin, West Chester, OH (US)

(73) Assignees: GENERAL ELECTRIC COMPANY, Evendale, OH (US); GE Aerospace Poland sp. z o.o., Warsaw (PL)

( * ) Notice: Subject to any disclaimer, the term of this patent is extended or adjusted under 35 U.S.C. 154(b) by 0 days.

(21) Appl. No.: 18/532,647

(22) Filed: Dec. 7, 2023

(65) Prior Publication Data

US 2025/0189130 A1 Jun. 12, 2025

(51) Int. Cl.
*F23R 3/00* (2006.01)
*F23R 3/06* (2006.01)

(52) U.S. Cl.
CPC ..... *F23R 3/002* (2013.01); *F23R 3/06* (2013.01); *F23R 2900/03041* (2013.01); *F23R 2900/03042* (2013.01); *F23R 2900/03044* (2013.01)

(58) Field of Classification Search
CPC .. F23R 3/002; F23R 3/04; F23R 3/045; F23R 3/10; F23R 3/50; F23R 2900/03041–03044; F23R 3/06
See application file for complete search history.

(56) References Cited

U.S. PATENT DOCUMENTS 4,380,905 A * 4/1983 Smart ..... F23R 3/002 60/756
4,689,961 A * 9/1987 Stratton ..... F23R 3/14 60/746

(Continued)

FOREIGN PATENT DOCUMENTS

CN 103348188 A 10/2013
CN 111780165 A 10/2020

(Continued)

OTHER PUBLICATIONS

Extended European Search Report issued in corresponding application 24213581.2 dated Apr. 7, 2025 (8 pages).

(Continued)

*Primary Examiner* — Devon C Kramer
*Assistant Examiner* — Jingchen Liu
(74) *Attorney, Agent, or Firm* — Carter, DeLuca & Farrell LLP

(57) ABSTRACT

A combustor for a turbine engine including a dome wall; a combustor liner extending from the dome wall; a combustion chamber at least partially defined by the dome wall and the combustor liner; a fuel cup disposed at a dome wall section of the dome wall, the fuel cup comprising a fuel cup centerline; a set of air tubes extending at least partially through the dome wall section to direct air into the combustion chamber; and a set of cooling holes extending through the dome wall section.

15 Claims, 41 Drawing Sheets

(56) References Cited

U.S. PATENT DOCUMENTS

| | | | | |
|---|---|---|---|---|
| 5,220,794 | A | 6/1993 | Sledd et al. | |
| 7,546,737 | B2 | 6/2009 | Schumacher et al. | |
| 8,312,725 | B2 | 11/2012 | Steele et al. | |
| 9,534,781 | B2 | 1/2017 | Hughes et al. | |
| 10,107,496 | B2 * | 10/2018 | Rathmann | F23R 3/50 |
| 10,408,457 | B2 | 9/2019 | Akiyama et al. | |
| 10,823,418 | B2 | 11/2020 | Zelina et al. | |
| 10,845,055 | B2 | 11/2020 | Roh et al. | |
| 2003/0000217 | A1 * | 1/2003 | North | F23R 3/002 60/752 |
| 2008/0016876 | A1 | 1/2008 | Colibaba-Evulet et al. | |
| 2008/0115506 | A1 * | 5/2008 | Patel | F02C 3/145 60/804 |
| 2009/0188255 | A1 * | 7/2009 | Green | F23R 3/286 60/737 |
| 2013/0042627 | A1 * | 2/2013 | Gerendas | F23M 20/005 60/725 |
| 2013/0247575 | A1 | 9/2013 | Patel et al. | |
| 2016/0186997 | A1 * | 6/2016 | Sadil | F02C 7/16 411/347 |
| 2017/0009986 | A1 * | 1/2017 | Patel | F23R 3/60 |
| 2018/0292089 | A1 * | 10/2018 | Porter | F23R 3/04 |
| 2019/0056110 | A1 * | 2/2019 | Stevens | F23R 3/286 |
| 2019/0093892 | A1 * | 3/2019 | Rimmer | F23R 3/10 |
| 2020/0063963 | A1 | 2/2020 | Bilse et al. | |
| 2022/0082258 | A1 | 3/2022 | Justice et al. | |
| 2023/0213191 | A1 | 7/2023 | Vukanti et al. | |
| 2023/0220802 | A1 | 7/2023 | Bucaro et al. | |

FOREIGN PATENT DOCUMENTS

| | | | |
|---|---|---|---|
| CN | 116412412 | A | 7/2023 |
| CN | 116608489 | A | 8/2023 |

OTHER PUBLICATIONS

Office Action issued in corresponding Chinese application No. 202411777793.8, dated Aug. 1, 2026, together with machine generated English translation.

* cited by examiner

GAS TURBINE ENGINE AND COMBUSTOR THEREFOR

TECHNICAL FIELD

The present subject matter relates generally to a gas turbine engine having a combustor.

BACKGROUND

Turbine engines are driven by a flow of combustion gases passing through the engine to rotate a multitude of turbine blades, which, in turn, rotate a compressor to provide compressed air to the combustor for combustion. A combustor can be provided within the turbine engine and is fluidly coupled with a turbine into which the combusted gases flow.

Historically, fuels are used in the combustor of a turbine engine. Generally, air and fuel are fed to a combustion chamber, the air and fuel are mixed, and then the fuel is burned in the presence of the air to produce hot gas. The hot gas is then fed to a turbine to produce power.

DETAILED DESCRIPTION

Aspects of the disclosure described herein are directed to a combustor. For purposes of illustration, the present disclosure will be described with respect to a turbine engine. It will be understood, however, that aspects of the disclosure described herein are not so limited and that a combustor as described herein can be implemented in engines, including but not limited to turbojet, turboprop, turboshaft, and turbofan engines. Aspects of the disclosure discussed herein may have general applicability within non-aircraft engines having a combustor, such as other mobile applications and non-mobile industrial, commercial, and residential applications.

The word "exemplary" is used herein to mean "serving as an example, instance, or illustration." Any implementation described herein as "exemplary" is not necessarily to be construed as preferred or advantageous over other implementations. Additionally, unless specifically identified otherwise, all embodiments described herein should be considered exemplary.

As may be used herein, the terms "first", "second", and "third" may be used interchangeably to distinguish one component from another and are not intended to signify location or importance of the individual components.

Figure 1:
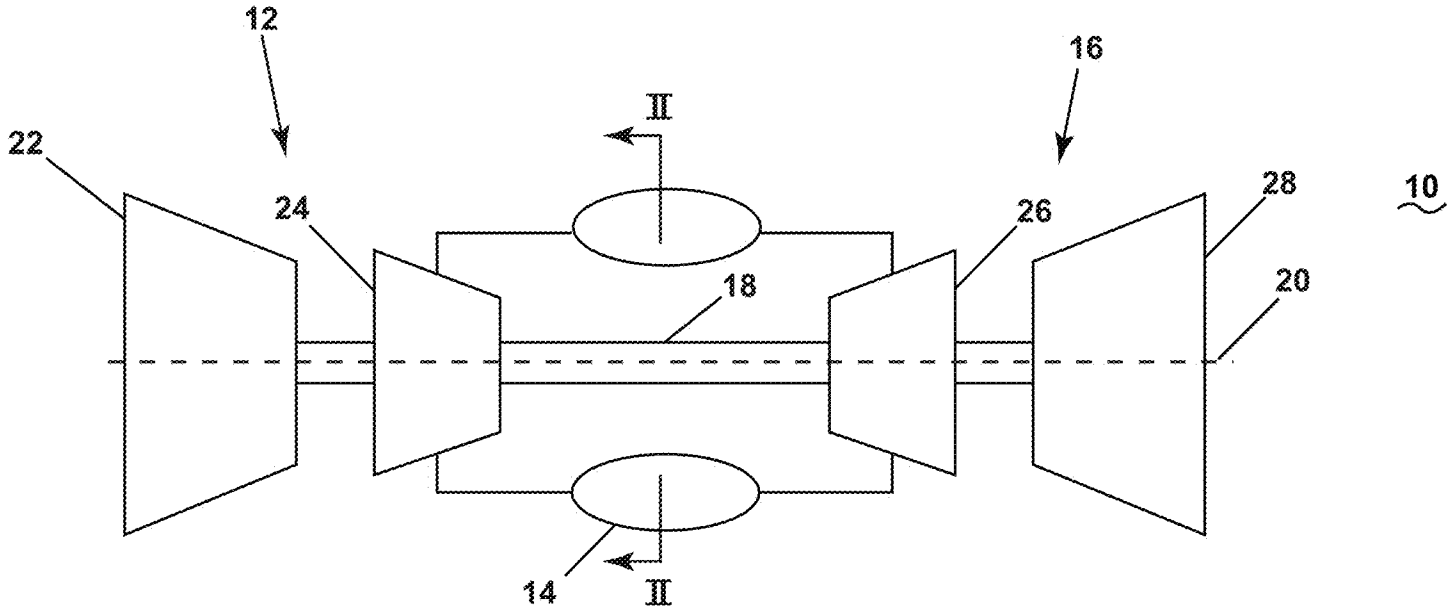
FIG. 1 is a schematic cross-sectional view of a turbine engine having a compressor section, a combustion section, and a turbine section in accordance with various aspects described herein.
Figure 3:
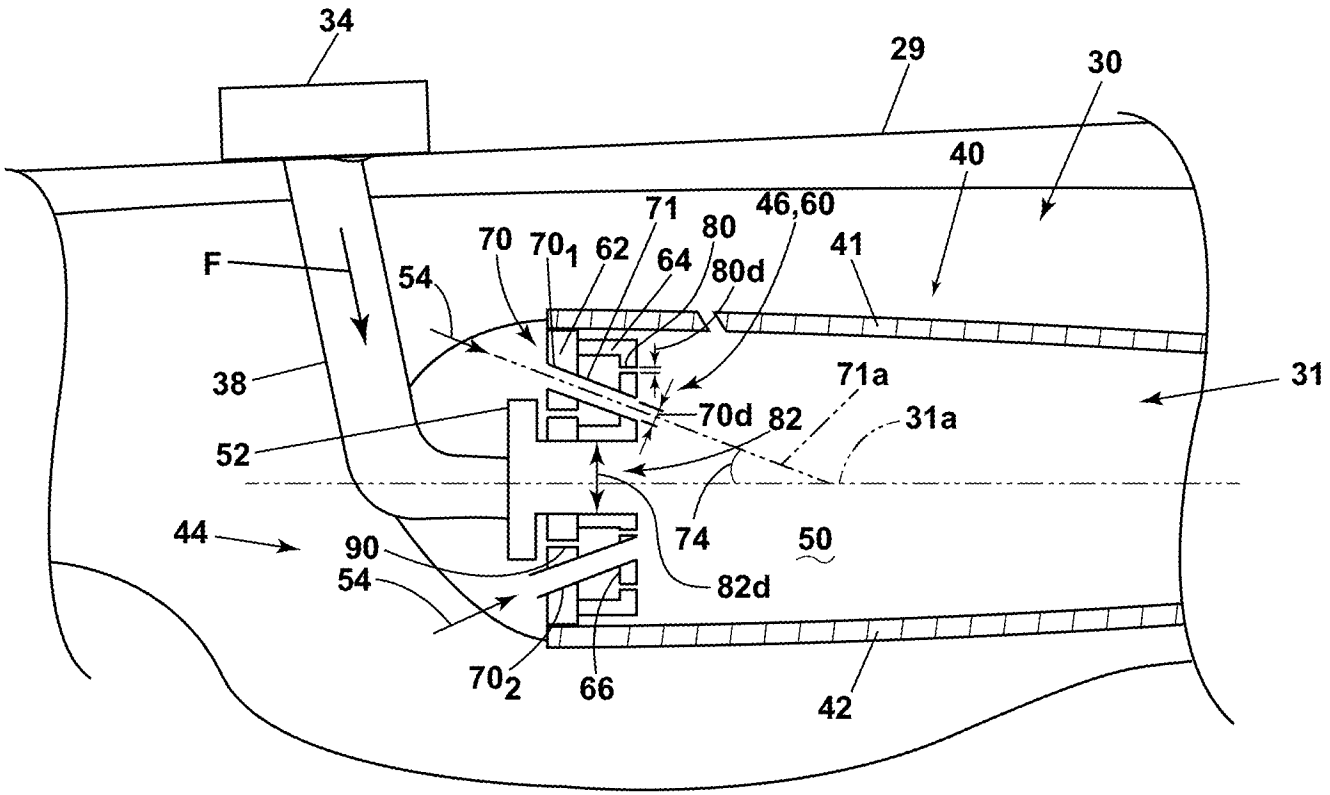
FIG. 3 is a schematic view illustrating portions of the combustor of FIG. 2 along line III-III in accordance with various aspects described herein.

The terms "forward" and "aft" refer to relative positions within a gas turbine engine or a vehicle, and refer to the normal operational attitude of the gas turbine engine or vehicle. For example, with regard to a gas turbine engine, forward refers to a position closer to an engine inlet and aft refers to a position closer to an engine exhaust. In FIG. 1, FIG. 3, and the even-numbered drawings of FIGS. 4-40, forward is generally illustrated to the left, and aft/rearward is generally illustrated to the right.

As used herein, the term "upstream" refers to a direction that is opposite the fluid flow direction, and the term "downstream" refers to a direction that is in the same direction as the fluid flow. The term "fore" or "forward" means in front of something and "aft" or "rearward" means behind something. For example, when used in terms of fluid flow, fore/forward can mean upstream and aft/rearward can mean downstream.

The term "fluid" may be a gas or a liquid. The term "fluid communication" means that a fluid is capable of making the connection between the areas specified.

Additionally, as used herein, the terms "radial" or "radially" refer to a direction away from a common center. For example, in the overall context of a turbine engine, radial refers to a direction along a ray extending between a center longitudinal axis of the engine and an outer engine circumference.

All directional references (e.g., radial, axial, proximal, distal, upper, lower, upward, downward, left, right, lateral, front, back, top, bottom, above, below, vertical, horizontal, clockwise, counterclockwise, upstream, downstream, forward, aft, etc.) are only used for identification purposes to aid the reader's understanding of the present disclosure, and do not create limitations, particularly as to the position, orientation, or use of aspects of the disclosure described herein. Connection references (e.g., attached, coupled, connected, and joined) are to be construed broadly and can include intermediate structural elements between a collection of elements and relative movement between elements unless otherwise indicated. As such, connection references do not necessarily infer that two elements are directly connected and in fixed relation to one another. The exemplary drawings are for purposes of illustration only the dimensions, positions, order and relative sizes reflected in the drawings attached hereto can vary.

The singular forms "a", "an", and "the" include plural references unless the context clearly dictates otherwise. Furthermore, as used herein, the term "set" or a "set" of elements can be any number of elements, including only one.

Uses of "and" and "or" are to be construed broadly. For example and without limitation, uses of "and" do not necessarily require all elements or features listed, and uses of "or" are inclusive unless such a construction would be illogical.

Approximating language, as used herein throughout the specification and claims, is applied to modify any quantitative representation that could permissibly vary without resulting in a change in the basic function to which it is related. Accordingly, a value modified by a term or terms, such as "about", "approximately", "generally", and "substantially", are not to be limited to the precise value specified. In at least some instances, the approximating language may correspond to the precision of an instrument for measuring the value, or the precision of the methods or machines for constructing or manufacturing the components and systems. In at least some instances, the approximating language may correspond to the precision of an instrument for measuring the value, or the precision of the methods or machines for constructing or manufacturing the components and systems. For example, the approximating language may refer to being within a 1, 2, 4, 5, 10, 15, or 20 percent margin in either individual values, range(s) of values and endpoints defining range(s) of values. Here and throughout the specification and claims, range limitations are combined and interchanged, such ranges are identified and include all the sub-ranges contained therein unless context or language indicates otherwise. For example, all ranges disclosed herein are inclusive of the endpoints, and the endpoints are independently combinable with each other.

"Proximate" as used herein is not limiting, rather a descriptor for locating parts described herein. Further, the term "proximate" means nearer or closer to the part recited than the following part. For example, a first hole proximate a wall, the first hole located upstream from a second hole means that the first hole is closer to the wall than the first hole is to the second hole.

FIG. 1 is a schematic view of a turbine engine 10. As a non-limiting example, the turbine engine 10 can be used within an aircraft. The turbine engine 10 can include, at least, a compressor section 12, a combustion section 14, and a turbine section 16. A drive shaft 18 rotationally couples the compressor section 12 and turbine section 16, such that rotation of one affects the rotation of the other, and defines a rotational axis 20 for the turbine engine 10.

The compressor section 12 can include a low-pressure (LP) compressor 22, and a high-pressure (HP) compressor 24 serially fluidly coupled to one another. The turbine section 16 can include an HP turbine 26, and an LP turbine 28 serially fluidly coupled to one another. The drive shaft 18 can operatively couple the LP compressor 22, the HP compressor 24, the HP turbine 26 and the LP turbine 28 together. Alternatively, the drive shaft 18 can include an LP drive shaft (not illustrated) and an HP drive shaft (not illustrated). The LP drive shaft can couple the LP compressor 22 to the LP turbine 28, and the HP drive shaft can couple the HP compressor 24 to the HP turbine 26. An LP spool can be defined as the combination of the LP compressor 22, the LP turbine 28, and the LP drive shaft such that the rotation of the LP turbine 28 can apply a driving force to the LP drive shaft, which in turn can rotate the LP compressor 22. An HP spool can be defined as the combination of the HP compressor 24, the HP turbine 26, and the HP drive shaft such that the rotation of the HP turbine 26 can apply a driving force to the HP drive shaft which in turn can rotate the HP compressor 24.

The compressor section 12 can include a plurality of axially spaced stages. Each stage includes a set of circumferentially-spaced rotating blades and a set of circumferentially-spaced stationary vanes. The compressor blades for a stage of the compressor section 12 can be mounted to a disk, which is mounted to the drive shaft 18. Each set of blades for a given stage can have its own disk. The vanes of the compressor section 12 can be mounted to a casing which can extend circumferentially about the turbine engine 10. It will be appreciated that the representation of the compressor section 12 is merely schematic and that there can be any number of blades, vanes and stages. Further, it is contemplated that there can be any number of other components within the compressor section 12.

Similar to the compressor section 12, the turbine section 16 can include a plurality of axially spaced stages, with each stage having a set of circumferentially-spaced, rotating blades and a set of circumferentially-spaced, stationary vanes. The turbine blades for a stage of the turbine section 16 can be mounted to a disk which is mounted to the drive shaft 18. Each set of blades for a given stage can have its own disk. The vanes of the turbine section can be mounted to the casing in a circumferential manner. It is noted that there can be any number of blades, vanes and turbine stages as the illustrated turbine section is merely a schematic representation. Further, it is contemplated that there can be any number of other components within the turbine section 16.

The combustion section 14 can be provided serially between the compressor section 12 and the turbine section 16. The combustion section 14 can be fluidly coupled to at least a portion of the compressor section 12 and the turbine section 16 such that the combustion section 14 at least partially fluidly couples the compressor section 12 to the turbine section 16. As a non-limiting example, the combustion section 14 can be fluidly coupled to the HP compressor 24 at an upstream end of the combustion section 14 and to the HP turbine 26 at a downstream end of the combustion section 14.

During operation of the turbine engine 10, ambient or atmospheric air is drawn into the compressor section 12 via a fan (not illustrated) upstream of the compressor section 12, where the air is compressed defining a pressurized air. The pressurized air can then flow into the combustion section 14 where the pressurized air is mixed with fuel and ignited, thereby generating combustion gases. Some work is extracted from these combustion gases by the HP turbine 26, which drives the HP compressor 24. The combustion gases are discharged into the LP turbine 28, which extracts additional work to drive the LP compressor 22, and the exhaust gas is ultimately discharged from the turbine engine 10 via an exhaust section (not illustrated) downstream of the turbine section 16. The driving of the LP turbine 28 drives the LP spool to rotate the fan (not illustrated) and the LP compressor 22. The pressurized airflow and the combustion gases can together define a working airflow that flows through the fan, compressor section 12, combustion section 14, and turbine section 16 of the turbine engine 10.

Figure 2:
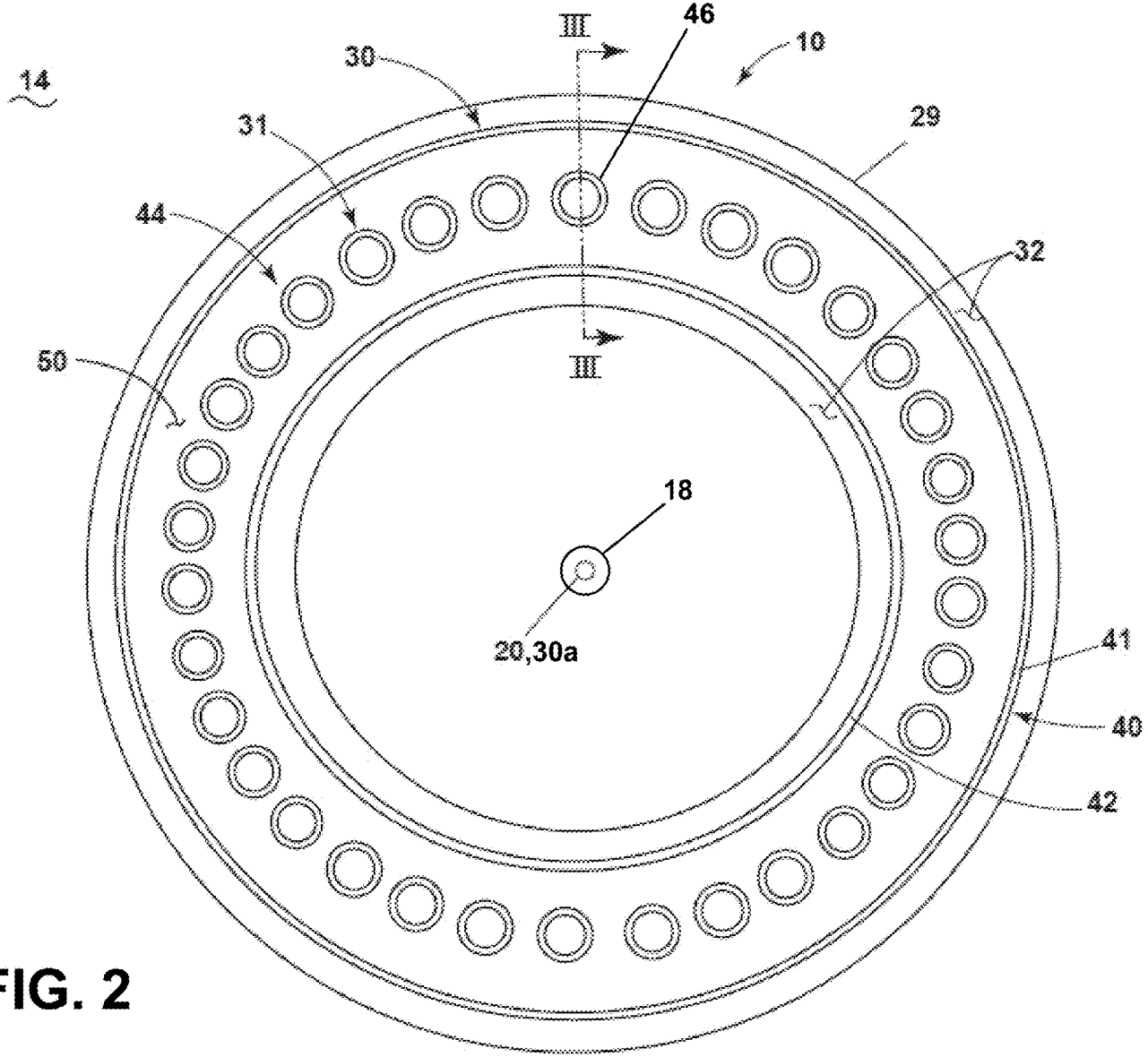
FIG. 2 is a schematic view of a combustor of the combustion section of FIG. 1 along line II-II in accordance with various aspects described herein.

FIG. 2 depicts a cross-sectional view a combustor 30 of the combustion section 14 along line II-II of FIG. 1. The combustor 30 can include an annular arrangement of fuel cups 31 disposed around the centerline or rotational axis 20 of the turbine engine 10. The combustor 30 can have a can, can-annular, or annular arrangement depending on the type of engine in which the combustor 30 is located. In a non-limiting example, the combustor 30 can have a combination arrangement located with a casing 29 of the engine. The combustor 30 can include a centerline 30*a* that can be coincident with the centerline 20.

The combustor 30 can be at least partially defined by a combustor liner 40. In some examples, the combustor liner 40 can include an outer liner 41 and an inner liner 42 concentric with respect to each other and arranged in an annular fashion about the engine centerline or rotational axis 20. In some examples, the combustor liner 40 can have an annular structure about the combustor 30. In some examples, the combustor liner 40 can include multiple segments or portions collectively forming the combustor liner 40. In some examples, the combustor liner 40 can include the outer liner 41 radially spaced from the inner liner 42. In some examples, the combustor liner 40 can include a single liner.

A dome assembly 44 together with the combustor liner 40 can at least partially define a combustion chamber 50 arranged annularly about the rotational axis 20. For example, a dome wall 46 of the dome assembly 44 can be substantially perpendicular to the rotational axis 20 and can cooperate with the outer liner 41, the inner liner 42, or both, to at least partially define the combustion chamber 50. In other configurations, the dome wall 46 is disposed at an angle relative to the rotation axis 20.

The fuel cups 31 can be separately provided at the dome wall 46. For example and without limitation, the fuel cups 31 can be provided at the dome wall 46 in a circumferentially spaced configuration. The fuel cups 31 can be disposed at a radial distance from the rotational axis 20 that is greater than a radial distance of the inner liner 42 and less than a radial distance of the outer liner 41. The dome wall 46 can include a dome wall section 60 (FIG. 3) for each fuel cup 31.

FIG. 3 is a cross-sectional view of the combustor 30 along line III-III of FIG. 2. The combustor 30 can include or be connected to a fuel supply 34 (e.g., an eternal fuel manifold). The fuel supply 34 can be connected to an outer surface of the casing 29. One or more fuel nozzles 38, connected to the dome wall 46, fluidly couple the fuel supply 34 with the fuel cups 31 and the combustion chamber 50. The fuel F can include any suitable fuel, including hydrocarbon fuel or hydrogen fuel in non-limiting examples. In an example aspect, the fuel cup 31 includes or is fluidly coupled with a swirler 52. The swirler 52 can be provided at or about the dome wall 46 and, in some instances, can be disposed at least partially in a fuel inlet 82 of the dome wall 46. The swirler 52 can swirl incoming air 54, such as compressed air 54 from the compressor section 12 (FIG. 1), in proximity of fuel F exiting the fuel nozzle 38, which may facilitate a homogeneous mixture of air and fuel entering the combustion chamber 50. Additionally or alternatively, the fuel inlet 82 can receive air from the swirler 52, air circuits other than the swirler 52, or a combination thereof.

In some examples, the combustor 30 can include the dome wall 46 and the combustor liner 40 extending from the dome wall 46 in an axial direction relative to a fuel cup centerline 31*a*. The dome wall 46 can be generally perpendicular to the axial direction but can be disposed at other angles relative to the axial direction. The combustion chamber 50 can be at least partially defined by the dome wall 46 and the combustor liner 40. The fuel cup 31 can be disposed at a dome wall section 60 of the dome wall 46. The dome wall 46 can, for example, include a dome wall section 60 for each fuel cup 31. With configurations having an annular dome wall 46, the sections 60 can include annular sectors.

A set of air tubes 70 can extend at least partially through the dome wall 46 to direct air, such as air 54, into the combustion chamber 50. The air 54 provided to the set of air tubes 70 and directed into the combustion chamber 50 may be devoid of fuel. For example, some or all of the set of air tubes 70 may be offset from, not in fluid communication with, or both, the fuel inlet 82 such that the air tubes 70 do not receive or convey fuel or a fuel-air mixture. The set of air tubes 70 can include one or more of a variety of cross-sectional shapes, including, for example, circular, oval-shaped, or rectangular, among others. The set of air tubes 70 can direct air 54 into the combustion chamber 50 to control, at least in part, flame distribution. One or more of the air tubes 70 can include a portion 71 having an air tube centerline 71*a* disposed at an angle 74 relative to the fuel cup centerline 31*a*. The angle 74 may include an oblique angle such that one or more air tubes 70 direct air 54 radially inward or radially outward, relative to the fuel cup centerline 31*a*, at least to some degree. For example, in some configurations, one or more air tube centerlines 71*a* may not be parallel to the axial direction or perpendicular to the radial direction. Additionally or alternatively, one or more air tube centerlines 71*a* may be parallel to the axial direction and perpendicular to the radial direction. The angle 74 can, with an example of the set of air tubes 70, be defined between the fuel cup centerline 31*a* and the air tube centerline 71*a* in a plane including the fuel cup centerline 31*a* and a radius thereof (e.g., a radial plane).

In some configurations, the one or more air tubes 70 can be disposed at an additional angle, such as an additional oblique angle, relative to the radial plane (e.g., one or more air tubes 70 can be not perpendicular to the circumferential direction). The set of air tubes 70 can comprise one air tube or a plurality of air tubes 70. For example and without limitation, the set of air tubes 70 can include at least two, three, four, or more air tubes 70. The set of air tubes 70 can be disposed in a circumferentially spaced configuration about the fuel cup centerline 31*a* but can be spaced about the section 60 of the dome wall 46 in other configurations, such as a rectangular pattern, a spiral pattern, a non-uniform configuration, or a combination thereof. For example, in some configurations, all of the air tubes 70 of a set of air tubes 70 can have a different configuration (e.g., angles, length, hydraulic diameter, among others). The set of air tubes 70 can, in some examples, include a first air tube $\mathbf{70}_1$ and a second air tube $\mathbf{70}_2$.

With some aspects, at least one of the set of air tubes 70 can have a diameter 70*d* (e.g., a hydraulic diameter) that converges toward the combustion chamber 50 (e.g., a converging hydraulic diameter). Additionally or alternatively, at least one of the set of air tubes 70 can have an inner diameter 70*d* that diverges toward the combustion chamber (e.g., a diverging hydraulic diameter). For example, the dome wall section 60 can include one or more air tubes 70 with a converging diameter in a rearward direction, one or more other air tubes 70 with a diverging diameter in the rearward direction, one or more other air tubes 70 with a constant diameter, or a combination thereof. Additionally or alternatively, the inner diameter 70*d* of one or more of the set of air tubes 70 can be constant.

The dome wall 46 can include a set of cooling holes 80 extending at least partially through the section 60 of the dome wall 46. The air 54 may be provided to the cooling holes 80 to cool portions of the dome wall 46, such as from the compressor section 12 (FIG. 1). The air 54 provided to the cooling holes 80 may be devoid of fuel. The cooling holes 80 can be parallel with the fuel cup centerline 31*a*. Additionally or alternatively, one or more of the set of cooling holes 80 can be disposed at angles relative to the fuel cup centerline 31*a*, which can include radial components, tangential components, or both. With some aspects, an axial extent of the set of cooling holes 80 can be less than an axial extent of one or more of the set of air tubes 70. For example and without limitation, the axial extent of the set of cooling holes 80 can be 50% or less of the axial extent of some or all of the set of air tubes 70. The air tube inner diameter 70*d* of at least one air tube 70 can be larger than a cooling hole diameter 80*d* (e.g., a hydraulic diameter) of at least one of the set of cooling holes 80. For example and without limitation, the air tube inner diameter 70*d* can be at least at least two, three, four, or more times larger than the cooling hole diameter 80*d*. One or more of the set of cooling holes 80 can be disposed radially outward of one or more of the set of air tubes 70, relative to the fuel cup centerline 31*a*. Additionally or alternatively, one or more of the set of cooling holes 80 can be disposed radially inward of one or more of the set of air tubes 70, relative to the fuel cup centerline 31*a*. Additionally or alternatively, one or more of the set of cooling holes 80 can be disposed at substantially the same radial distance as one or more of the set of the air tubes 70, relative to the fuel cup centerline 31*a*. The set of cooling holes 80 can include cooling holes of different sizes, different shapes, or different sizes and shapes. The set of cooling holes 80 can include cooling holes disposed in an asymmetric arrangement, cooling holes disposed in a symmetric arrangement, or a combination of asymmetric and symmetric arrangements.

With some examples, the section 60 of the dome wall 46 can include the fuel inlet 82 that can be adapted for fluid coupling with the fuel nozzle 38, the swirler 52, other fluid circuits, or combinations thereof. An inner diameter 82*d* (e.g., a fuel inlet hydraulic diameter) of the fuel inlet 82 can be larger than the air tube inner diameter 70*d*. For example and without limitation, the fuel inlet inner diameter 82*d* can be at least twice as large as the air tube inner diameter 70*d*.

In some examples, the dome wall 46 can include a plate 62, a heat shield 64, or a plate 62 and a heat shield 64. The plate 62 can be disposed, at least in part, upstream or forward of the heat shield 64 (e.g., left of the heat shield 64 in FIG. 3). The plate 62, the heat shield 64, or the plate 62 and the heat shield 64 can include one or more of the set of air tubes 70. With some aspects, the plate 62 includes a first subset of the set of air tubes 70 and the heat shield includes a second subset of the set of air tubes 70. The first subset of the set of air tubes 70 can extend from the plate 62 rearward toward, into, or through the heat shield 64 (see first air tube $\mathbf{70}_1$). The second subset of the set of air tubes 70 can extend from the heat shield 64 forward, toward, into, or through the plate 62 (see second air tube $\mathbf{70}_2$).

The dome wall 46 can include a set of impingement holes 90. The set of impingement holes 90 can be provided in the plate 62. Additionally or alternatively, the set of impingement holes 90 can be provided in one or more impingement baffles (see, e.g., impingement holes 290 of impingement baffle 292 in FIG. 6). The impingement holes 90 may fluidly couple an upstream fluid source and one or more portions of the dome wall 46, such as for cooling. For example, the set of impingement holes 90 of the plate 62 can provide the air 54 from the compressor section 12 (FIG. 1) to a forward/upstream surface 66 of the heat shield 64 to facilitate cooling of the heat shield 64. Additionally or alternatively, the set of impingement holes 90 of an impingement baffle can provide air 54 to the plate 62, the heat shield 64, or both. Some or all of the impingement holes 90 can be radially, circumferentially, or radially and circumferentially offset, relative to the fuel cup centerline 31*a*, from some or all of the cooling holes of the set of cooling holes 80.

One or more of the set of impingement holes 90 can be disposed radially outward of one or more of the set of air tubes 70, relative to the fuel cup centerline 31*a*. Additionally or alternatively, one or more of the set of impingement holes 90 can be disposed radially inward of one or more of the set of air tubes 70, relative to the fuel cup centerline 31*a*. Additionally or alternatively, one or more of the set of impingement holes 90 can be disposed at substantially the same radial distance as (and circumferentially offset from) one or more of the set of air tubes 70, relative to the fuel cup centerline 31*a*.

With some configurations, each dome wall section 60 can include a respective plate 62, a respective heat shield 64, or a respective plate 62 and a respective heat shield 64. In other configurations, one plate 62, one heat shield 64, or one plate 62 and one heat shield 64 can be utilized for a plurality of dome wall sections 60 such that a dome wall section 60 includes a portion of a plate 62, a portion of a heat shield 64, or portions of a plate 62 and a heat shield 64. As one non-limiting example, a dome wall section 60 could include all of a plate 62 and a portion of a heat shield 64, other portions of which can be included with other dome wall sections 60 of the same dome wall 46. The other dome wall sections 60 can each include a respective plate 62. As another non-limiting example, a dome wall section 60 can include all of a heat shield 64 and a portion of a plate 62, other portions of which can be included with other dome wall sections 60 of the same dome wall 46, and the other dome wall sections 60 can each include a respective heat shield 64.

In some examples, the plate 62, the heat shield 64, or the plate 62 and the heat shield 64 can be integrally formed, at least in part, with the combustor liner 40.

In embodiments with an impingement baffle (e.g., impingement baffle 292 of FIG. 6), the impingement baffle can include a single impingement baffle for the whole dome wall 46, a plurality of impingement baffles each provided to a respective plurality of dome wall sections 60, a plurality of impingement baffles each provided to a respective dome wall section 60, or a combination thereof.

Figure 4:
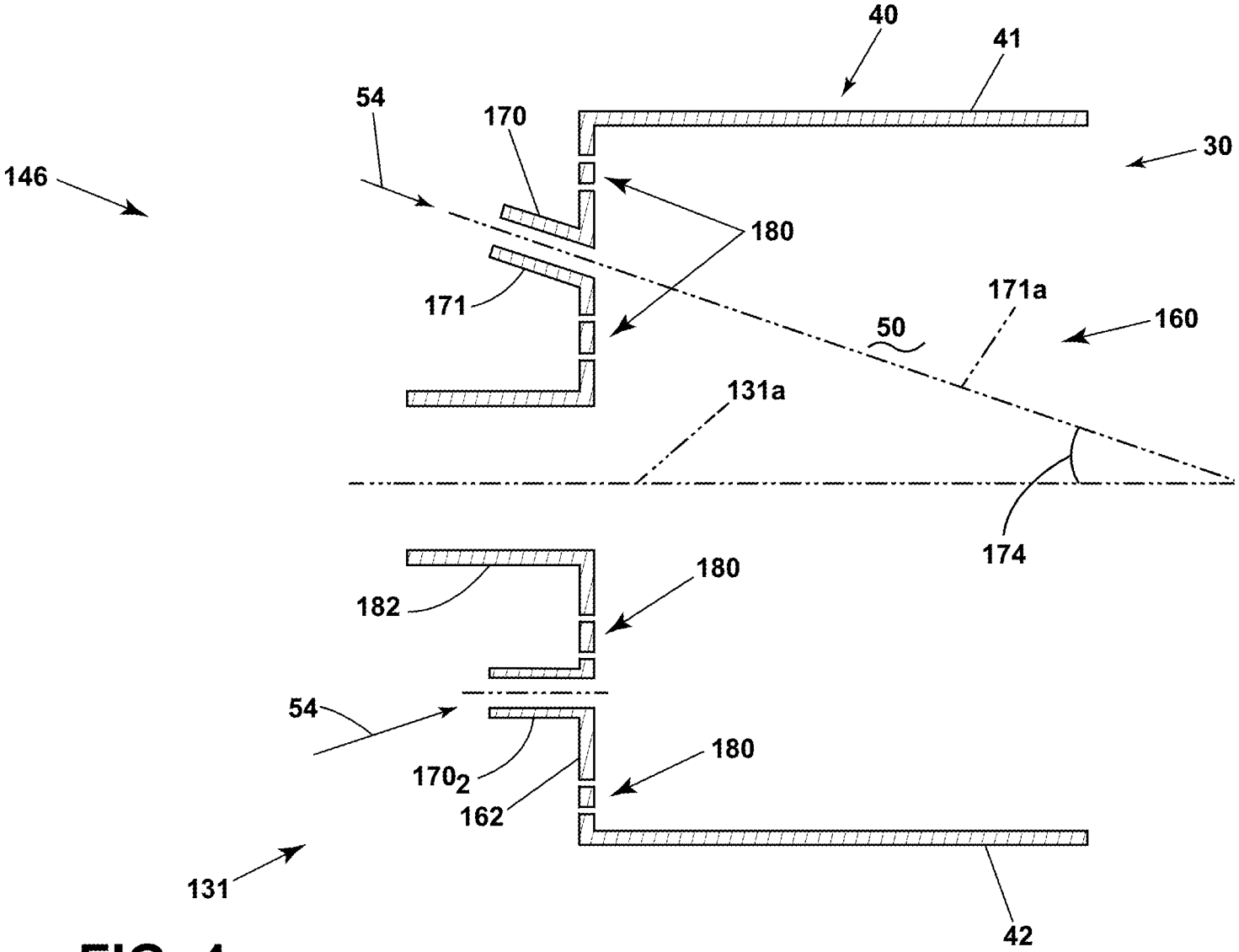
FIG. 4 is a schematic view illustrating portions of a combustor in accordance with various aspects described herein.
Figure 5:
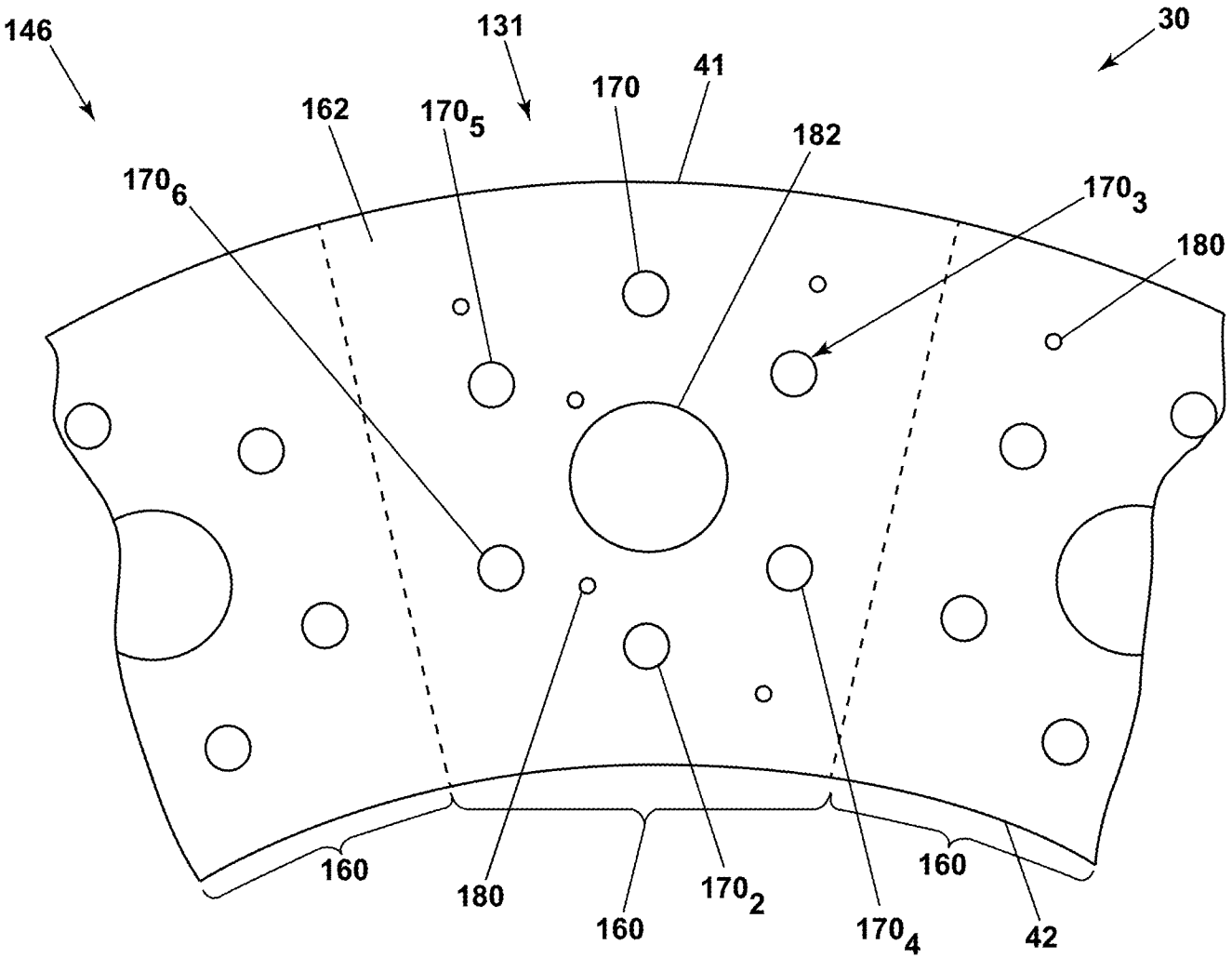
FIG. 5 is a schematic view illustrating portions of a combustor, from aft looking forward, in accordance with various aspects described herein.

Referring to FIGS. 4 and 5, a dome wall 146 that can be utilized for a combustor 30 is illustrated. The dome wall 146 can include aspects similar to those of the dome wall 46; therefore, like parts will be described with like numerals further increased by 100, with it being understood that the description of the like parts of the dome wall 46 can apply to the dome wall 146, except where noted.

The dome wall 146 can include a fuel cup 131, a dome wall section 160, and a plate 162. With some configurations, the dome wall 146 may not include a heat shield. The fuel cup 131 and the dome wall section 160 can include at least portions of the plate 162. For example and without limitation, the plate 162 may extend across a plurality or all of the dome wall sections 160 of the dome wall 146. The plate 162 can include a fuel inlet 182 that can be centered with a centerline 131*a* of the fuel cup 131. The plate 162 can be coupled to the combustor liner 40. Additionally or alternatively, the plate 162 can be integrally formed with some or all of the combustor liner 40. The plate 162 can include a set of air tubes 170, a set of cooling holes 180, or a combination thereof. One or more of the set of cooling holes 180 can be disposed radially outside of one or more of the set of air tubes 170, relative to the fuel cup centerline 131*a* of the fuel cup 131. Additionally or alternatively, one or more of the set of cooling holes 180 can be disposed radially between one or more of the set of air tubes 170 and the fuel inlet 182, relative to the fuel cup centerline 131*a*. Additionally or alternatively, one or more of the set of cooling holes 180 can be disposed circumferentially between one or more pairs of air tubes of the set of air tubes 170.

One or more of the set of air tubes 170 can be integrally formed with the plate 162. An air tube centerline 171*a* of a portion 171 of at least one air tube 170 can be disposed at an angle 174 relative to the fuel cup centerline 131*a*. The angle 174 can include an acute angle such that the at least one air tube 170 directs air 54 into the combustion chamber 50 and radially toward the fuel cup centerline 131*a*, at least to some degree. For example, a portion 171 of one or more air tubes 170 can be perpendicular to a circumferential direction of the fuel cup centerline 131*a* such that the air tube centerline 171*a* intersects the fuel cup centerline 131*a*. Additionally or alternatively, a portion 171 of one or more air tubes 170 may not be perpendicular to the circumferential direction such that the air tube centerline 171*a* does not intersect the fuel cup centerline 131*a*. With such a portion 171, the portion 171 may direct air 54 radially inward, generally toward the fuel cup centerline 131*a* but not directly toward the fuel cup centerline 131*a* (e.g., the air tube centerline 171*a* can be angled radially inward such that it does not intersect the fuel cup centerline 131*a*). Additionally or alternatively, the angle 174 for one or more air tubes 170 can include an obtuse angle such that the one or more air tubes 170 direct air 54 into the combustion chamber 50 and radially away from the fuel cup centerline 131*a*, at least to some degree. Additionally or alternatively, the angle 174 for one or more air tubes 170 can include a 0 or 180 degree angle such that the one or more air tubes 170 direct air 54 into the combustion chamber 50 in a direction parallel to the fuel cup centerline 131*a*.

In some configurations, the set of air tubes 170 can include a subset of air tubes disposed at different oblique angles 174 relative to the fuel cup centerline 131*a* (e.g., the oblique angles 174 of different air tubes 170 may or may not be different). The angles of the set of air tubes 170 relative to the circumferential direction of the fuel cup centerline 131*a* may or may not vary between air tubes 170. The set of air tubes 170 can, in some examples, include a first air tube 170 and one or more additional air tubes, such as air tubes $\mathbf{170}_{2\text{-}6}$ (FIG. 5).

Figure 6:
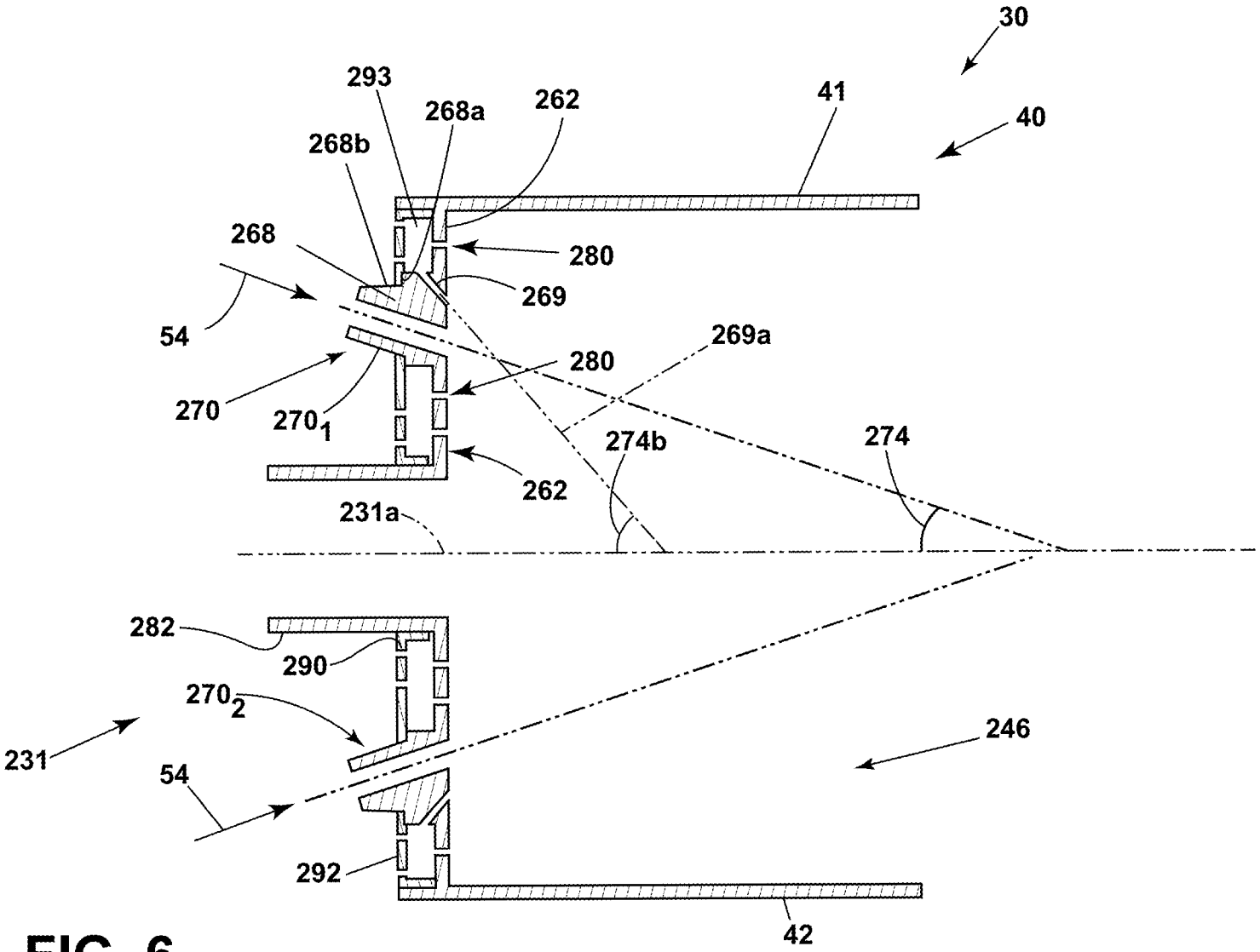
FIG. 6 is a schematic view illustrating portions of a combustor in accordance with various aspects described herein.
Figure 7:
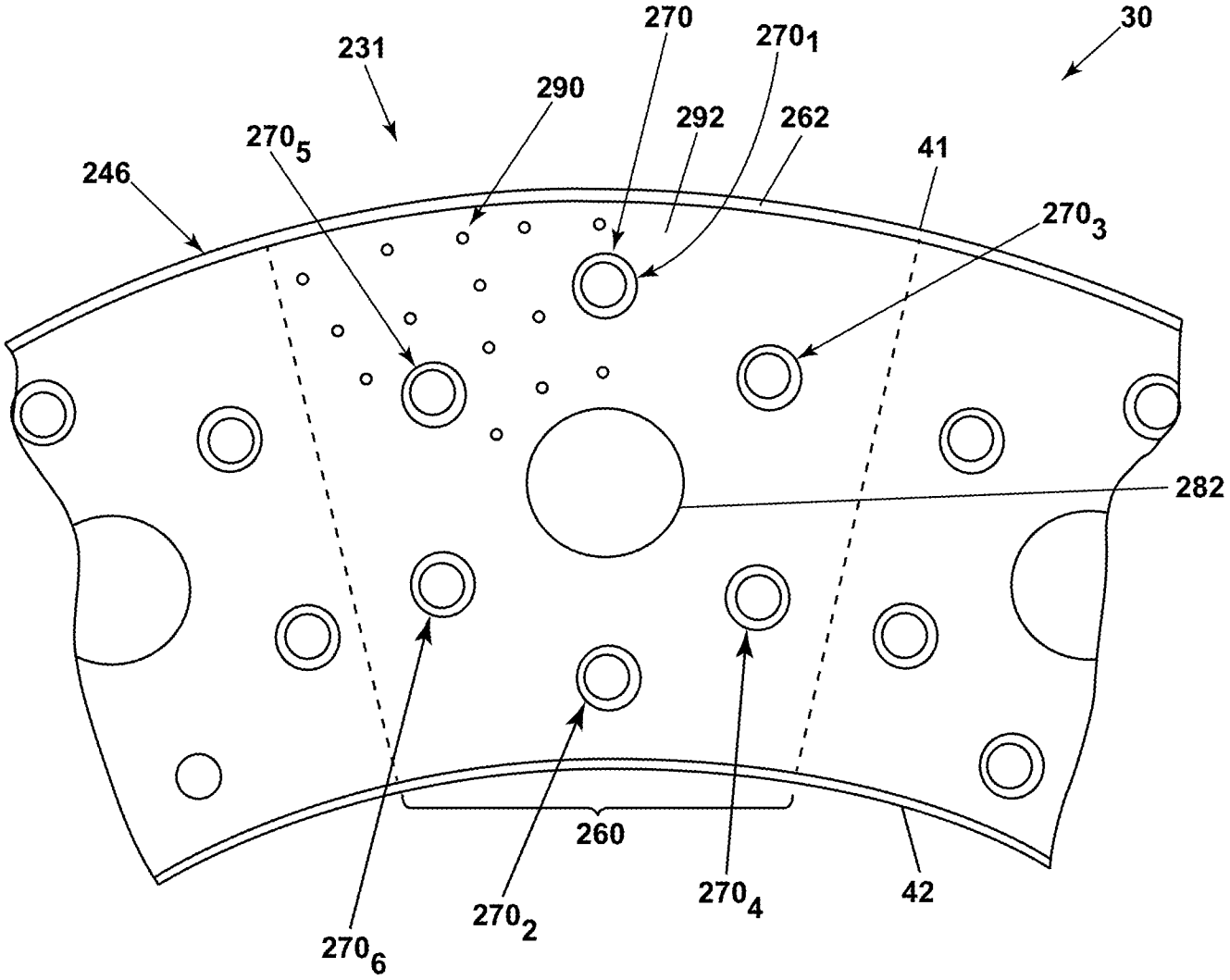
FIG. 7 is a schematic view illustrating portions of the combustor of FIG. 6, from forward looking aft, in accordance with various aspects described herein.

Referring to FIGS. 6 and 7, a dome wall 246 that can be utilized for a combustor 30 is illustrated. The dome wall 246 can include aspects similar to those of the dome wall 46 (FIG. 3), 146 (FIGS. 4 and 5); therefore, like parts will be described with like numerals further increased by 100, with it being understood that the description of the like parts of the dome wall 46, 146 can apply to the dome wall 246, except where noted.

The dome wall 246 can include a fuel cup 231, a dome wall section 260, a plate 262, a set of air tubes 270, a fuel inlet 282, and an impingement baffle 292. The fuel cup 231 and the dome wall section 260 can include at least portions of the plate 262 and the impingement baffle 292. The fuel cup 231 can include a fuel cup centerline 231*a*. The impingement baffle 292 can be coupled to the combustor liner 40, the plate 262, the dome wall 246, or a combination thereof, such as at least partially upstream of the plate 262. For example, the impingement baffle 292 can be fixed (e.g., brazed, welded, press fit, among others) with one or a combination of the outer liner 41, the inner liner 42, or the plate 262. The plate 262 can include a set of air tubes 270, at least some of which can extend (e.g., forward) into or through the impingement baffle 292. In some configurations, the impingement baffle 292 is fixed to one or more of the set of air tubes 270.

The impingement baffle 292 can include a set of impingement holes 290. At least some of the set of impingement holes 290 can be offset radially, circumferentially, or radially and circumferentially from the set of cooling holes 280 of the plate 262, relative to the fuel cup centerline 231*a*. For example, at least some of the impingement holes 290 can be disposed such that they are not directly aligned with the set of cooling holes 280. One or more of the set of impingement holes 290 can be disposed radially outside of the set of air tubes 270, relative to the fuel cup centerline 231*a*. Additionally or alternatively, one or more of the set of impingement holes 290 can be disposed radially between the set of air tubes 270 and a fuel inlet 282 of the plate, relative to the fuel cup centerline 231*a*. Additionally or alternatively, one or more of the set of impingement holes 290 can be disposed circumferentially between one or more pairs of air tubes of the set of air tubes 270.

With some aspects, the plate 262 can include one or more protrusions 268 extending away from the combustion chamber 50 (e.g., forward). At least one air tube of the set of air tubes 270 can be at least partially defined by the protrusion 268. The plate 262 can, for example, include a protrusion 268 for each air tube of the set of air tubes 270 or a single protrusion 268 for a plurality of air tubes of the set of air tubes 270. In some configurations, the protrusion 268 can include a cooling passage 269. A cooling passage centerline 269*a* of the cooling passage 269 can be disposed at a second oblique angle 274*b* relative to the fuel cup centerline 231*a*. The second oblique angle 274*b* can be different than an angle 274 of the set of air tubes 270 relative to the fuel cup centerline 231*a*. The cooling passage 269 can fluidly couple a space 293 between the impingement baffle 292 and the plate 262 with the combustion chamber 50. With some configurations, the cooling passage 269 is shorter or has a smaller diameter (e.g., a hydraulic diameter) than the at least one air tube 270, or is shorter and has a smaller diameter. The impingement baffle 292 can be coupled (e.g., fixed) to the plate 262 via the one or more protrusions 268. For example, the one or more protrusions 268 can include a forward axial surface 268*a* and a radial surface 268*b*, and the impingement baffle 292 can be fixed (e.g., brazed, welded, press fit, among others) with the forward axial surface 268*a*, the radial surface 268*b*, or both. In some configurations, the impingement baffle 292 can be coupled to the plate 262 only via one or more protrusions 268, but can be coupled to the plate 262, the combustor liner 40, or both in other manners in other configurations.

The set of air tubes 270 can, in some examples, include a first air tube $\mathbf{270}_1$ and one or more additional air tubes, such as air tubes $\mathbf{270}_{2\text{-}6}$. The dome wall 246, viewed from forward looking aft, is shown in FIG. 7. The dome wall 246, viewed from aft looking forward, may generally resemble the portions of the dome wall 146 illustrated in FIG. 5.

Figure 8:
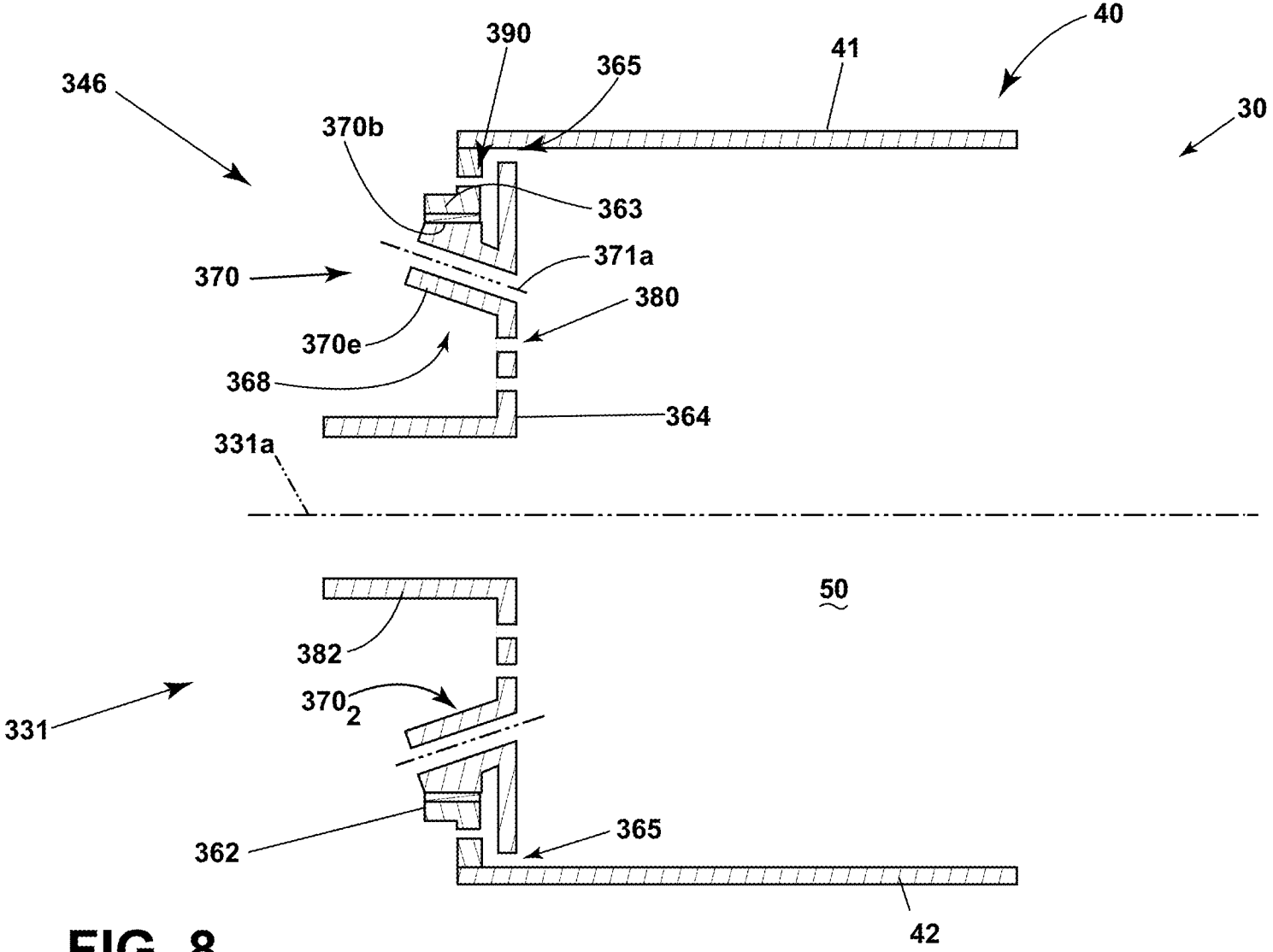
FIG. 8 is a schematic view illustrating portions of a combustor in accordance with various aspects described herein.
Figure 9A:
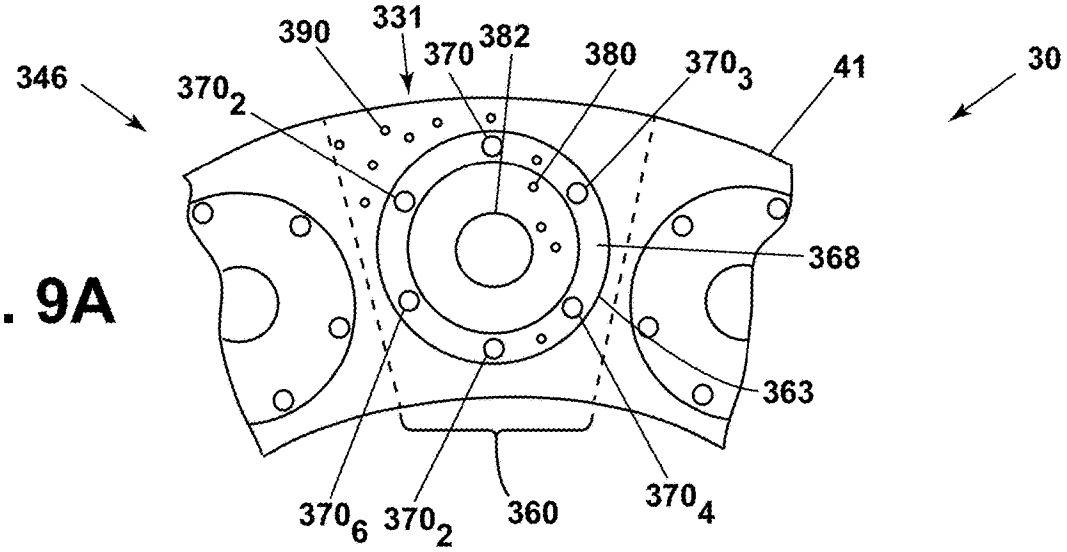
FIGS. 9A and 9B are schematic views illustrating portions of the combustor of FIG. 8, from forward looking aft, and from aft looking forward, respectively, in accordance with various aspects described herein.
Figure 9B:
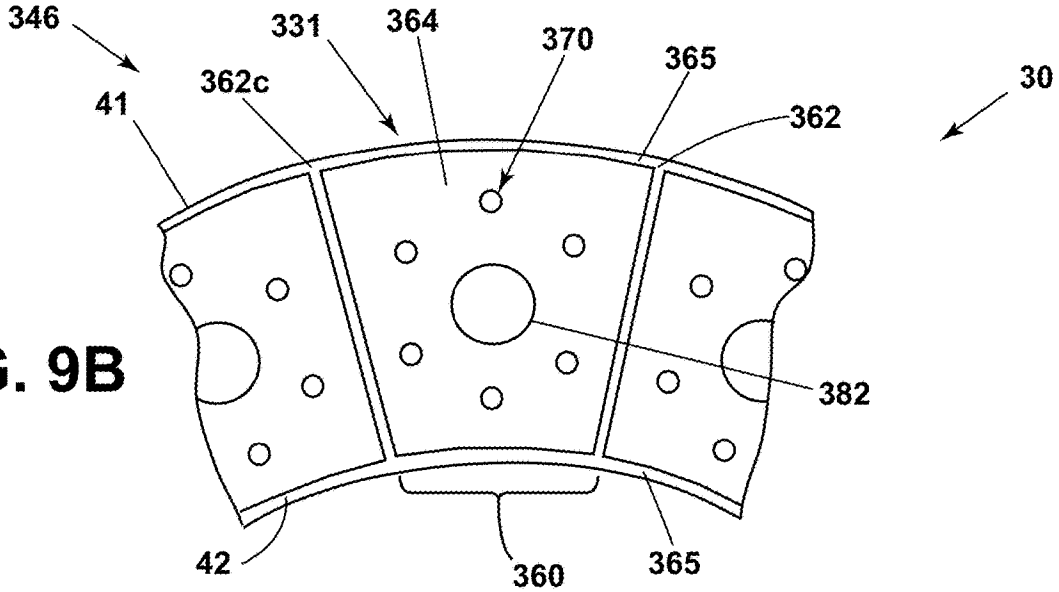

Referring to FIGS. 8, 9A, and 9B, a dome wall 346 that can be utilized for a combustor 30 is illustrated. The dome wall 346 can include aspects similar to those of the dome wall 46 (FIG. 3), 146 (FIGS. 4 and 5), 246 (FIGS. 6 and 7); therefore, like parts will be described with like numerals further increased by 100, with it being understood that the description of the like parts of the dome wall 46, 146, 246 can apply to the dome wall 346, except where noted.

The dome wall 346 can include a fuel cup 331, a dome wall section 360, a plate 362, a heat shield 364, a set of air tubes 370, and a fuel inlet 382. The heat shield 364 can be coupled to the plate 362. The fuel cup 331 and the dome wall section 360 can include at least portions of the plate 362 and the heat shield 364. The fuel cup 331 can include a fuel cup centerline 331*a*. The plate 362, the heat shield 364, or the plate 362 and the heat shield 364 can be coupled to the combustor liner 40. For example, in some aspects, the heat shield 364 can be fixedly coupled to the plate 362, and the plate 362 can be coupled to the combustor liner 40.

With some examples, the heat shield 364 can include a set of air tubes 370. One or more of the set of air tubes 370 can be coupled (e.g., fixed) to the plate 362, which can couple the heat shield 364 to the plate 362. Additionally or alternatively, the heat shield 364 can include a protrusion 368 that may define the set of air tubes 370 and be coupled (e.g., fixed) to or integrally formed with the plate 362. The protrusion 368 can be continuous or provided via separate segments. In some examples, the protrusion 368 can be annular. The heat shield 364 can at least partially overlap with the plate 362 in an axial direction, relative to the fuel cup centerline 331*a*. The heat shield 364 can be disposed such that a radial gap 365 is present between the heat shield 364 and the combustor liner 40, such as between the heat shield 364 and the outer liner 41, between the heat shield 364 and the inner liner 42, or both. A portion 362*c* of the plate 362 can be aligned with the radial gap 365 such that the heat shield 364 does not cover at least that portion 362*c* of the plate 362. The unshielded portion 362*c* may, for example, comprise 10% or less of the surface area of the plate 362 in the dome wall section 360.

With some aspects, the plate 362 can include a set of impingement holes 390 that may be disposed radially inward of the radial gap 365 relative to the fuel cup centerline 331*a*. Additionally or alternatively, the set of impingement holes 390 may be disposed at a radial distance from the fuel cup centerline 331*a* that is greater than a maximum radial extent for the set of air tubes 370. An inner diameter surface 363 of the plate 362 can be connected (e.g., fixed) to an outer radial surface 370*b* of the at least one of the set of air tubes 370. For example, with some configurations, the heat shield 364 can be fixed (e.g., brazed, welded, among others) to the plate 362 exclusively via the set of air tubes 370, but can be fixed to the plate 362, the liner 40, the annular protrusion 368, or a combination thereof in additional or alternative manners in other configurations. The outer radial surface 370*b* can be parallel to the fuel cup centerline 331*a*. Additionally or alternatively, the outer radial surface 370*b* may not be parallel to an air tube centerline 371*a*. In some configurations, the outer radial surface 370*b* can be provided at a forward end 370*e* of an air tube 370. The annular protrusion 368 can, in some aspects, include the outer radial surface 370*b*. The heat shield 364 can include a set of cooling holes 380. With some aspects, the heat shield 364 can include the fuel inlet 382, and the plate 362 may not include a portion of the fuel inlet 382.

Figure 10:
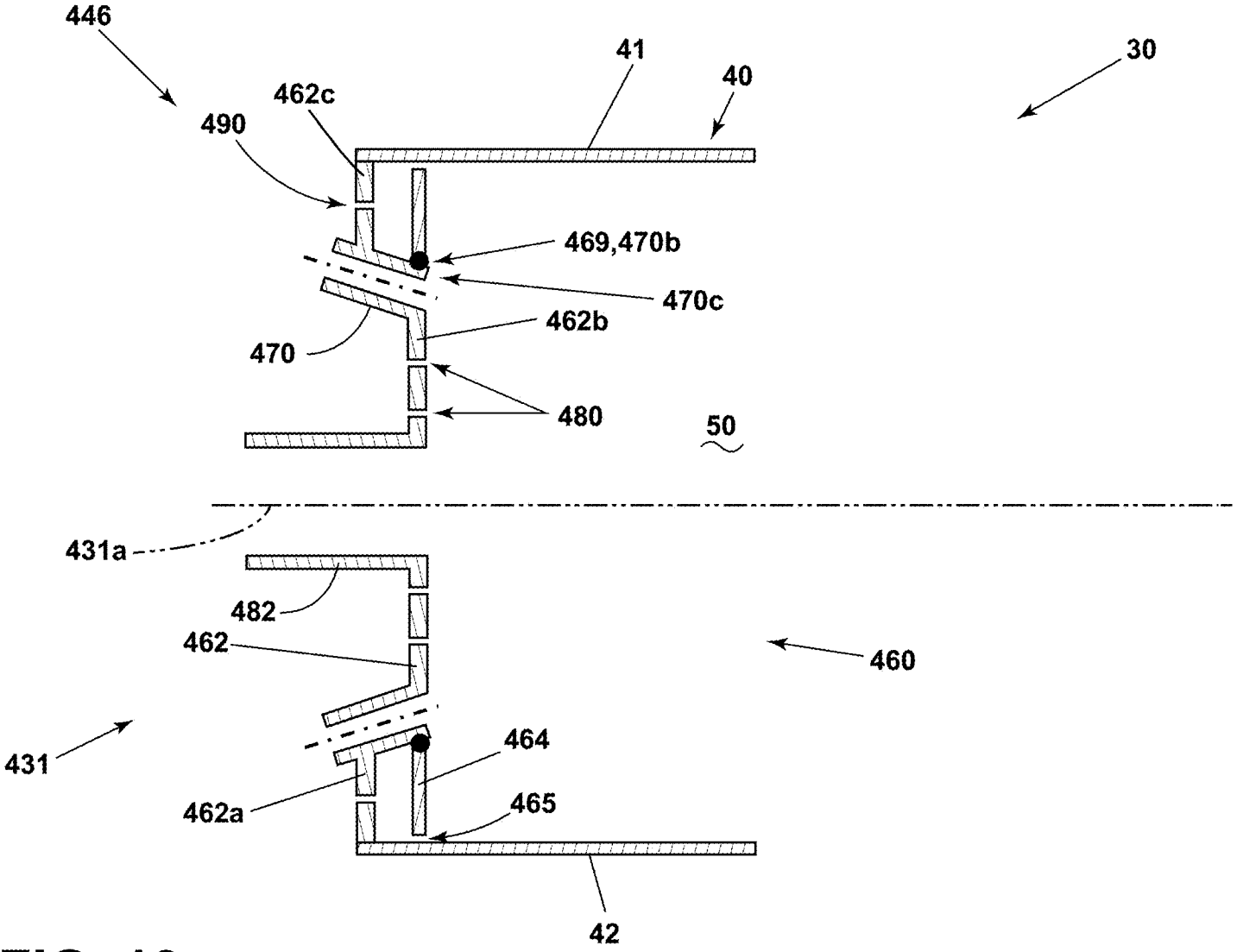
FIG. 10 is a schematic view illustrating portions of a combustor in accordance with various aspects described herein.
Figure 11A:
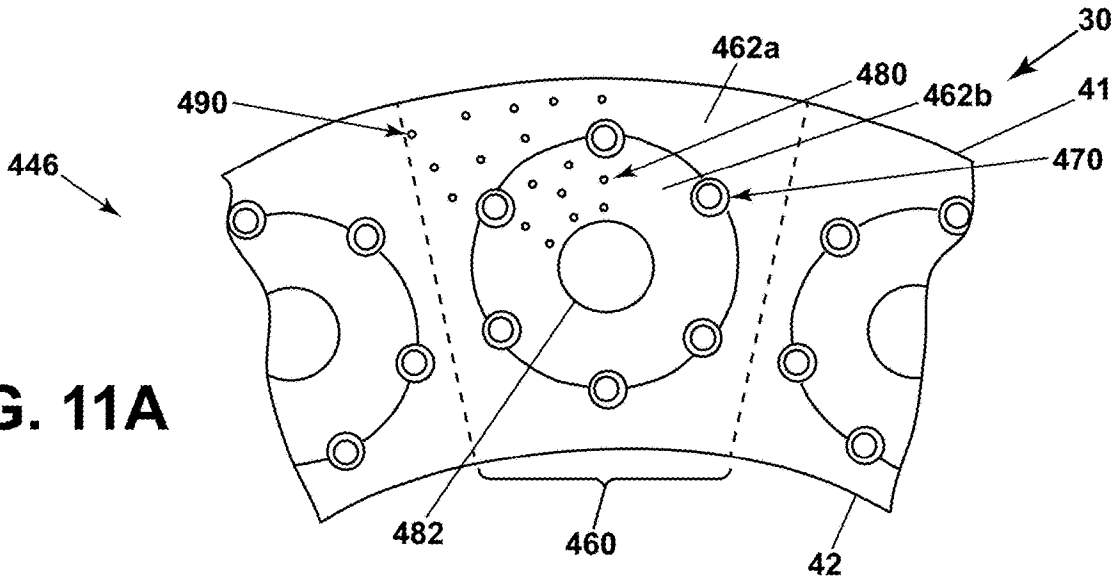
FIGS. 11A and 11B are schematic views illustrating portions of the combustor of FIG. 10, from forward looking aft, and from aft looking forward, respectively, in accordance with various aspects described herein.
Figure 11B:
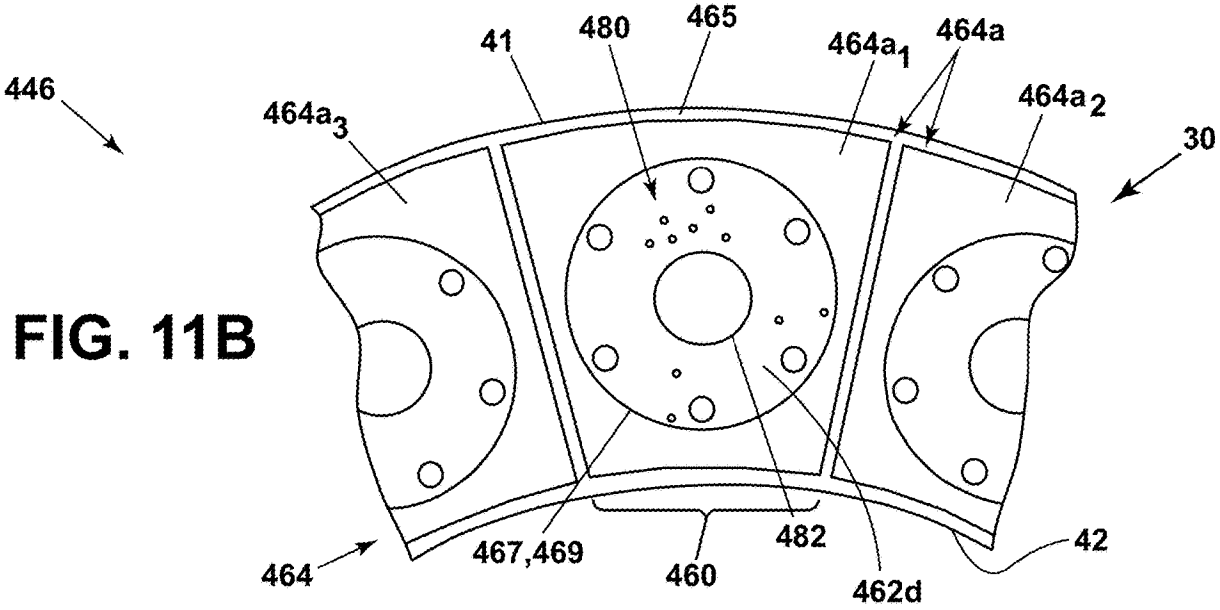

Referring to FIGS. 10, 11A, and 11B, a dome wall 446 that can be utilized for a combustor 30 is illustrated. The dome wall 446 can include aspects similar to those of the dome wall 46 (FIG. 3), 146 (FIGS. 4 and 5), 246 (FIGS. 6 and 7), 346 (FIGS. 8-9B); therefore, like parts will be described with like numerals further increased by 100, with it being understood that the description of the like parts of the dome wall 46, 146, 246, 346, can apply to the dome wall 446, except where noted.

The dome wall 446 can include a fuel cup 431, a dome wall section 460, a plate 462, a heat shield 464, a set of air tubes 470, and a fuel inlet 482. The fuel cup 431 and the dome wall section 460 can include at least portions of the plate 462 and the heat shield 464. The fuel cup 431 can include a fuel cup centerline 431*a*. The plate 462 can be coupled to the combustor liner 40. The heat shield 464 can be fixed to the plate 462. The plate 462 can include a set of air tubes 470. The heat shield 464 can be fixed to an outer radial surface 470*b* of a rear end 470*c* of at least one air tube 470 of the set of air tubes 470 (see, e.g., FIG. 10). For example, the heat shield 464 can include an aperture 467 having an edge 469, and the edge 469 can be fixed to the outer radial surface 470*b* of the rear end 470*c* of at least one air tube 470 of the set of air tubes 470. Additionally or alternatively, the edge 469 of the heat shield 464 can be fixed to an outer surface (e.g., an outer circumference) of a second plate section 462*b* of the plate 462. With some examples, the heat shield 464 can be coupled to the plate 462 exclusively via fixing the edge 469 to some or all of the set of air tubes 470, but can be coupled with additional or alternative configurations.

With some aspects, the plate 462 can include a first plate section 462*a* and a second plate section 462*b* axially offset from (e.g., downstream/rearward of) the first plate section 462*a*. The set of air tubes 470 can extend from the second plate section 462*b* forward to or beyond the first plate section 462*a*. Additionally or alternatively, the set of air tubes 470 can extend rearward beyond the second plate section 462*b*. The heat shield 464 can partially overlap with the first plate section 462*a* in an axial direction, relative to the fuel cup centerline 431*a*. The heat shield 464 can be disposed such that a radial gap 465 is present between the heat shield 464 and the combustor liner 40. A portion 462*c* of the first plate section 462*a* can be aligned with the radial gap 465 such that the heat shield 464 does not cover the portion 462*c*.

In some examples, the plate 462 can include a set of cooling holes 480, a set of impingement holes 490, or a combination thereof. For example, the first plate section 462*a* can include the set of impingement holes 490 for cooling the heat shield 464, the second plate section 462*b*, or both. Additionally or alternatively, the second plate section 462*b* can include the set of cooling holes 480, which may facilitate cooling of the second plate section 462*b*. The plate 462 can include a fuel inlet 482 that extends from the second plate section 462*b* axially forward toward or beyond an axial position of the first plate section 462*a*, such as for connection with the fuel nozzle 38 (FIG. 2), the swirler 52 (FIG. 2), or both. The heat shield 464 may not include a portion of the fuel inlet 482. The set of cooling holes 480 can include cooling holes disposed radially between outlets/rear ends 470*c* of the set of air tubes 470 and the fuel inlet 482. Additionally or alternatively, the set of cooling holes 480 can include cooling holes disposed circumferentially between the set of air tubes 470. In some examples, the plate 462, including one or more of the first plate section 462*a*, the second plate section 462*b*, the set of air tubes 470, or the fuel inlet 482, can be monolithic.

With some aspects, such as generally illustrated in FIG. 11B, the heat shield 464 can comprise a plurality of heat shield segments 464*a* (e.g., 464*a*1, 464*a*2, 464*a*3) disposed adjacent to each other to form the heat shield 464. The heat shield segments 464*a* can, for example, include annular sector shapes with a respective aperture 467 disposed generally in the center and the segments 464*a* can be disposed to provide the heat shield 464 with an annular configuration. The area of the aperture 467 can, for example and without limitation, be at least 40% of an area of the heat shield segment 464*a*. The aperture 467 can be aligned with and define an unshielded portion 462*c* of the plate 462, which may comprise some or all of the second plate section 462*b*. The heat shield 464 and the second plate section 462*b* can be axially aligned, such as to define a rearward/aft surface of the dome wall 446. The set of air tubes 470 can extend forward from an unshielded portion 462*d*. For example, rear ends 470*c* of the set of air tubes 470 can be disposed at an outer circumference or perimeter of the unshielded portion 462*c*. The unshielded portion 462*d* can include the fuel inlet 482, the set of cooling holes 480, or both. The heat shield 464 may not include a portion of the fuel inlet 482. Each dome wall section 460 of the dome wall 446 can include a heat shield segment 464*a* of the heat shield 464. Additionally or alternatively, the plate 462 may extend to other dome wall sections 460, so each dome wall section 460 can include a respective portion of the plate 462, the first plate section 462*a*, the second plate section 462*b*, or a combination thereof.

Figure 12:
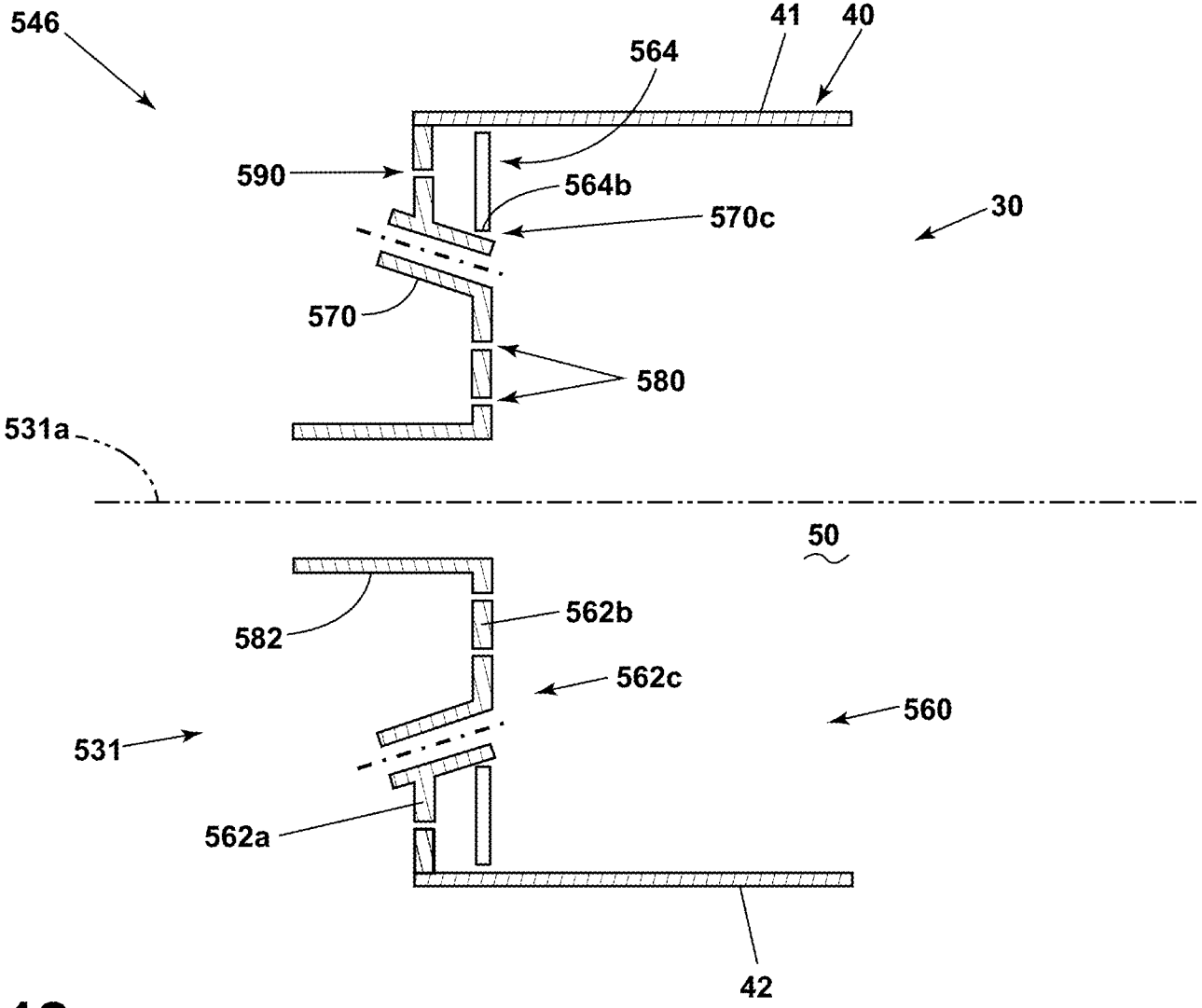
FIG. 12 is a schematic view illustrating portions of a combustor in accordance with various aspects described herein.
Figure 13C:
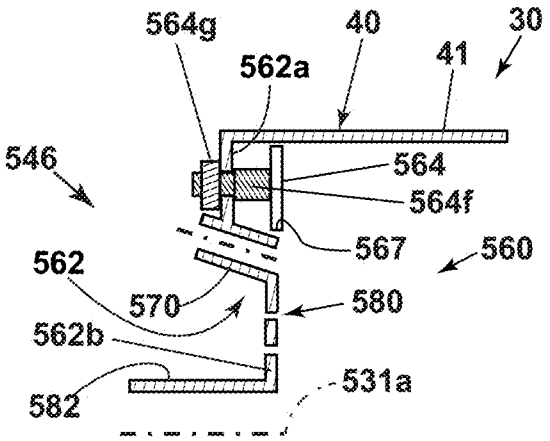
FIG. 13C is a schematic view illustrating portions of the combustor of FIGS. 12-13B along line C-C of FIG. 13B in accordance with various aspects described herein.
Figure 13A:
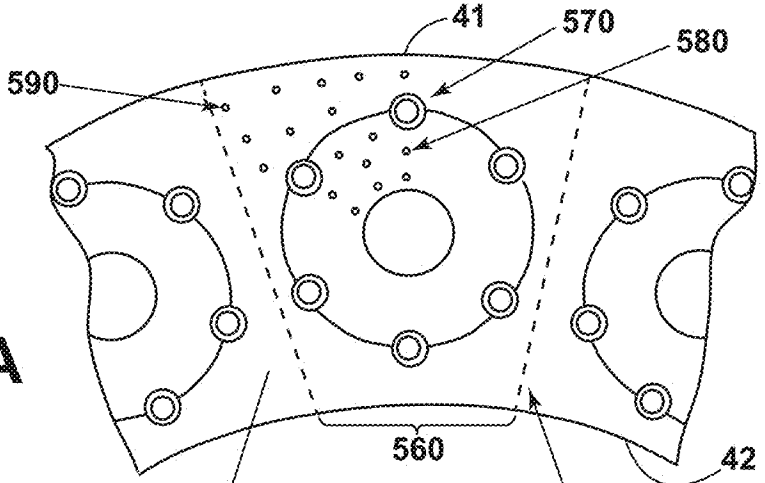
FIGS. 13A and 13B are schematic views illustrating portions of the combustor of FIG. 12, from forward looking aft, and from aft looking forward, respectively, in accordance with various aspects described herein.

Referring to FIGS. 12-13C, a dome wall 546 that can be utilized for a combustor 30 is illustrated. The dome wall 546 can include aspects similar to those of the dome wall 46 (FIG. 3), 146 (FIGS. 4 and 5), 246 (FIGS. 6 and 7), 346 (FIGS. 8-9B), 446 (FIGS. 10-11B); therefore, like parts will be described with like numerals further increased by 100, with it being understood that the description of the like parts of the dome wall 46, 146, 246, 346, 446 can apply to the dome wall 546, except where noted.

The dome wall 546 can include a fuel cup 531, a dome wall section 560, a plate 562, a heat shield 564, a set of air tubes 570, and a fuel inlet 582. The fuel cup 531 and the dome wall section 560 can include at least portions of the plate 562 and the heat shield 564. The fuel cup 531 can include a fuel cup centerline 531*a*. The plate 562 can be coupled to the combustor liner 40. The plate 562 can include the set of air tubes 570. The plate 562 can include a first plate section 562*a* and a second plate section 562*b* axially offset from (e.g., downstream/rearward of) the first plate section 562*a*. The set of air tubes 570 can extend from the first plate section 562*a* to the second plate section 562*b*. Additionally or alternatively, the set of air tubes 570 can extend forward from the first plate section 562*a*. The heat shield 564 can be axially aligned with the second plate section 562*b*. The first plate section 562*a* can include a set of impingement holes 590, such as for impingement cooling of the heat shield 564.

Figure 13B:
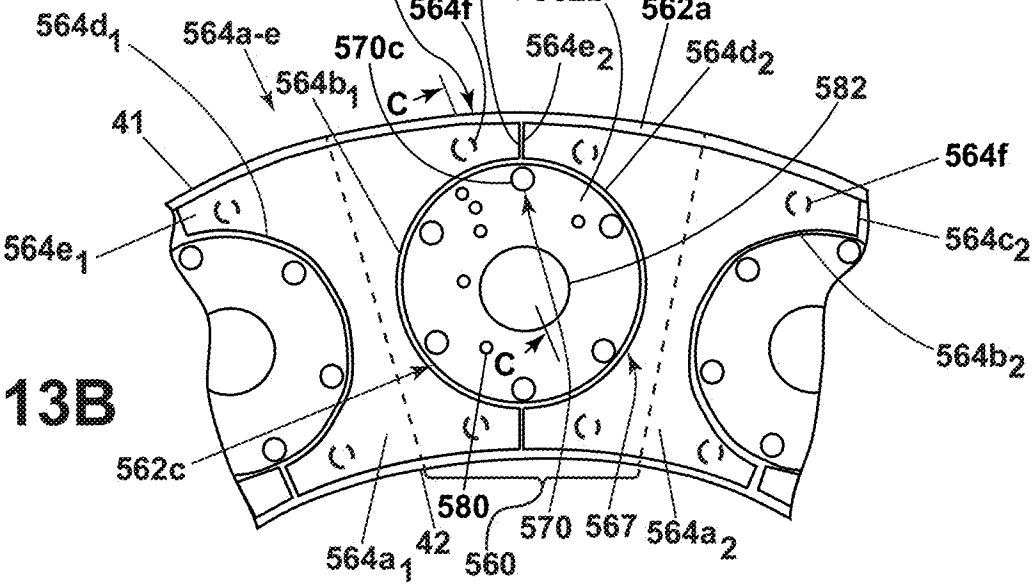

With some aspects, such as generally illustrated in FIG. 13B, the heat shield 564 can include a plurality of heat shield segments 564*a*, including a first heat shield segment $\mathbf{564}a_1$ and a second heat shield segment $\mathbf{564}a_2$, that can be formed as separate components. The dome wall section 560 can include a portion (e.g., a first half) of the first heat shield segment $\mathbf{564}a_1$ and a portion (e.g., a second half) of the second heat shield segment $\mathbf{564}a_2$. The first heat shield segment $\mathbf{564}a_1$ and the second heat shield segment $\mathbf{564}a_2$ can be axially aligned with each other, axially aligned with the second plate section 562*b*, fixed to the first plate section 562*a*, or a combination thereof. A heat shield segment 564*a*, such as heat shield segments $\mathbf{564}a_{1\text{-}2}$, can include a generally H-shaped configuration defining a heat shield segment first recess 564*b* formed in a first circumferential side $\mathbf{564}c_1$ of the first heat shield segment 564*a* and a heat shield segment second recess $\mathbf{564}d_2$ formed in a second circumferential side $\mathbf{564}e_2$ of the heat shield segment 564*a*. For example, the first heat shield segment $\mathbf{564}a_1$ can include recesses $\mathbf{564}b_1$, $\mathbf{564}d_1$, and circumferential sides $\mathbf{564}c_1$, $\mathbf{564}e_1$. Additionally or alternatively, the second heat shield segment $\mathbf{564}a_2$ can include recesses $\mathbf{564}b_2$, $\mathbf{564}d_2$, and circumferential sides $\mathbf{564}c_2$, $\mathbf{564}e_2$. The first circumferential side $\mathbf{564}c_1$ of the first heat shield segment $\mathbf{564}a_1$ can be disposed adjacent the second circumferential side $\mathbf{564}e_2$ of the second heat shield segment $\mathbf{564}a_2$ such that the first heat shield segment first recess $\mathbf{564}b_1$ is aligned with the second heat shield segment second recess $\mathbf{564}d_2$ to at least partially define an aperture 567 of the heat shield 564. A center of the aperture 567 can be aligned with the fuel cup centerline 531*a*. The aperture 567 can be aligned with and define an unshielded portion 562*c* of the plate 562, which may comprise some or all of the second plate section 562*b*. The set of air tubes 570 can extend forward from the unshielded portion 562*c*. For example, rear ends 570*c* of the set of air tubes 570 can be disposed at or proximate an outer circumference or perimeter of the unshielded portion 562*c*. The unshielded portion 562*c* can include a fuel inlet 582, cooling holes 580, or both. With some examples, some pairs or each pair of adjacent dome wall sections 560 can include one full heat shield segment 564*a* and a half of two other heat shield segments 564*a*.

In some examples, such as generally illustrated in FIG. 13C, which is a partial cross-sectional view along line C-C of FIG. 13B, the heat shield 564 can be fixed to the plate 562, such as to the first plate section 562*a*. For example, the heat shield 564 can include a set of protrusions or fasteners 564*f* that extend forward from the heat shield 564 at least one of toward, into, or through the first plate section 562*a*. At least one fastener 564*f* can, for example, be welded, brazed, press-fit, or fastened via a nut 564*g* (e.g., if the fastener 564*f* includes threads) to the first plate section 562*a*. The fastener 564*f* can, with some examples, be integrally formed with the heat shield 564 or a segment 564*a* (FIG. 13B) thereof. In other examples, the fastener 564*f* can be formed separately from the heat shield 564 (e.g., as a bolt, screw, rivet, among others). In yet other examples, a heat shield 564 can include a mixture of integrally formed and separately formed fasteners 564*f*. The fasteners 564*f* can, in some configurations, be disposed at or proximate ends of the legs of an H-shaped heat shield segment 564*a*.

Referring to FIGS. 14-17B, a dome wall 646 that can be utilized for a combustor 30 is illustrated. The dome wall 646 can include aspects similar to those of the dome wall 46 (FIG. 3), 146 (FIGS. 4 and 5), 246 (FIGS. 6 and 7), 346 (FIGS. 8-9B), 446 (FIGS. 10-11B), 546 (FIGS. 12-13C); therefore, like parts will be described with like numerals further increased by 100, with it being understood that the description of the like parts of the dome wall 46, 146, 246, 346, 446, 546 can apply to the dome wall 646, except where noted.

The dome wall 646 can include a fuel cup 631, a dome wall section 660, a plate 662, a heat shield 664, a set of air tubes 670, and a fuel inlet 682. The fuel cup 631 and the dome wall section 660 can include at least portions of the plate 662 and the heat shield 664. The fuel cup 631 can include a fuel cup centerline 631*a*. The plate 662 can be coupled to the combustor liner 40, and the heat shield 664 can be coupled to the plate 662. The heat shield 664 can include one or more first air tubes $\mathbf{670}_1$ of the set of air tubes 670 (see, e.g., FIG. 14). Additionally or alternatively, the plate 662 can include one or more second air tubes $\mathbf{670}_2$ of the set of air tubes 670 (see, e.g., FIG. 16). In some configurations, the plate 662 can include one or more first air tubes $\mathbf{670}_1$ of the set of air tubes 670, and the heat shield 664 can include one or more second air tubes $\mathbf{670}_2$ of the set of air tubes 670, or vice versa. For example, the views shown in FIGS. 14 and 16 can represent two cross sections of the same fuel cup 631 offset from each other about the fuel cup centerline 631*a*.

With some aspects, a dome wall 646 can include a seal 649 that can provide a fluid seal between portions of the plate 662 and the heat shield 664. The shape of the seal 649 can correspond to the shape of the plate 662, the shape of the heat shield 664, including segments thereof, or a combination of the shapes of the plate 662 and the heat shield 664. The seal 649 can, with some aspects, include respective segments disposed at an outer edge portion 669*a* of the heat shield 664, an inner edge portion 669*b* of the heat shield 664, a first circumferential edge 669*c*, a second circumferential edge 669*d*, or a combination thereof (see, e.g., FIG. 15B). The segments of the seal 649 can be formed separately, or two or more segments can be integrally formed.

In some examples, the plate 662 can include a first portion 682*a* of the fuel inlet 682 and the heat shield 664 can include a second portion 682*b* of the fuel inlet 682. At least some of the outer surface of the second portion 682*b* can be fixed (e.g., brazed, welded, press fit, among others) to an inner surface of the first portion 682*a*.

The plate 662 can include a set of impingement holes 690 located radially inward of the set of air tubes 670, located radially outward of the set of air tubes 670, circumferentially between the set of air tubes 670, or a combination thereof.

Figure 14:
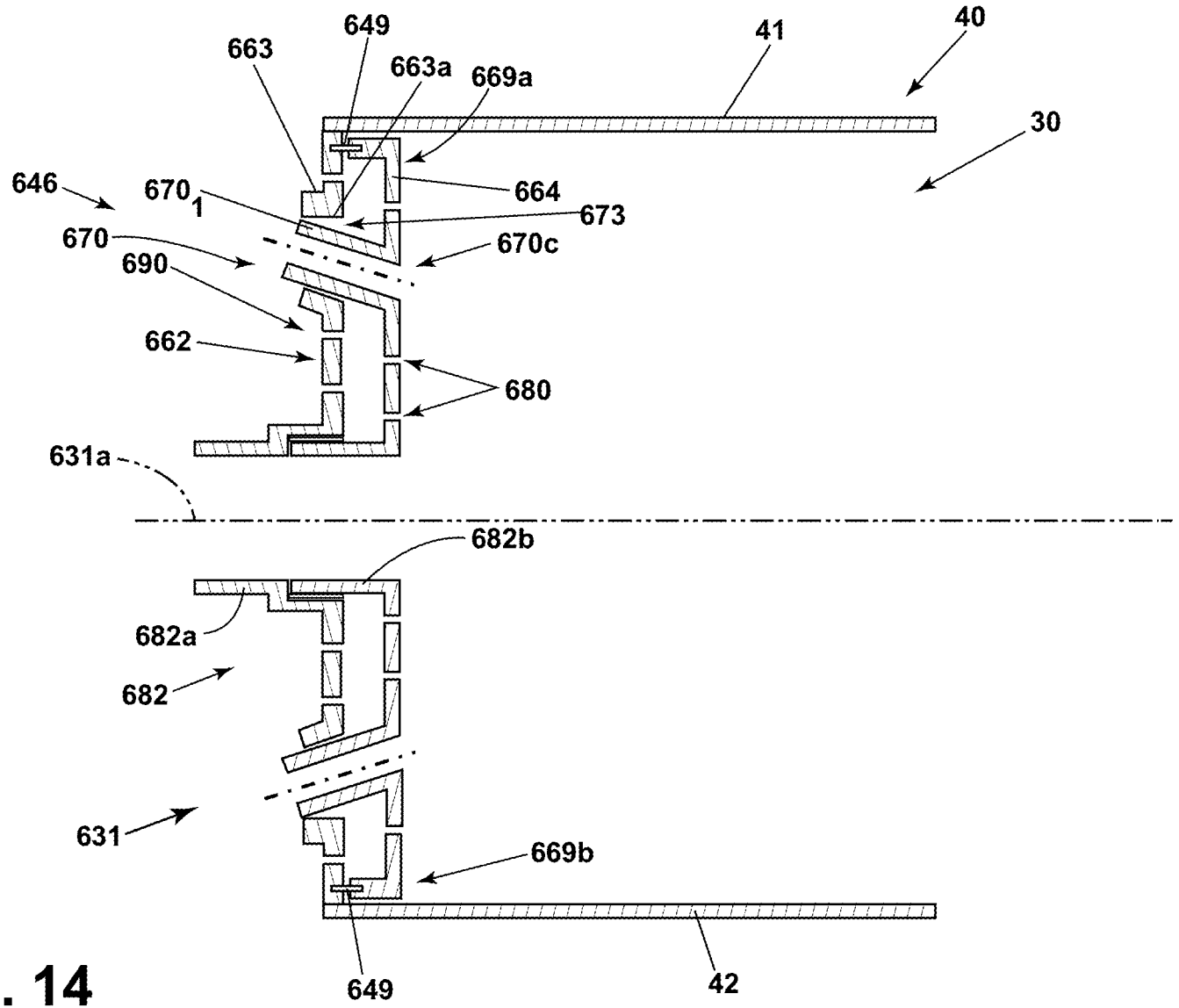
FIG. 14 is a schematic view illustrating portions of a combustor in accordance with various aspects described herein.
Figure 15A:
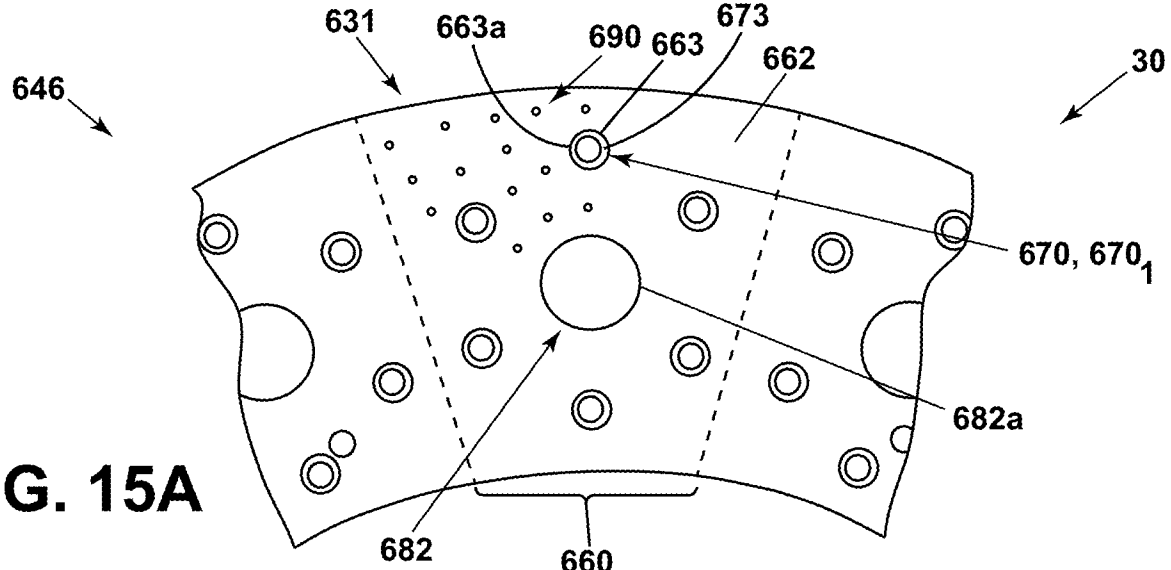
FIGS. 15A and 15B are schematic views illustrating portions of the combustor of FIG. 14, from forward looking aft, and from aft looking forward, respectively, in accordance with various aspects described herein.
Figure 15B:
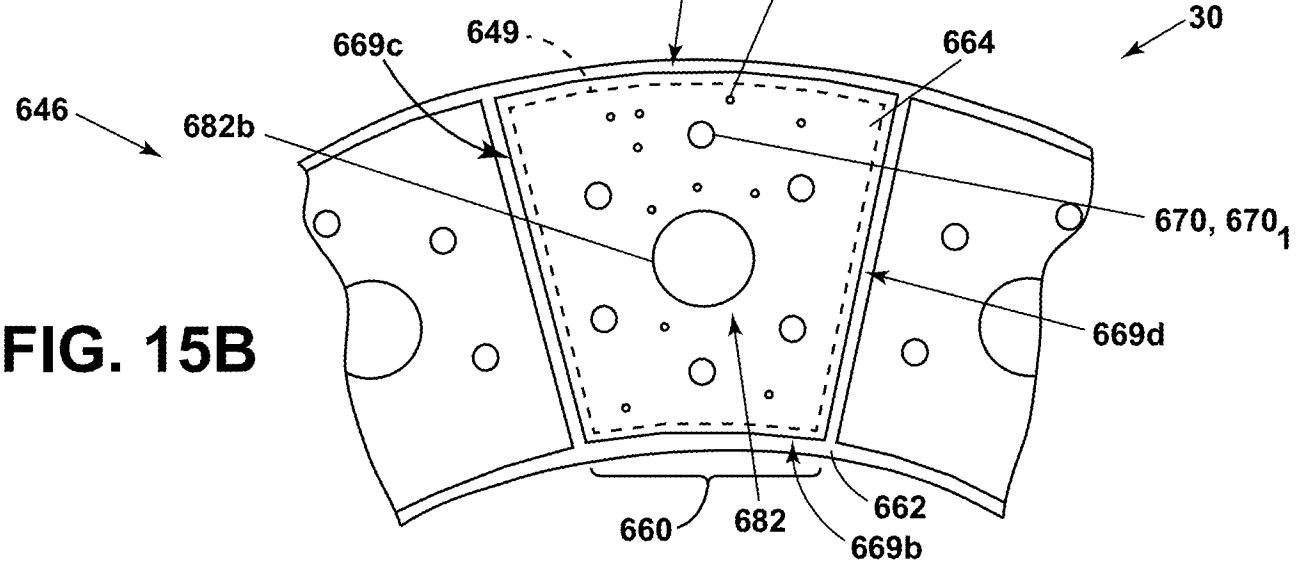

Referring to FIG. 14, the heat shield 664 can include one or more air tubes $\mathbf{670}_1$, and the plate 662 can include a set of flanges 663 that may define respective apertures 663*a*. The set of air tubes $\mathbf{670}_1$ can extend forward from the heat shield 664 into or through the set of flanges 663. The set of flanges 663 can, for example, include an annular or cylindrical configuration and can be parallel or inclined relative to the fuel cup centerline 631*a*. The set of flanges 663 can include a single continuous flange or a plurality of separate sections. The set of air tubes $\mathbf{670}_1$ can be disposed such that a gap 673 (e.g., a radial gap) is present between the set of flanges 663 and the set of air tubes $\mathbf{670}_1$. The gap 673 may, for example, provide space to accommodate for relative thermal growth between the plate 662 and the set of air tubes $\mathbf{670}_1$. The heat shield 664 can include a set of cooling holes 680 that can be disposed radially outward of a rear portion or end 670*c* of at least one of the set of air tubes $\mathbf{670}_1$, radially inward of the rear portion or end 670*c* of at least one of the set of air tubes $\mathbf{670}_1$, circumferentially between two or more of the set of air tubes $\mathbf{670}_1$, or a combination thereof. The plate 662 can include one or more of the set of impingement holes 690 disposed radially inward of the set of flanges 663, radially outward of the set of flanges 663, circumferentially between the set of air tubes 670, or a combination thereof.

Figure 16:
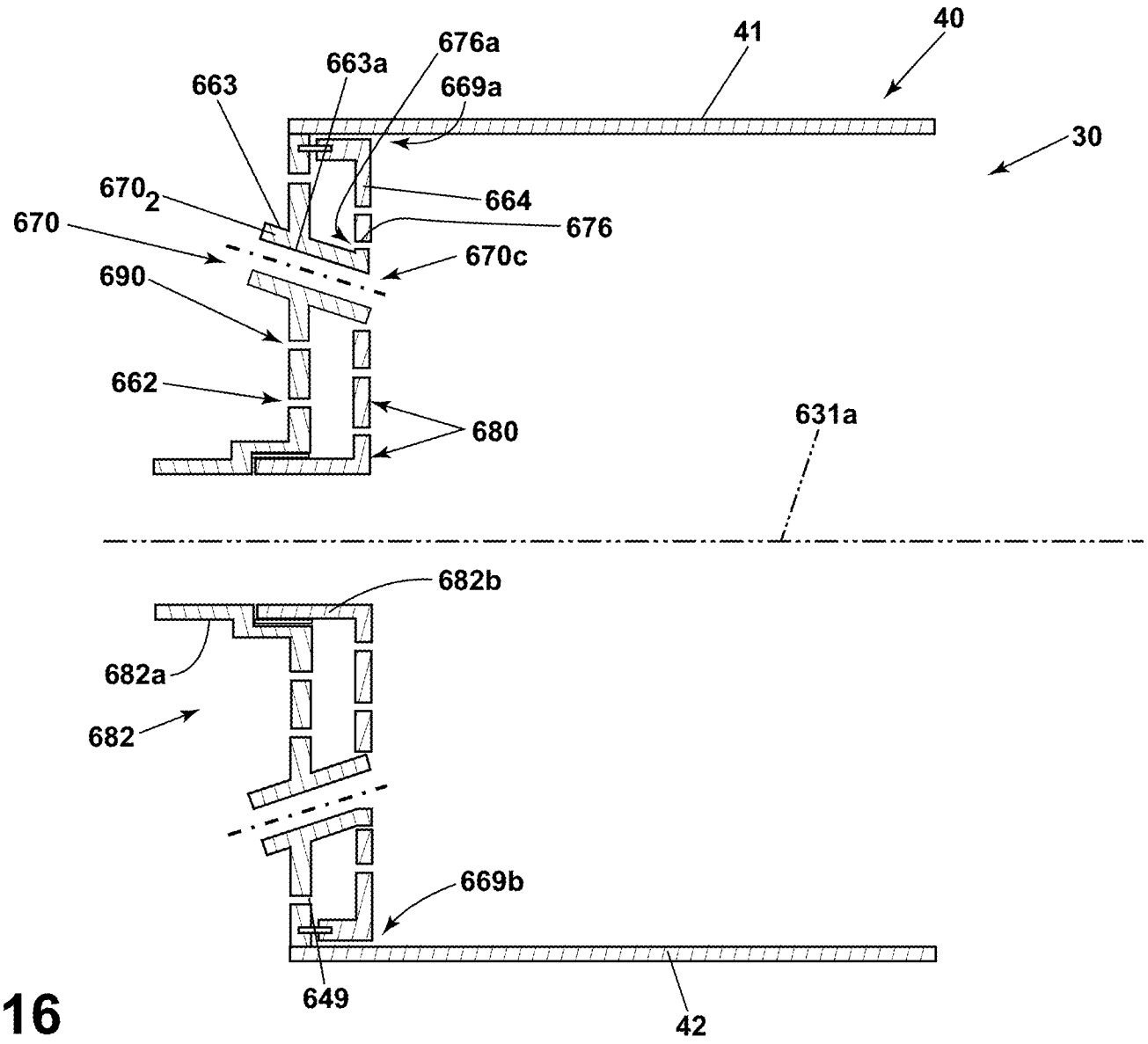
FIG. 16 is a schematic view illustrating portions of a combustor in accordance with various aspects described herein.
Figure 17A:
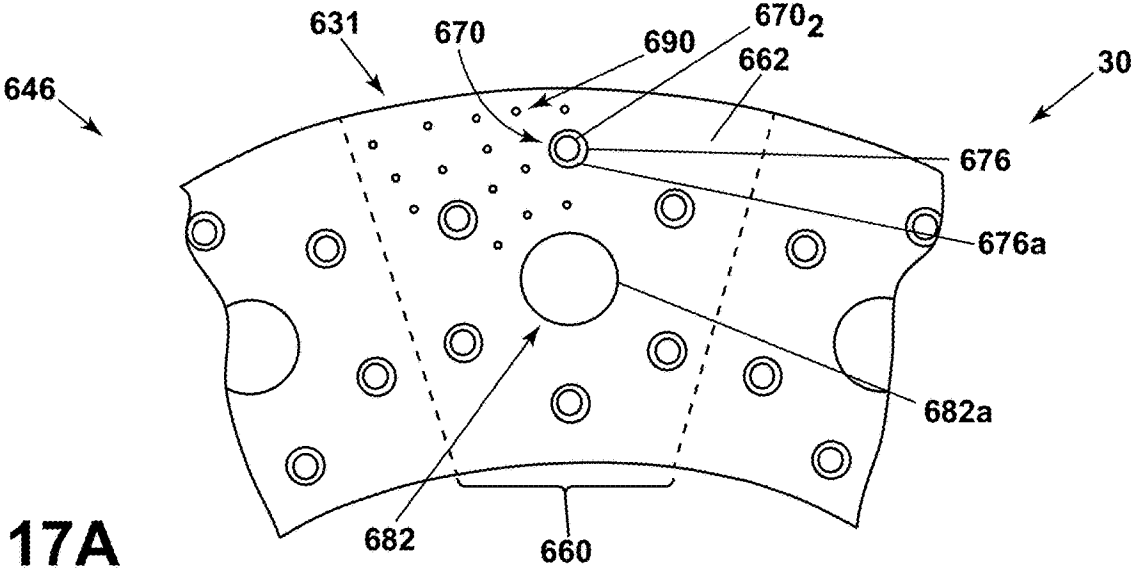
FIGS. 17A and 17B are schematic views illustrating portions of the combustor of FIG. 16, from forward looking aft, and from aft looking forward, respectively, in accordance with various aspects described herein.
Figure 17B:
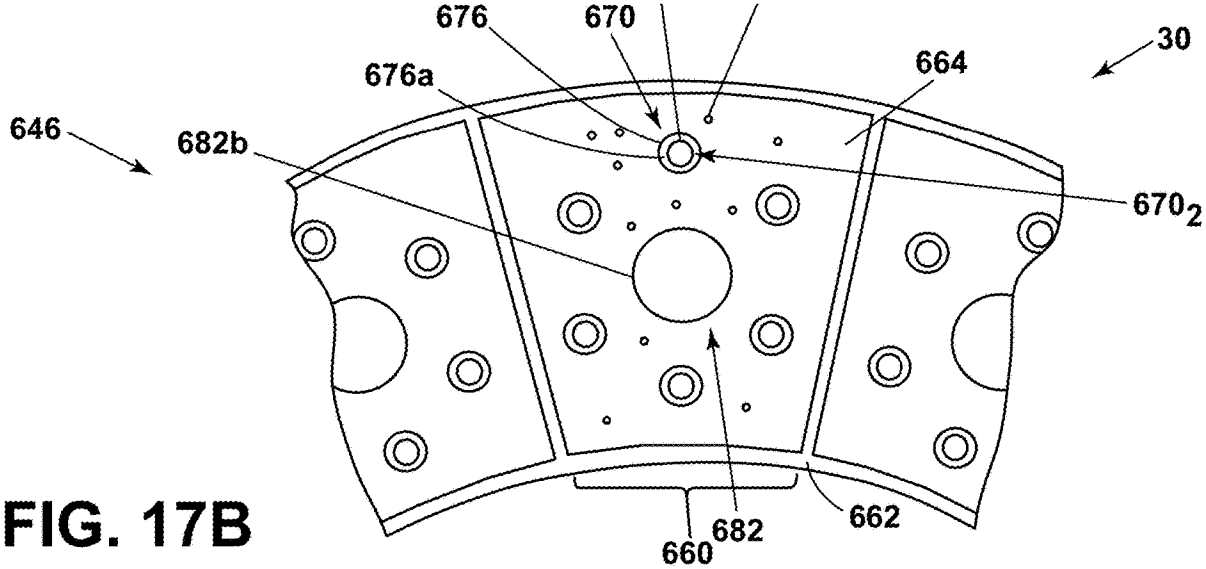
Figure 18:
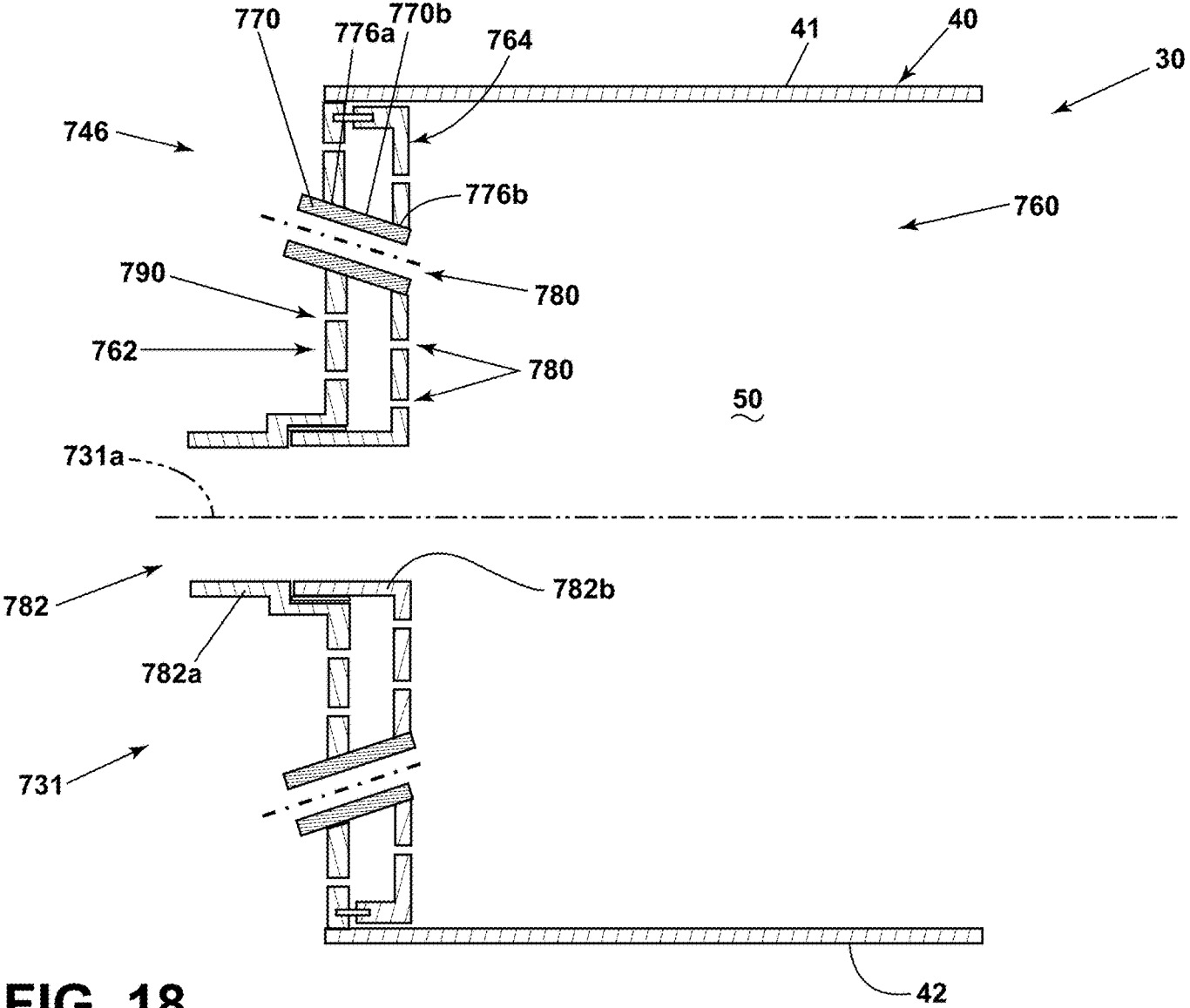
FIG. 18 is a schematic view illustrating portions of a combustor in accordance with various aspects described herein.
Figure 19A:
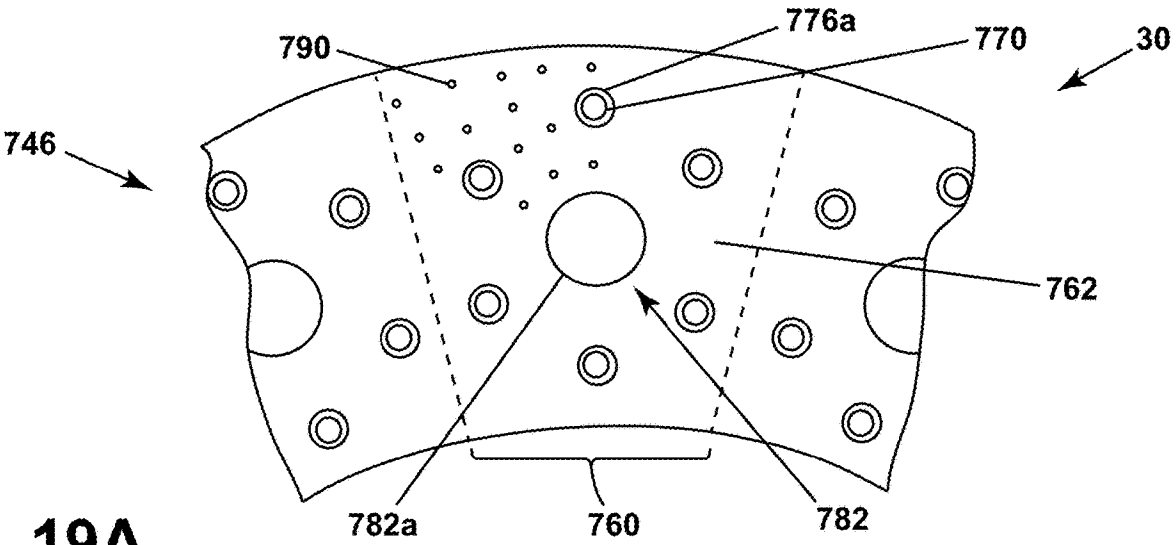
FIGS. 19A and 19B are schematic views illustrating portions of the combustor of FIG. 18, from forward looking aft, and from aft looking forward, respectively, in accordance with various aspects described herein.
Figure 19B:
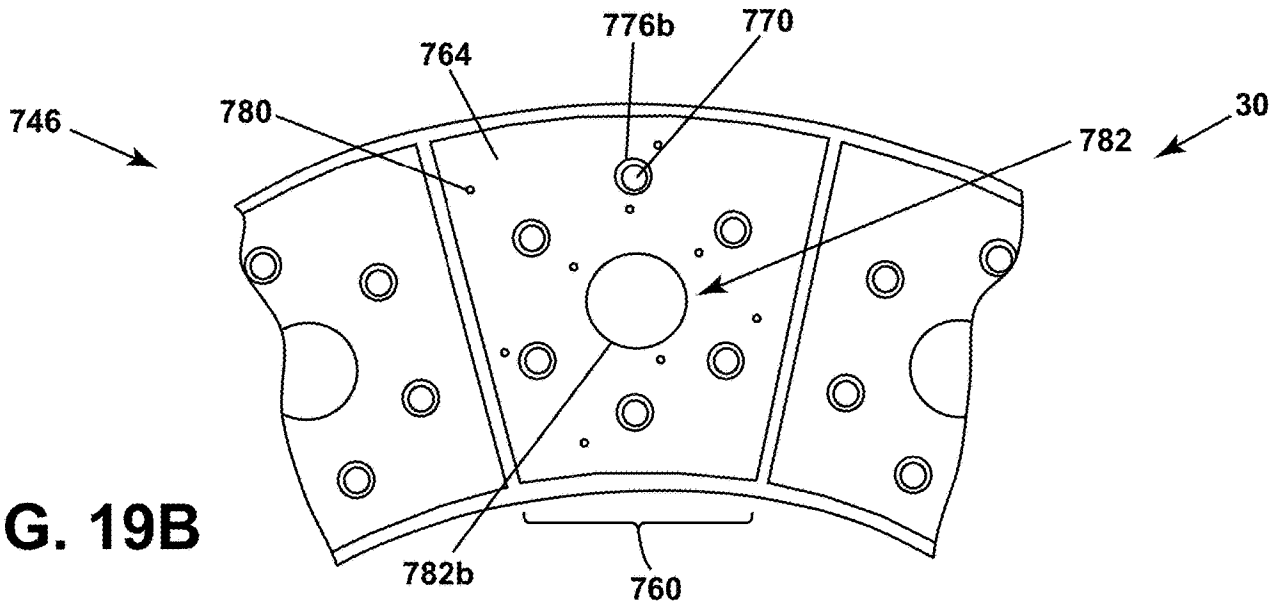

Referring to FIG. 16, the plate 662 can include one or more of the set of air tubes $\mathbf{670}_2$ that can extend rearward from the plate 662 into the heat shield 664, such as into one or more air tube apertures 676. The rear portions or ends 670*c* of the one or more air tubes $\mathbf{670}_2$ can be disposed in the one or more air tube apertures 676 of the heat shield 664 such that a gap 676*a* is present between the rear portion or end 670*c* and the heat shield 664. The gap 676*a* can, for example, provide space to accommodate for relative thermal growth between the air tube $\mathbf{670}_2$ and the heat shield 664, between the plate 662 and the heat shield 664, or a combination thereof. At least a subset of the set of cooling holes 680 can be disposed radially outward of the one or more apertures 676, radially inward of the one or more apertures 676, circumferentially between apertures 676, or a combination thereof.

A radial extent of the heat shield 664 can, for example, be equal to or between 90% and 100% of a radial extent of the plate 662 measured in a plane that extends through the combustor centerline 30*a* and through the fuel cup centerline 631*a*.

Referring to FIGS. 18-23B, a dome wall 746 that can be utilized for a combustor 30 is illustrated. The dome wall 746 can include aspects similar to those of the dome wall 46 (FIG. 3), 146 (FIGS. 4 and 5), 246 (FIGS. 6 and 7), 346 (FIGS. 8-9B), 446 (FIGS. 10-11B), 546 (FIGS. 12-13C), 646 (FIGS. 14-17B); therefore, like parts will be described with like numerals further increased by 100, with it being understood that the description of the like parts of the dome wall 46, 146, 246, 346, 446, 546, 646 can apply to the dome wall 746, except where noted.

The dome wall 746 can include a fuel cup 731, a dome wall section 760, a plate 762, a heat shield 764, a set of air tubes 770, and a fuel inlet 782. The fuel cup 731 and the dome wall section 760 can include at least portions of the plate 762, the heat shield 764, and the set of air tubes 770. The fuel cup 731 can include a fuel cup centerline 731*a*. The plate 762 can be coupled to the combustor liner 40, and the heat shield 764 can be coupled to the plate 762. The set of air tubes 770 can be formed separately from and connected to the plate 762, the heat shield 764, or the plate 762 and the heat shield 764. In some configurations, each of the set of air tubes 770 can be fixed (e.g., brazed, welded, press fit, fastened, among others) to one of the plate 762 and the heat shield 764, and floating relative to the other of the plate 762 and the heat shield 764, such as to compensate for relative thermal growth. The plate 762 and the heat shield 764 can include corresponding apertures 776*a*, 776*b* into which the set of air tubes 770 can be inserted. The apertures 776*a*, 776*b* can be offset in the radial direction. For example, at least some of the apertures 776*a*, 776*b* can be offset such that at least portions of the apertures 776*a* of the plate 762 are disposed radially outward of the apertures 776*b* of the plate 762, relative to the fuel cup centerline 731*a*. Additionally or alternatively, at least some of the apertures 776*a*, 776*b* can be offset such that at least portions of the apertures 776*a* of the plate 762 are disposed radially inward of the apertures 776*b* of the plate. Additionally or alternatively, at least some of the apertures 776*a*, 776*b* can be aligned with each other. The plate 762 can include a first portion 782*a* of the fuel inlet 782. The heat shield 764 can include a second portion 782*b* of the fuel inlet 782 that may be disposed at least partially in and fixed to the first portion 782*a*. The heat shield 764 can include a set of cooling holes 780.

Figure 20:
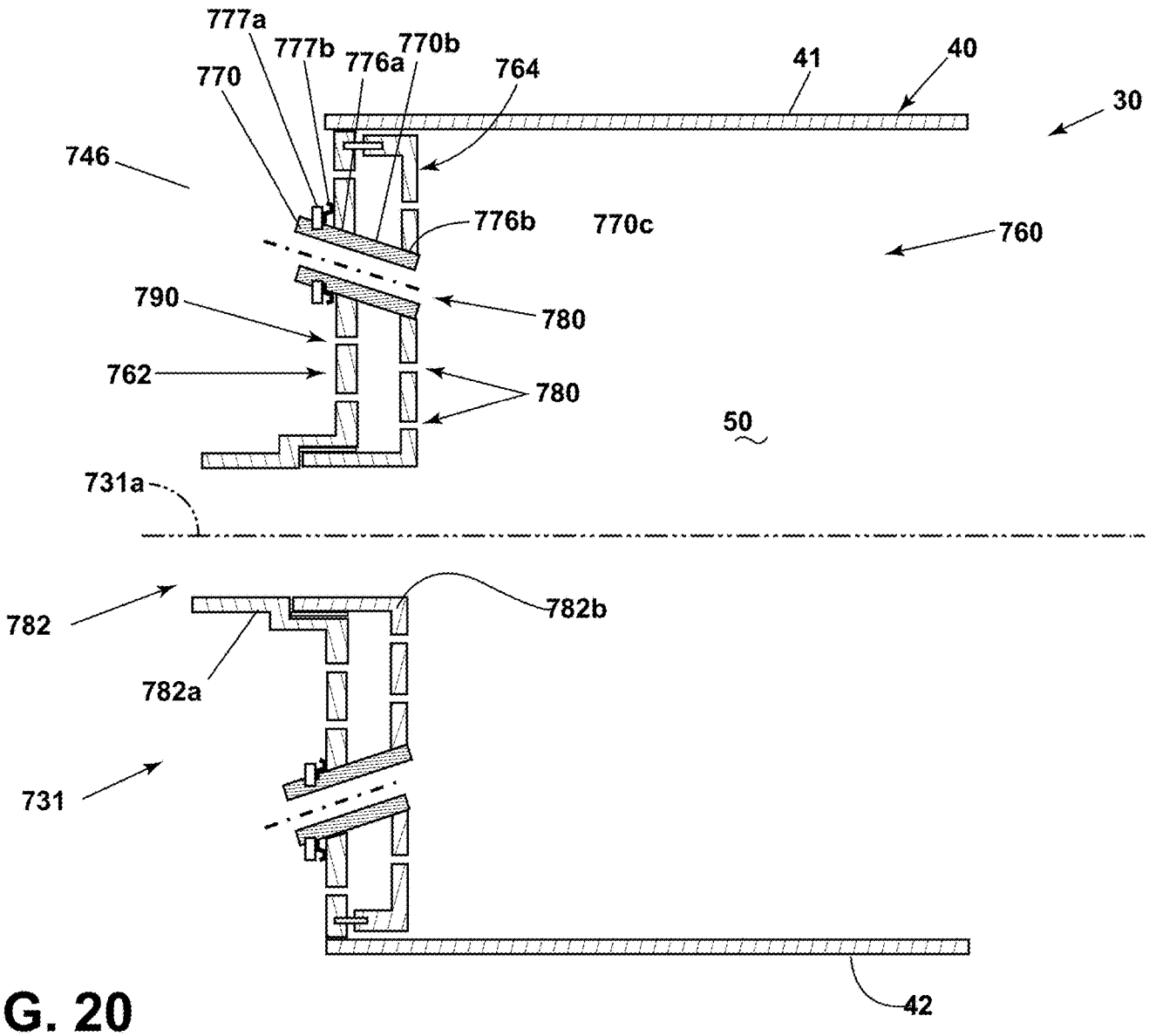
FIG. 20 is a schematic view illustrating portions of a combustor in accordance with various aspects described herein.
Figure 21A:
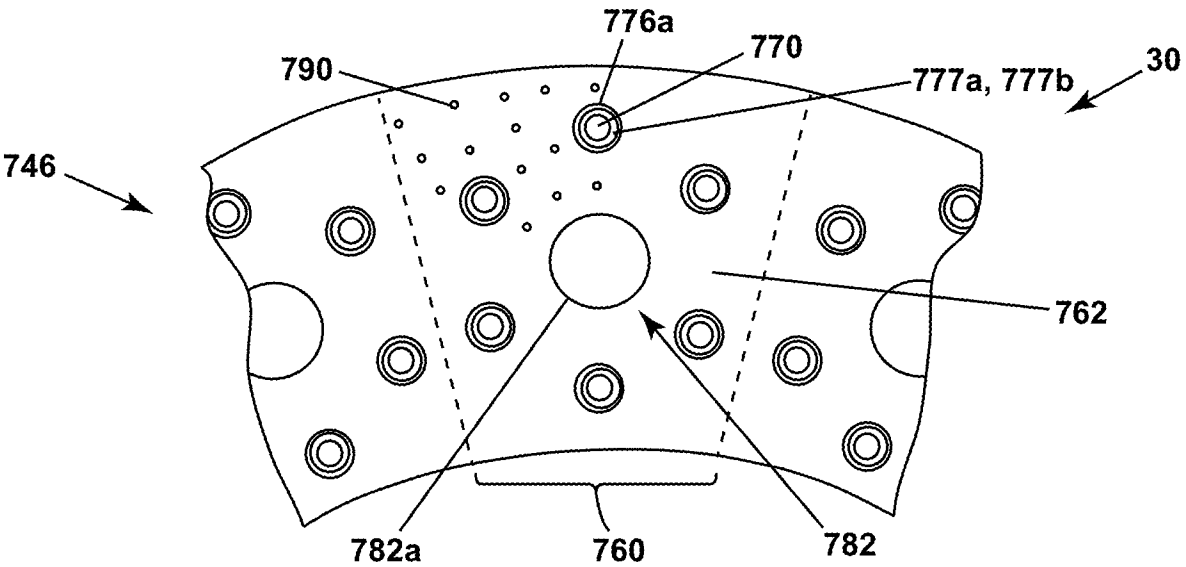
FIGS. 21A and 21B are schematic views illustrating portions of the combustor of FIG. 20, from forward looking aft, and from aft looking forward, respectively, in accordance with various aspects described herein.
Figure 21B:
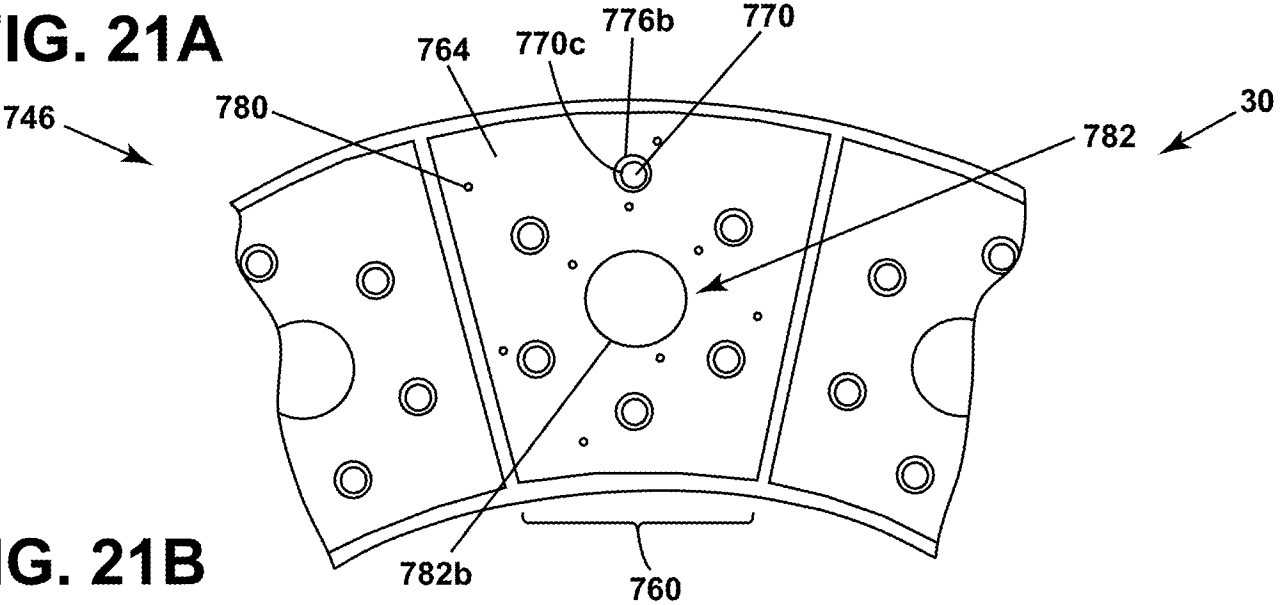

Referring to FIG. 20, one or more of the set of air tubes 770 can be connected to the plate 762 via at least one of a snap ring 777*a* or a seal 777*b*, such as a spring seal. Additionally or alternatively, a rear end 770*c* of the set of air tubes 770 can be fixed to the heat shield 764. The seal 777*b* can be adjacent or in contact with a forward surface 762*c* of the plate 762 and can restrict fluid flow between an outer surface 770*b* of the one or more of the set of air tubes 770 and the plate 762, which may improve impingement cooling of the heat shield 764 via a set of impingement holes 790 of the plate 762. The snap ring 777*a* can restrict movement of the seal 777*b*, such as to maintain the seal 777*b* in sealing contact with the plate 762.

Figure 22:
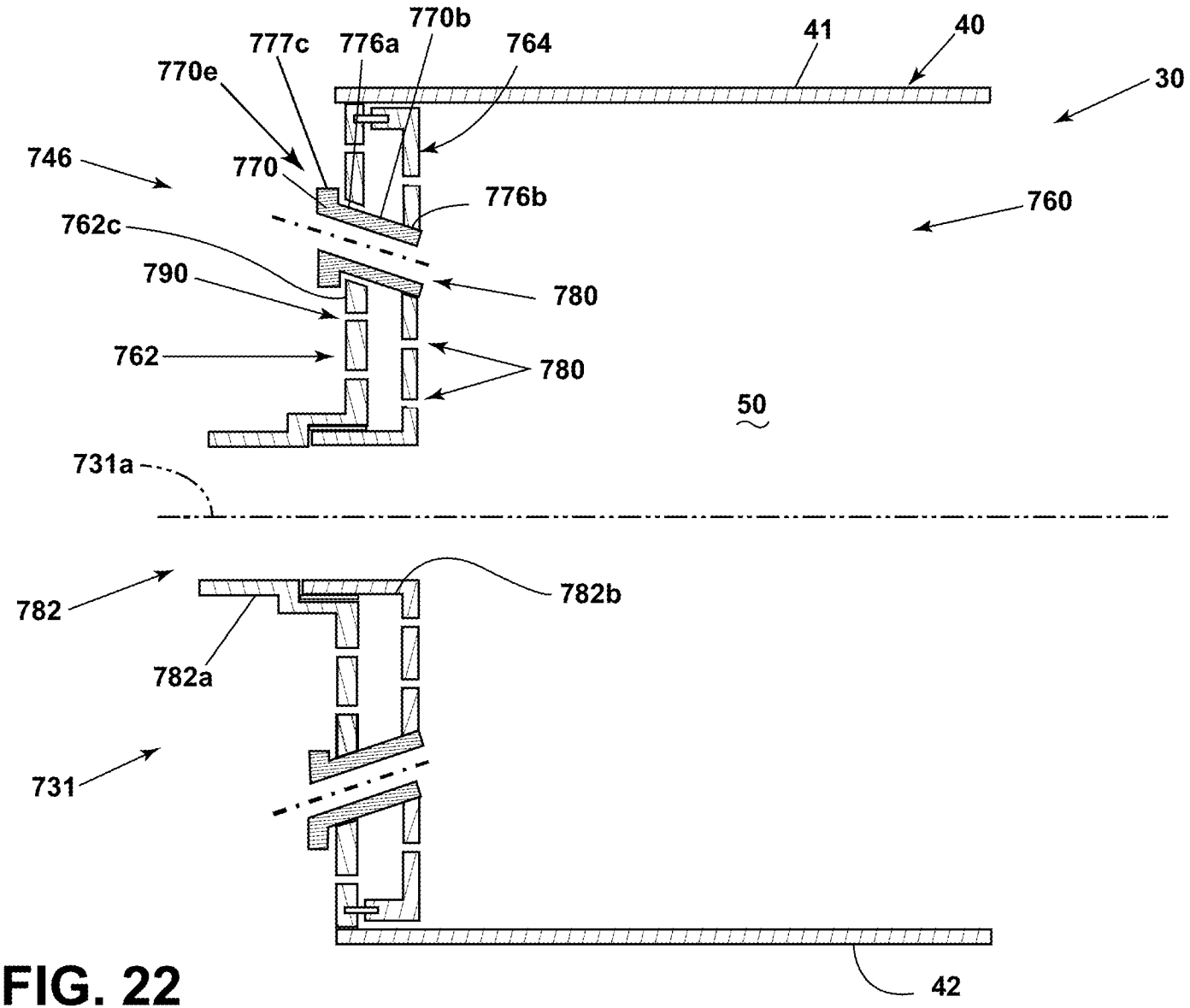
FIG. 22 is a schematic view illustrating portions of a combustor in accordance with various aspects described herein.
Figure 23A:
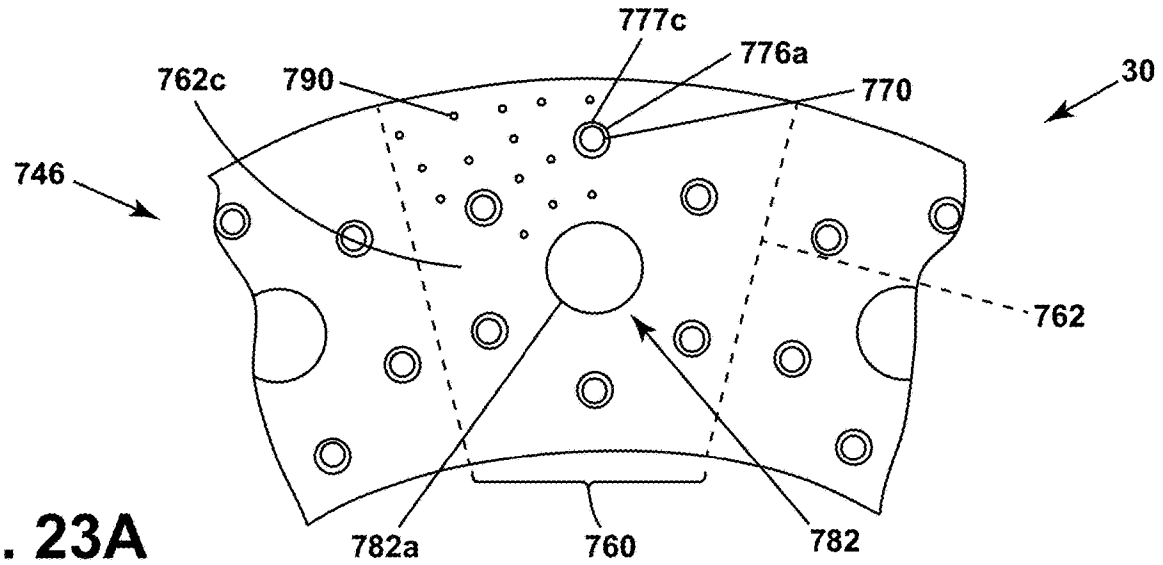
FIGS. 23A and 23B are schematic views illustrating portions of the combustor of FIG. 22, from forward looking aft, and from aft looking forward, respectively, in accordance with various aspects described herein.
Figure 23B:
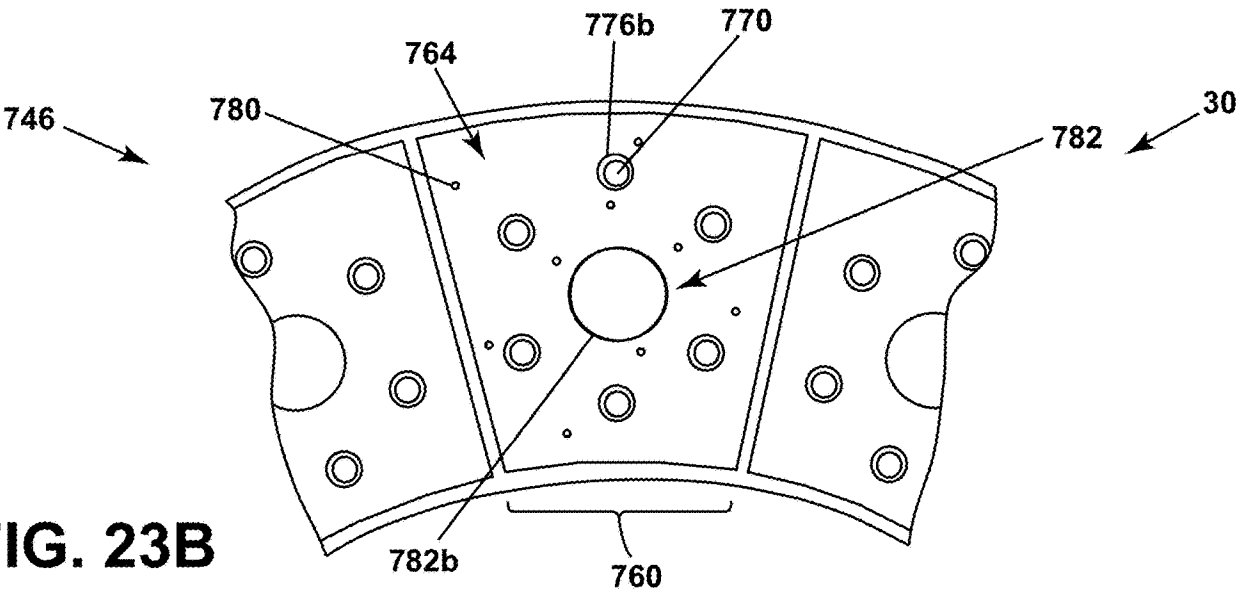
Figure 24:
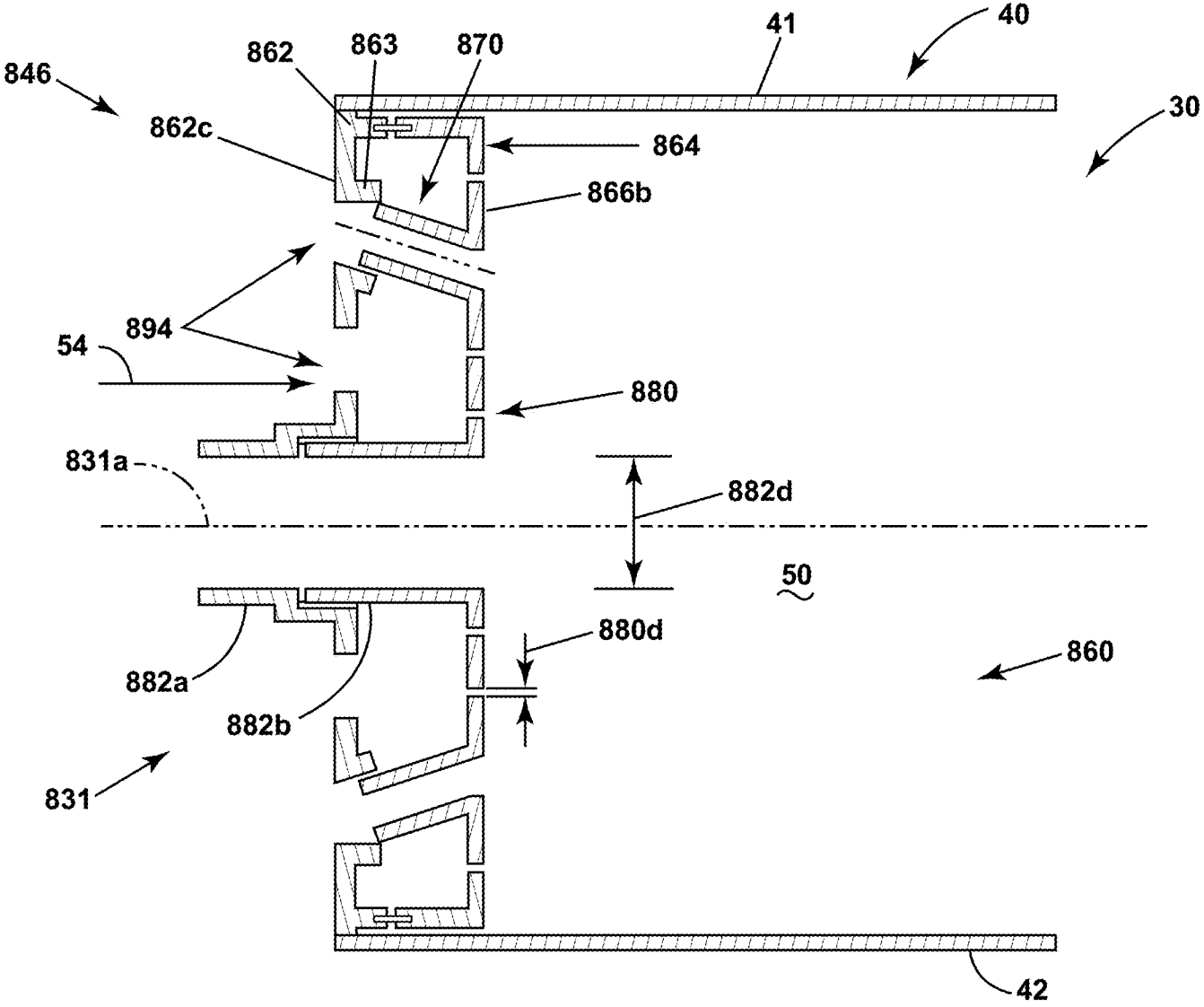
FIG. 24 is a schematic view illustrating portions of a combustor in accordance with various aspects described herein.
Figure 25A:
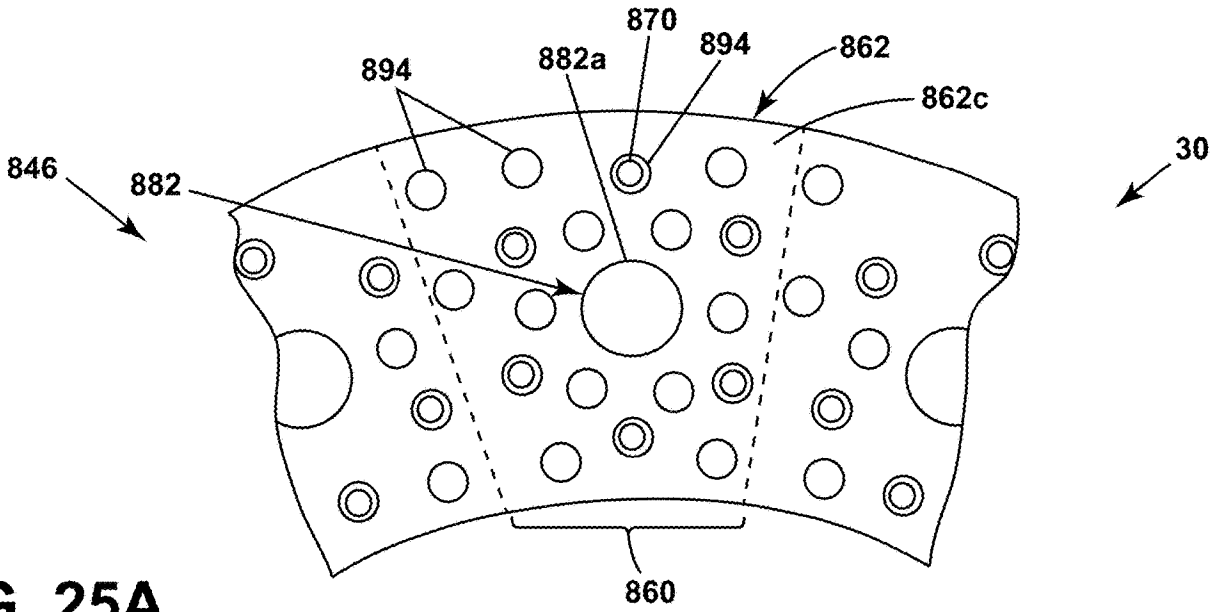
FIGS. 25A and 25B are schematic views illustrating portions of the combustor of FIG. 24, from forward looking aft, and from aft looking forward, respectively, in accordance with various aspects described herein.
Figure 25B:
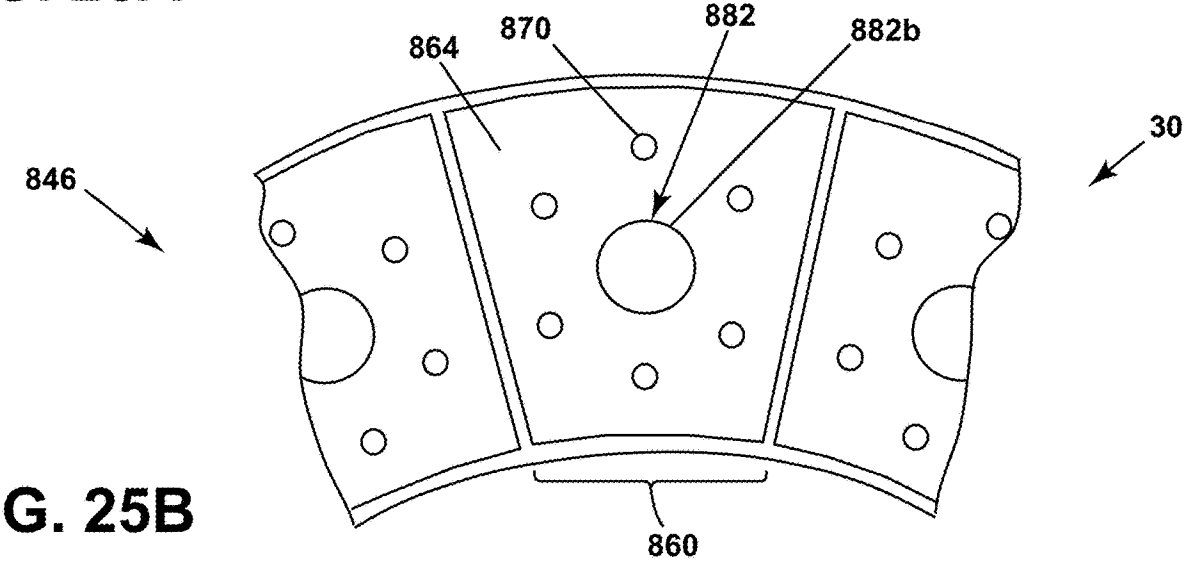

Referring to FIG. 22, one or more air tubes 770 of the set of air tubes 770 can comprise a discourager seal 777*c*. The discourager seal 777*c* can be adjacent or in contact with a forward surface 762*c* of the plate 762. In some examples, the discourager seal 777*c* can be integrally formed with the one or more air tubes 770, such as at or about a front end 770*e* of the one or more tubes 770. The discourager seal 777*c* can be adjacent or in contact with a forward surface 762*c* of the plate 762 and can restrict fluid flow between an outer surface 770*b* of the one or more of the set of air tubes 770 and the plate 762, which may improve impingement cooling of the heat shield 764 via the set of impingement holes 790 of the plate 762.

Referring to FIGS. 24-29B, a dome wall 846 that can be utilized for a combustor 30 is illustrated. The dome wall 846 can include aspects similar to those of the dome wall 46 (FIG. 3), 146 (FIGS. 4 and 5), 246 (FIGS. 6 and 7), 346 (FIGS. 8-9B), 446 (FIGS. 10-11B), 546 (FIGS. 12-13C), 646 (FIGS. 14-17B), 746 (FIGS. 18-23B); therefore, like parts will be described with like numerals further increased by 100, with it being understood that the description of the like parts of the dome wall 46, 146, 246, 346, 446, 546, 646, 746 can apply to the dome wall 846, except where noted.

The dome wall 846 can include a fuel cup 831, a dome wall section 860, a plate 862, a heat shield 864, and a fuel inlet 882. The fuel cup 831 and the dome wall section 860 can include at least portions of the plate 862 and the heat shield 864. The fuel cup 831 can include a fuel cup centerline 831*a*. The plate 862 can include a first portion 882*a* of the fuel inlet 882. The heat shield 864 can include a second portion 882*b* of the fuel inlet 882 that may be disposed at least partially in and fixed to the first portion 882*a*.

The plate 862 can be coupled to the combustor liner 40, and the heat shield 864 can be coupled to the plate 862. The heat shield 864 can include a set of air tubes 870. The set of air tube 870 can include air tubes that are integrally formed with the heat shield 864, air tubes that are formed separately from and then joined with the heat shield 864, or a combination thereof. One or more of the set of air tubes 870 can extend short of a forward surface 862*c* of the plate 862, and a set of cooling holes 880. For example, one or more of the set of air tubes 870 may extend into the plate 862 and may or may not extend beyond the plate 862. Additionally or alternatively, one or more of the set of air tubes 870 may extend forward toward and short of the plate 862. The plate 862 can include one or more flanges or raised portions 863 that extend rearward to interface with the set of air tubes 870. Additionally or alternatively, the plate 862 can be flat, at least in some portions.

With some aspects, the plate 862 can include a set of feeding holes 894. A feeding hole diameter 894*d* (e.g., a hydraulic diameter) of some or all of the set of feeding holes 894 can be larger than an air tube inner diameter 870*d* (e.g., a hydraulic diameter) of one or more of the set of air tubes 870, or can be larger than the inner diameter 870*d* and an outer diameter of the one or more air tubes 870. Additionally or alternatively, a cooling hole diameter 880*d* (e.g., a hydraulic diameter) of the set of cooling holes 880 can be less (e.g., half or less) than the air tube inner diameter 870*d*, the feeding hole diameter 894*d*, or both. The inner diameter 882*d* (e.g., a hydraulic diameter) of the fuel inlet 882 can be larger than the diameters of the air tubes 870, the set of cooling holes 880, and the set of feeding holes 894. A plate 862 may, in some examples, include the set of feeding holes 894 instead of impingement holes. The feeding holes 894 may be configured to minimally affect or not significantly affect the flow of air 54 to the heat shield 864.

Figure 26:
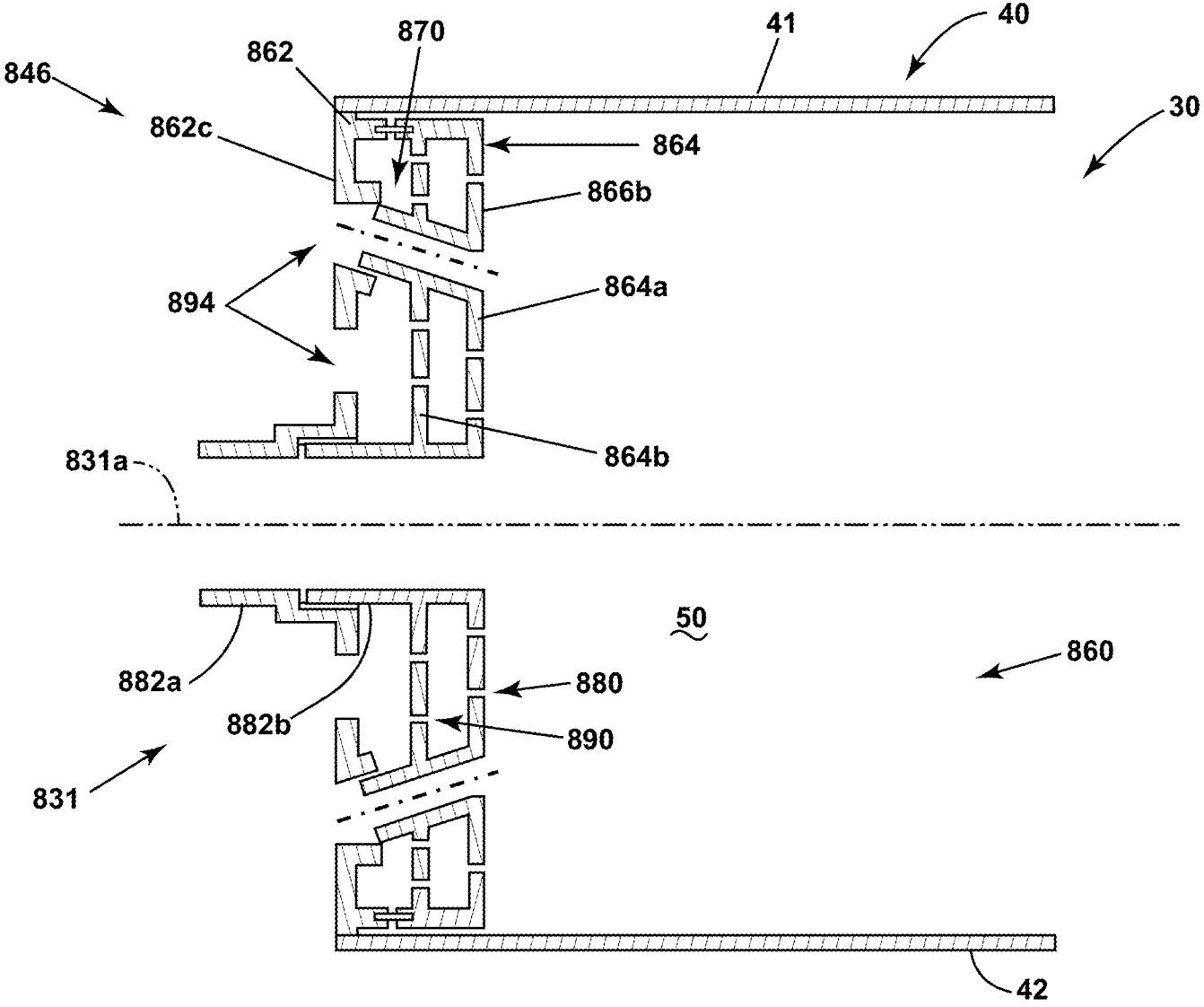
FIG. 26 is a schematic view illustrating portions of a combustor in accordance with various aspects described herein.
Figure 27A:
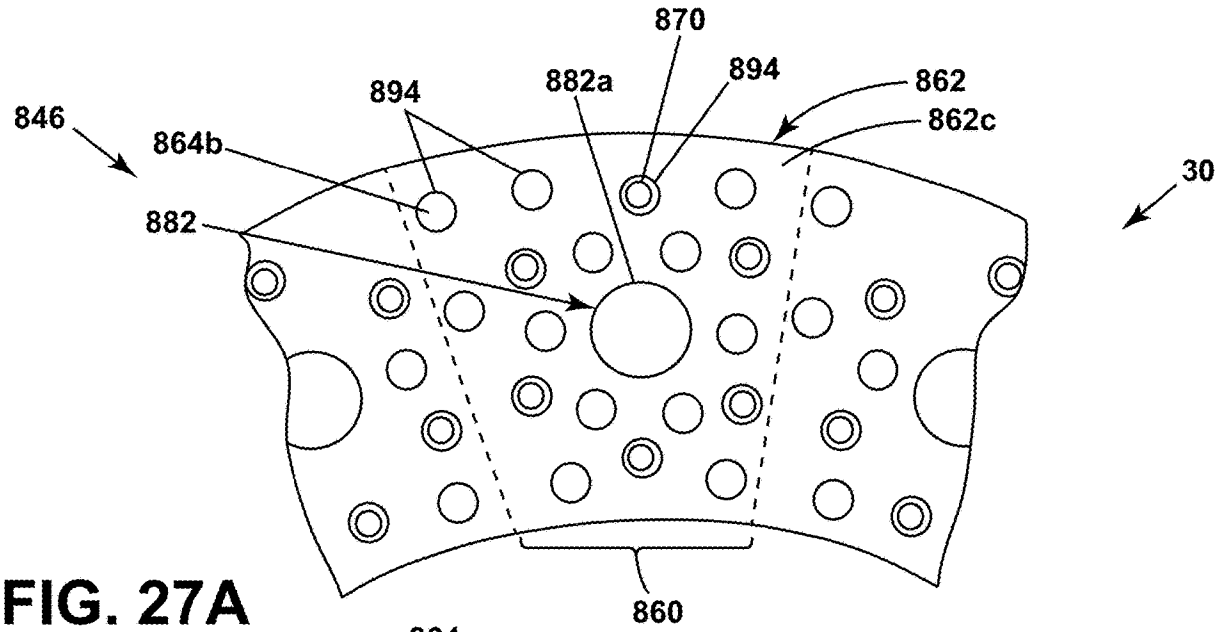
FIGS. 27A and 27B are schematic views illustrating portions of the combustor of FIG. 26, from forward looking aft, and from aft looking forward, respectively, in accordance with various aspects described herein.
Figure 27B:
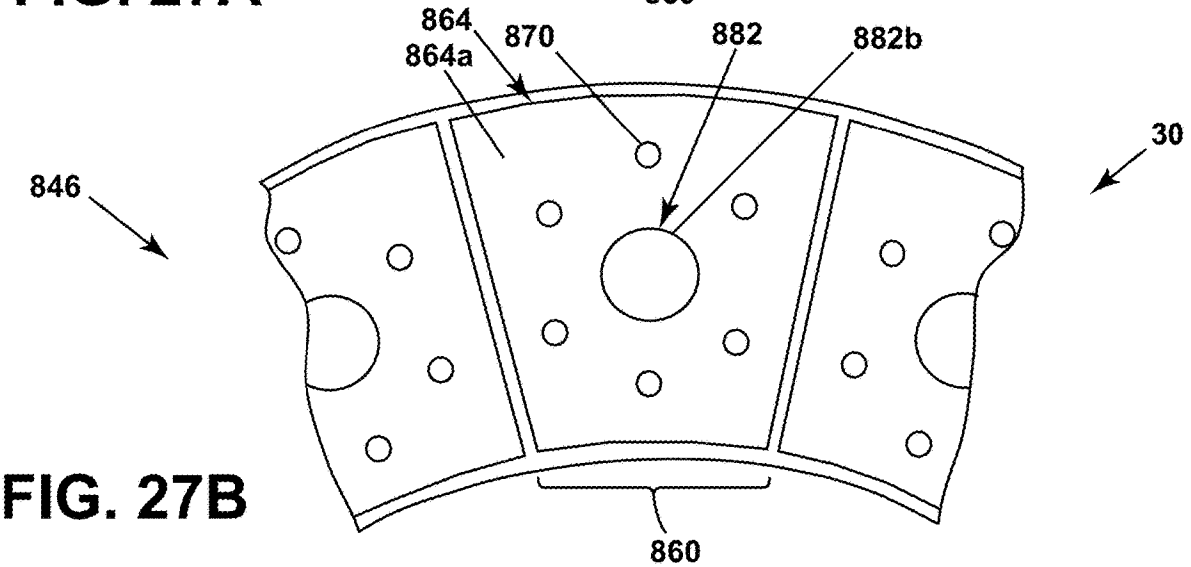

Referring to FIG. 26, the heat shield 864 can include a dual-wall configuration comprising a first heat shield wall 864*a* and a second heat shield wall 864*b* disposed axially between the first heat shield wall 864*a* and the plate 862. The first heat shield wall 864*a* can comprise the set of cooling holes 880. Additionally or alternatively, the second heat shield wall 864*b* can comprise a set of impingement holes 890 that may be configured to facilitate cooling of the first heat shield wall 864*a*. The set of impingement holes 890 may be radially offset, circumferentially offset, or radially and circumferentially offset from the cooling holes 880. The hydraulic diameters of the set of impingement holes 890 can, for example, be equal to or less than 50% of the hydraulic diameters of the set of air tubes 870.

One of more of the set of air tubes 870 can extend forward from the first heat shield wall 864*a* through the second heat shield wall 864*b* and at least partially into the plate 862. Additionally or alternatively, one or more of the set of air tubes 870 can extend forward from the first heat shield wall 864*a* and may extend to or short of the plate 862.

Some or all of the set of air tubes 870 and the heat shield 864, including the first heat shield wall 864*a* and the second heat shield wall 864*b*, can be formed as a monolithic component, such as via investment casting, additive manufacturing, or both. Additionally or alternatively, one or more of the set of air tubes 870 may be formed separate from and then attached to the heat shield 864, such as via welding, brazing, or other methods.

Figure 28:
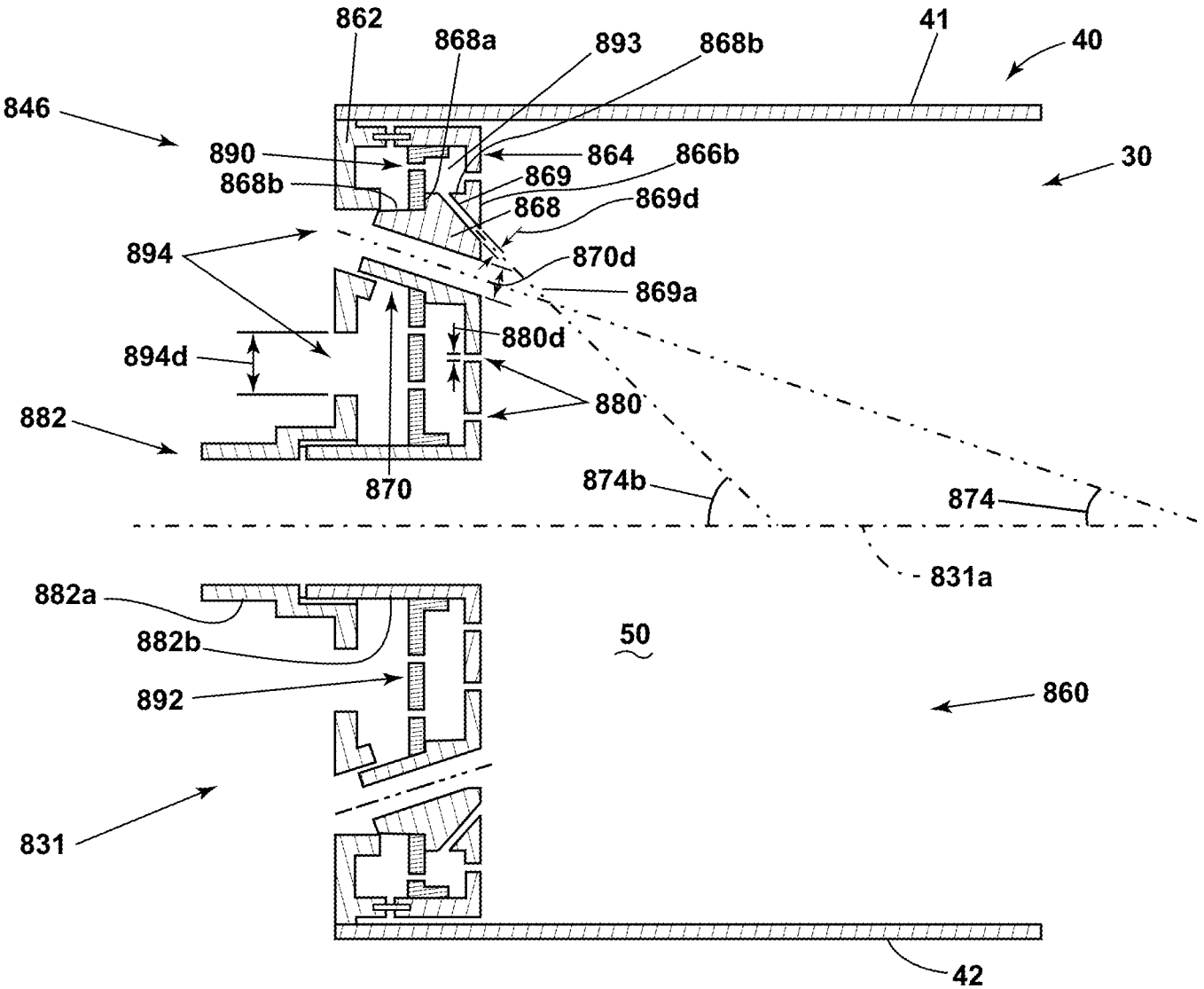
FIG. 28 is a schematic view illustrating portions of a combustor in accordance with various aspects described herein.
Figure 29A:
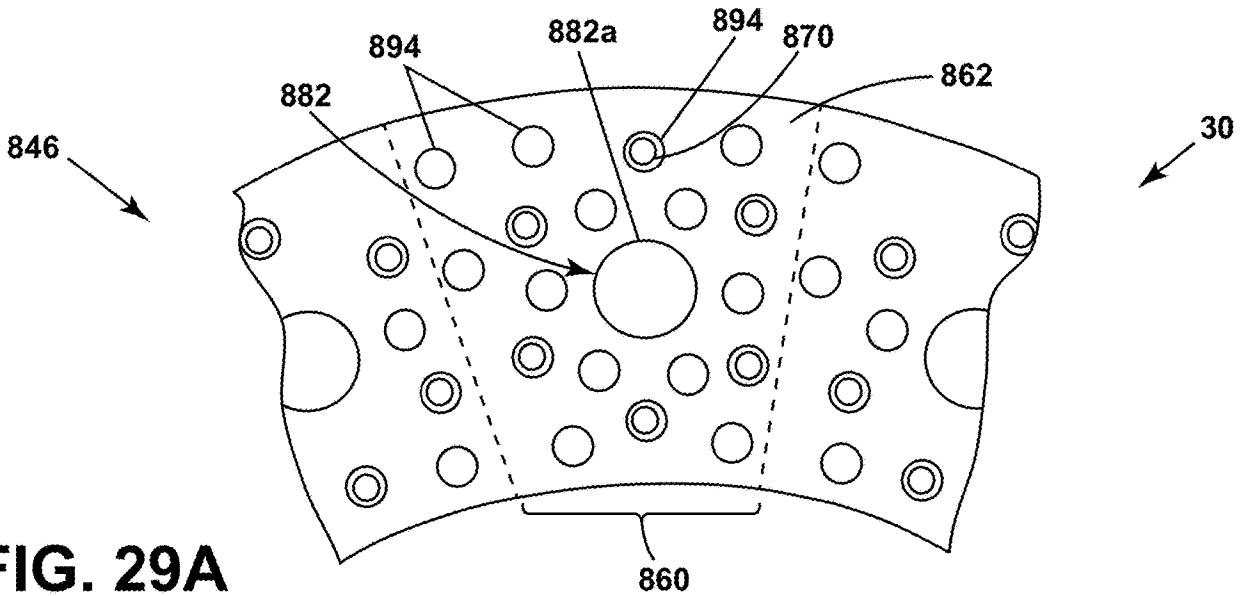
FIGS. 29A and 29B are schematic views illustrating portions of the combustor of FIG. 28, from forward looking aft, and from aft looking forward, respectively, in accordance with various aspects described herein.
Figure 29B:
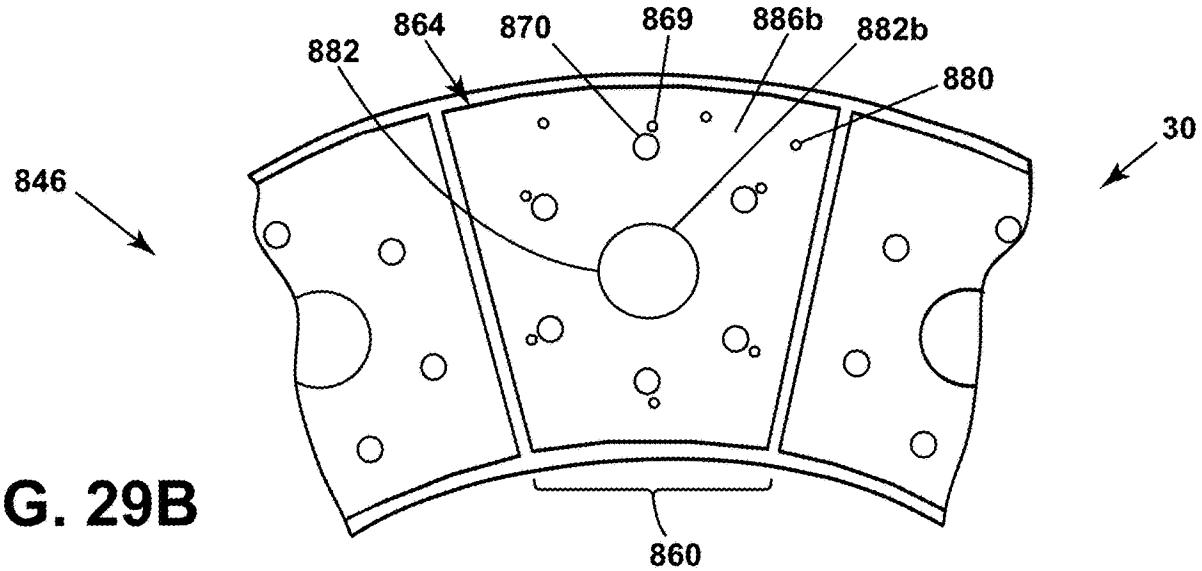

Referring to FIG. 28, the dome wall 846 can include an impingement baffle 892 that can be disposed between the heat shield 864 and the plate 862, such as instead of or in addition to a second heat shield wall 864*b* (FIG. 26). One of more of the set of air tubes 870 can extend forward from the heat shield 864 to, into, or through the impingement baffle 892 and short of, at least partially into, or through the plate 862.

With some aspects, the heat shield 864 can include a set of protrusions 868 extending away from the combustion chamber 50 (e.g., forward). At least one of the set of air tubes 870 can be at least partially defined by the set of protrusions 868. The set of protrusions 868 can, for example, include a protrusion for each of the set of air tubes 870. In some examples, the set of protrusions 868 can include a protrusion (e.g., an annular protrusion) that at least partially defines a plurality of air tubes 870. In some configurations, the set of protrusions 868 can include a set of cooling passages 869. A cooling passage centerline 869*a* of the set of cooling passages 869 can be disposed at a second angle 874*b* (e.g., an oblique or 0 or 180 degree angle) relative to the fuel cup centerline 831*a*. The second angle 874*b* can be different than an angle 874 (e.g., an oblique angle) of the set of air tubes 870 relative to the fuel cup centerline 831*a*. The cooling passage 869 can fluidly couple a space 893 between the impingement baffle 892 and the heat shield 864 with the combustion chamber 50. The set of cooling passages 869 can extend from a rear surface 866*b* of the heat shield 864 to an outer radial surface 868*b* of the protrusion 868. With some configurations, the cooling passage 869 can be shorter and have a diameter 869*d* (e.g., a hydraulic diameter) that is smaller than the diameter(s) 870*d* of the set of air tubes 870. The cooling passage 869 can be longer than the set of cooling holes 880. For example and without limitation, one or more of the set of cooling passages 869 can be at least three times longer than one or more of the set of cooling holes 880.

The impingement baffle 892 can be in contact with the set of protrusions 868. The impingement baffle 892 can be coupled (e.g., fixed) to the heat shield 864 via one or more of the set of protrusions 868. For example, one or more of the set of protrusions 868 can include a forward axial surface 868*a* and the outer radial surface 868*b*, and the impingement baffle 892 can be fixed (e.g., brazed, welded, press fit, among others) with the forward axial surface 868*a*, the outer radial surface 868*b*, or both. In some configurations, the impingement baffle 892 can be coupled to the heat shield 864 exclusively via one or more of the set of protrusions 868, but can be coupled to the plate 862, the liner 40, or both, in additional or alternative manners in other configurations.

Figure 30:
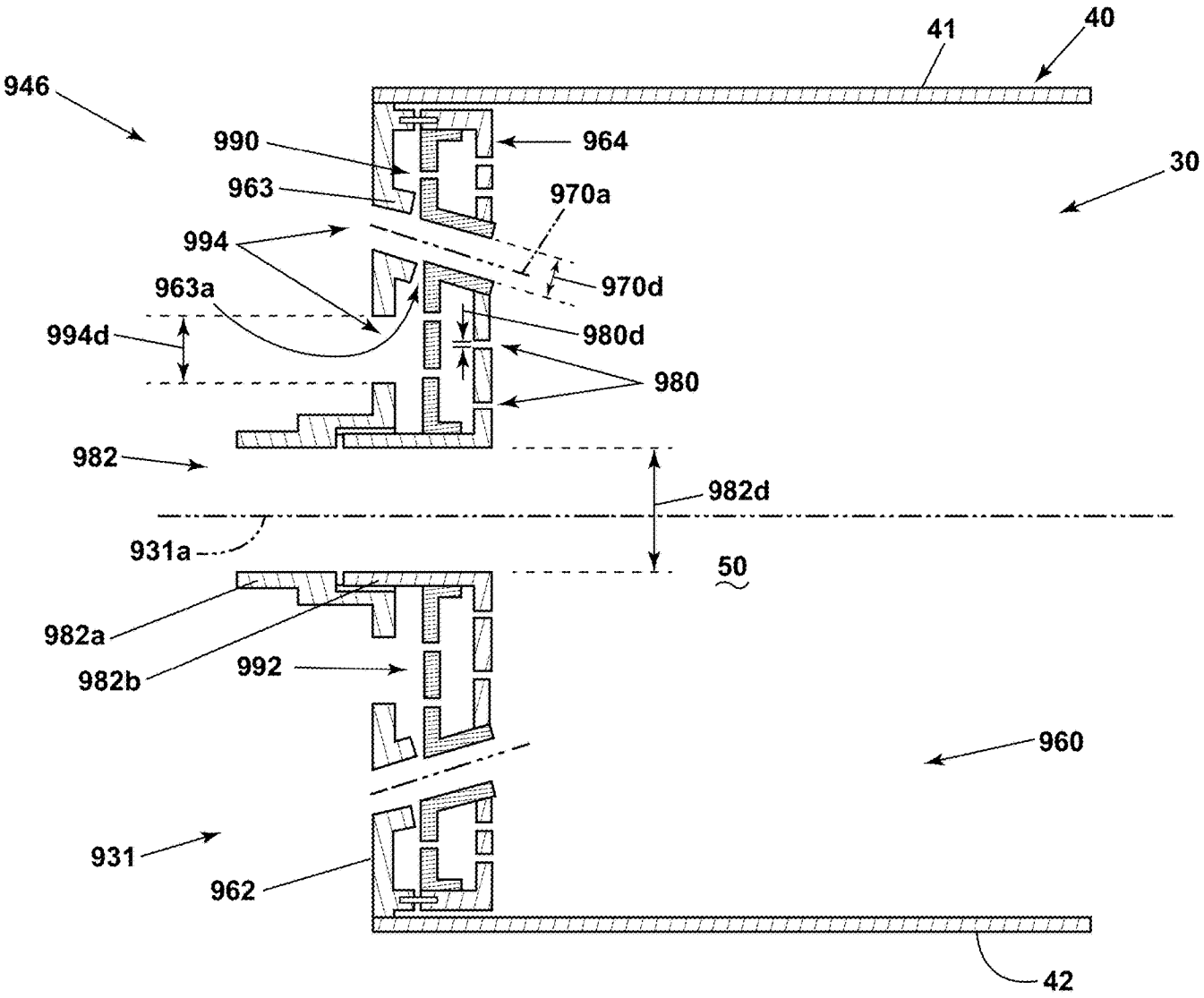
FIG. 30 is a schematic view illustrating portions of a combustor in accordance with various aspects described herein.
Figure 31A:
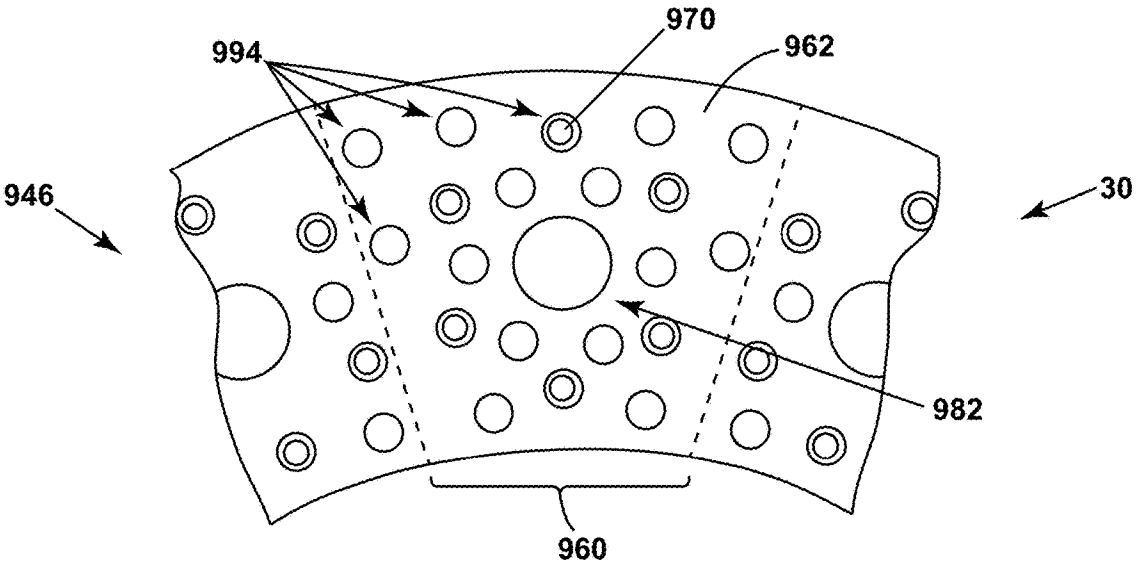
FIGS. 31A and 31B are schematic views illustrating portions of the combustor of FIG. 30, from forward looking aft, and from aft looking forward, respectively, in accordance with various aspects described herein.
Figure 31B:
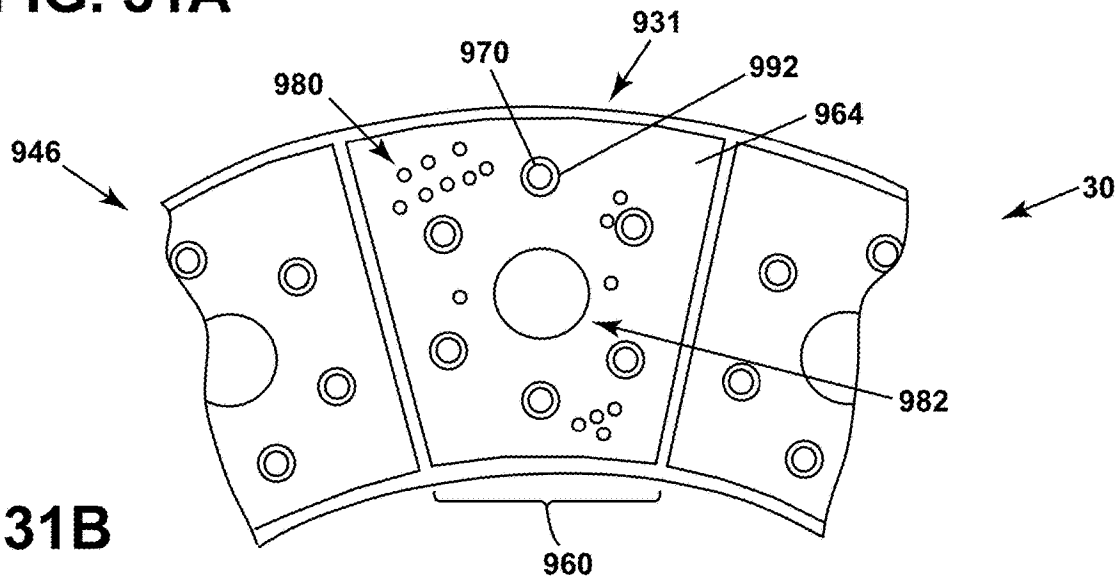

Referring to FIGS. 30, 31A, and 31B, a dome wall 946 that can be utilized for a combustor 30 is illustrated. The dome wall 946 can include aspects similar to those of the dome wall 46 (FIG. 3), 146 (FIGS. 4 and 5), 246 (FIGS. 6 and 7), 346 (FIGS. 8-9B), 446 (FIGS. 10-11B), 546 (FIGS. 12-13C), 646 (FIGS. 14-17B), 746 (FIGS. 18-23B), 846 (FIGS. 24-29B); therefore, like parts will be described with like numerals further increased by 100, with it being understood that the description of the like parts of the dome wall 46, 146, 246, 346, 446, 546, 646, 746, 846 can apply to the dome wall 946, except where noted.

The dome wall 946 can include a fuel cup 931, a dome wall section 960, a plate 962, a heat shield 964, a fuel inlet 982, and an impingement baffle 992. The fuel cup 931 and the dome wall section 960 can include at least portions of the plate 962, the heat shield 964, and the impingement baffle 992. The fuel cup 931 can include a fuel cup centerline 931*a*. The plate 962 can include a first portion 982*a* of the fuel inlet 982. The heat shield 964 can include a second portion 982*b* of the fuel inlet 982 that may be disposed at least partially in and fixed to the first portion 982*a*.

The plate 962 can be coupled to the combustor liner 40, the heat shield 964 can be coupled to the plate 962, and the impingement baffle 992 can be coupled to the heat shield 964. The impingement baffle 992 can be disposed between the plate 962 and the heat shield 964. The impingement baffle 992 can include a set of air tubes 970, a set of impingement holes 990, or both. The set of air tubes 970 can extend rearward from the impingement baffle 992 into or through the heat shield 964. Additionally or alternatively, the set of air tubes 970 can extend forward from the impingement baffle 992 into or through the plate 962. The dome wall 946 can, in some examples, include the impingement baffle 992 instead of or in addition to a second heat shield wall.

With some aspects, the plate 962 can include a set of feeding holes 994. A feeding hole diameter 994*d* (e.g., a hydraulic diameter) of some or all of the set of feeding holes 994 can be larger than an air tube diameter 970*d* (e.g., a hydraulic diameter) of one or more of the set of air tubes 970. Additionally or alternatively, cooling hole diameters 980*d* (e.g., hydraulic diameters) of a set of cooling holes 980 of the heat shield 964 can be less (e.g., half or less) than the air tube diameter 970*d*. A diameter 982*d* (e.g., a hydraulic diameter) of the fuel inlet 982 can be larger than the diameters 970*d*, 980*d*, 994*d* of the air tubes 970, the cooling holes 980, and the feeding holes 994. A plate 962 may, in some examples, include a set of feeding holes 994 instead of one or more of the set of impingement holes 990.

In some examples, the plate 962 can include a set of flanges 963 (e.g., extensions, projections, etc.) that may extend toward the set of air tubes 970 (e.g., rearward). The set of flanges 963 can include a flange for each of the set of air tubes 970. In other configurations, the set of flanges 963 can include a flange for each of a plurality groups/subsets of the set of air tubes 970. In yet other configurations, the set of flanges 963 can include a single flange for all of the set of air tubes 970. The set of flanges 963 can be annular and aligned with the air tube centerlines 970*a*. For example and without limitation, at least some of the set of flanges 963 can be tubular. The set of flanges 963 can extend short of the set of air tubes 970 such that a gap 963*a* (e.g., an axial gap) is present between the flange 963 and some or all of the set of air tubes 970. The presence of the gap 963*a* may result in leakage of air that may eventually pass through the impingement holes 990 of the impingement baffle 992.

Referring to FIGS. 32-35B, a dome wall 1046 that can be utilized for a combustor 30 is illustrated. The dome wall 1046 can include aspects similar to those of the dome wall 46 (FIG. 3), 146 (FIGS. 4 and 5), 246 (FIGS. 6 and 7), 346 (FIGS. 8-9B), 446 (FIGS. 10-11B), 546 (FIGS. 12-13C), 646 (FIGS. 14-17B), 746 (FIGS. 18-23B), 846 (FIGS. 24-29B), 946 (FIGS. 30-31B); therefore, like parts will be described with like numerals further increased by 100, with it being understood that the description of the like parts of the dome wall 46, 146, 246, 346, 446, 546, 646, 746, 846, 946 can apply to the dome wall 1046, except where noted.

The dome wall 1046 can include a fuel cup 1031, a dome wall section 1060, a plate 1062, a heat shield 1064, and a fuel inlet 1082. The fuel cup 1031 and the dome wall section 1060 can include at least portions of the plate 1062 and the heat shield 1064. The fuel cup 1031 can include a fuel cup centerline 1031*a*. The plate 1062 can include a first portion 1082*a* of the fuel inlet 1082. The heat shield 1064 can include a second portion 1082*b* of the fuel inlet 1082 that may be disposed at least partially in and fixed to the first portion 1082*a*. The plate 1062 can be coupled to the combustor liner 40, and the heat shield 1064 can be coupled to the plate 1062, such as at the fuel inlet 1082. The heat shield 1064 can include a set of air tubes 1070 extending from the heat shield 1064 forward into and through the plate 1062.

One or more of the set of air tubes 1070 can include a first portion 1071 having a centerline 1071*a*, and can include a second portion 1072 extending forward from the first portion 1071 and having a centerline 1072*a*. The second portion centerline 1072*a* can be disposed an angle 1074 (e.g., an oblique or right angle) relative to the first portion centerline 1071*a*. In some configurations, the second portion centerline 1072*a* can be parallel with the fuel cup centerline 1031*a*. The first portion 1071 can extend forward from the heat shield to the second portion 1072, which may extend from the first portion 1071 to, into, or through the plate 1062.

The heat shield 1064 can include a set of cooling holes 1080. Additionally or alternatively, the plate 1062 can include a set of impingement holes 1090 that may be offset from the cooling holes 1080.

Figure 32:
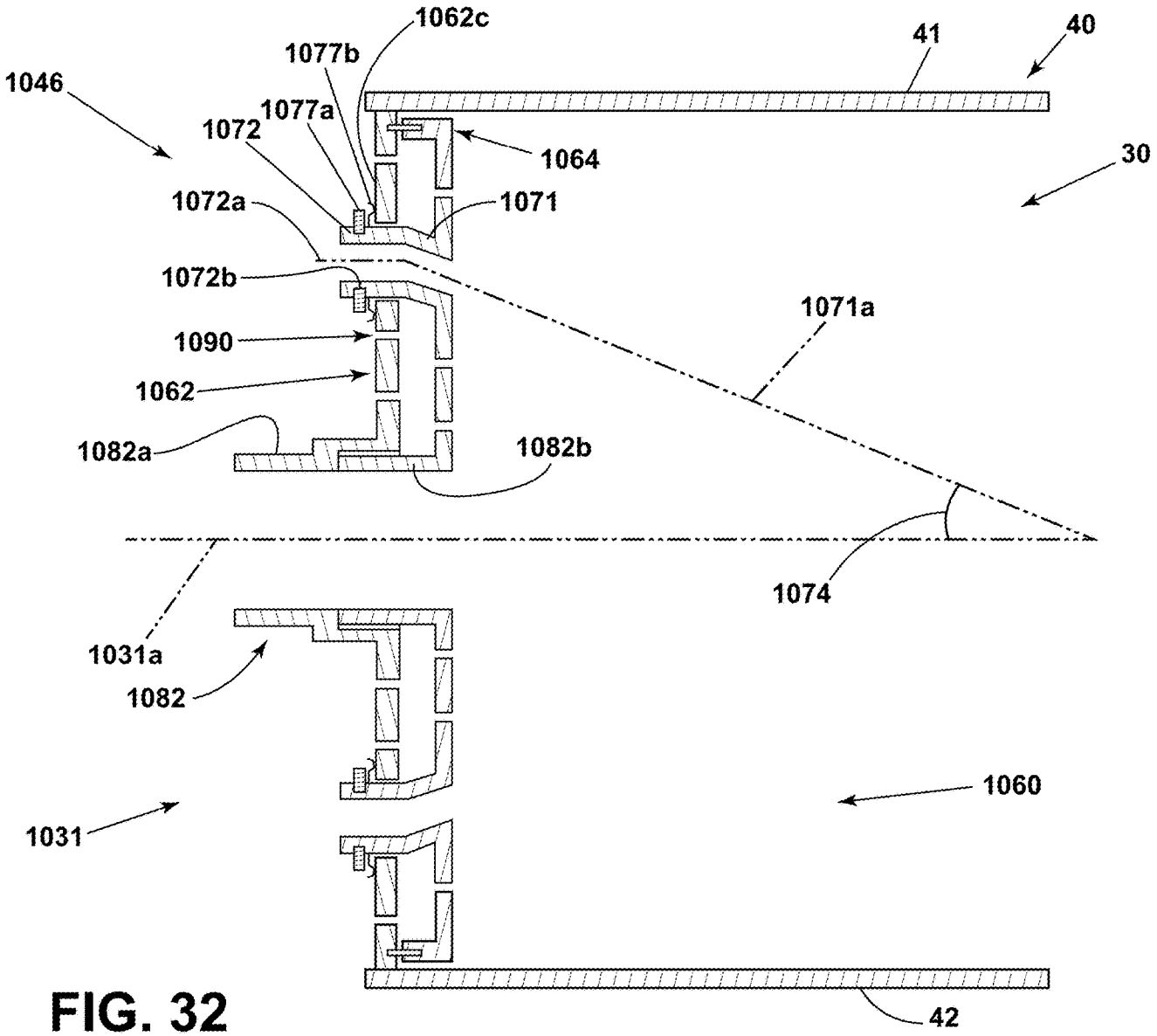
FIG. 32 is a schematic view illustrating portions of a combustor in accordance with various aspects described herein.
Figure 33A:
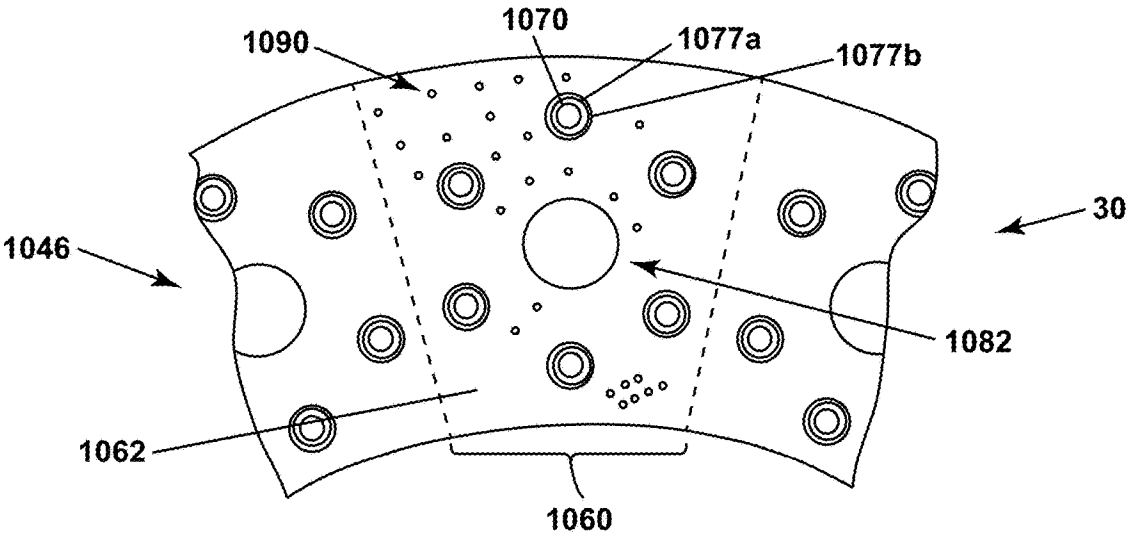
FIGS. 33A and 33B are schematic views illustrating portions of the combustor of FIG. 32, from forward looking aft, and from aft looking forward, respectively, in accordance with various aspects described herein.
Figure 33B:
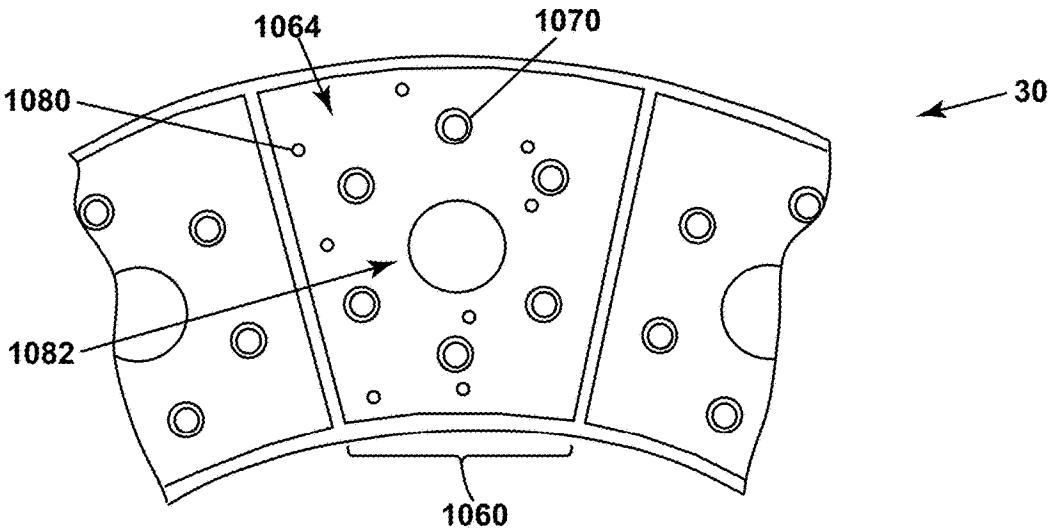

Referring to FIG. 32, with some aspects, the dome wall 1046 can include a snap ring 1077*a* and a seal 1077*b* (e.g., a spring seal). The snap ring 1077*a* and the seal 1077*b* may cooperate to sealing connect the outer surface of the second portion 1072 of an air tube 1070 with the plate 1062. For example, the seal 1077*b* may contact the second portion 1072, the forward surface 1062*c* of the plate 1062, or both. The snap ring 1077*a* may engage the second portion 1072 (e.g., a recess 1072*b* thereof) to limit axial movement of the seal 1077*b*, such as to maintain the seal 1077*b* in sealing contact with the plate 1062, the second portion 1072, or both.

Figure 34:
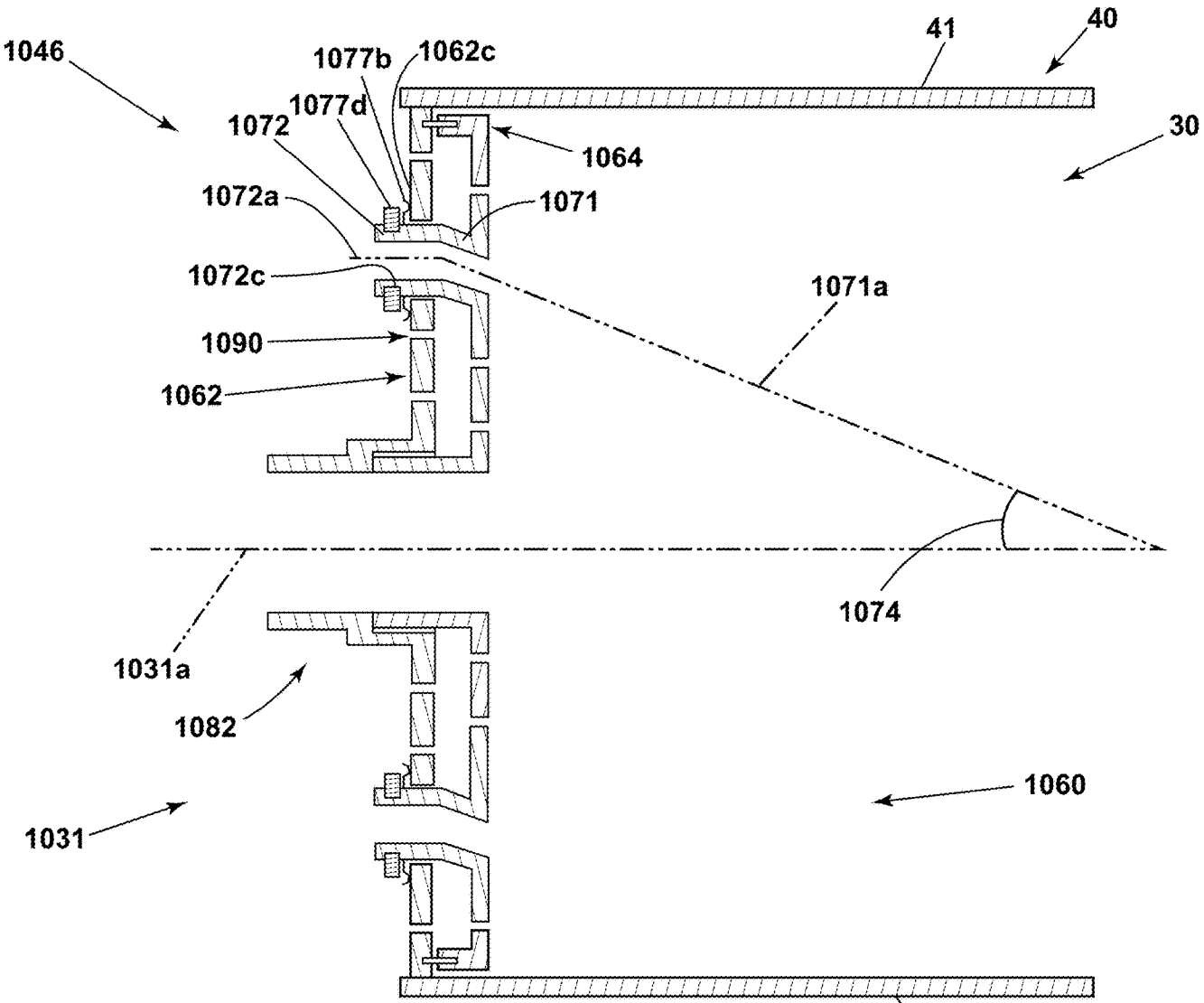
FIG. 34 is a schematic view illustrating portions of a combustor in accordance with various aspects described herein.
Figure 35A:
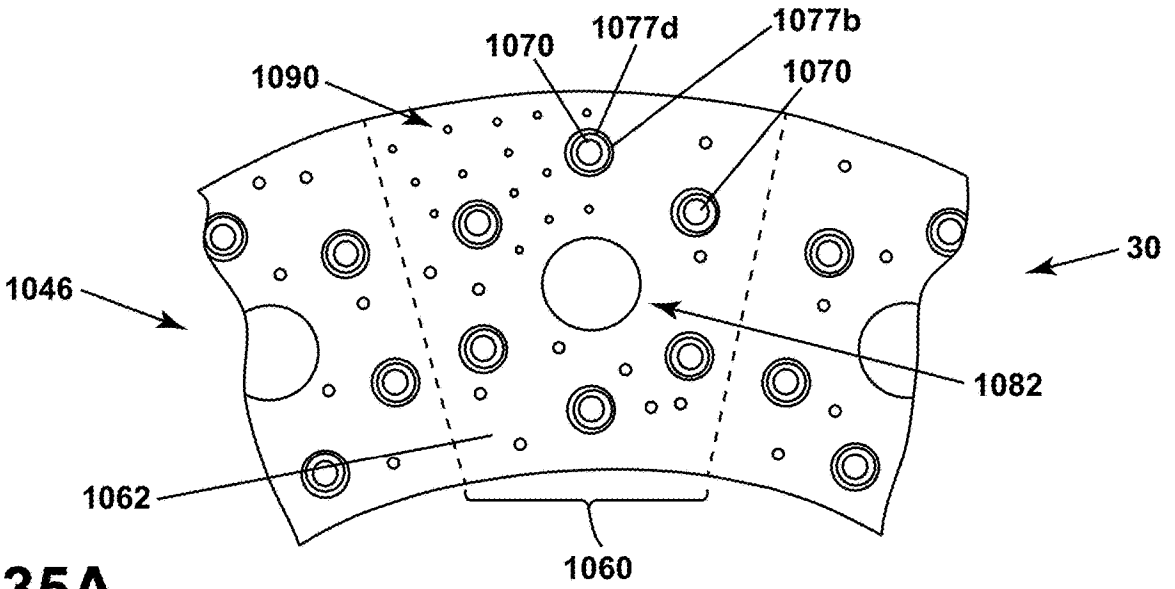
FIGS. 35A and 35B are schematic views illustrating portions of the combustor of FIG. 34, from forward looking aft, and from aft looking forward, respectively, in accordance with various aspects described herein.
Figure 35B:
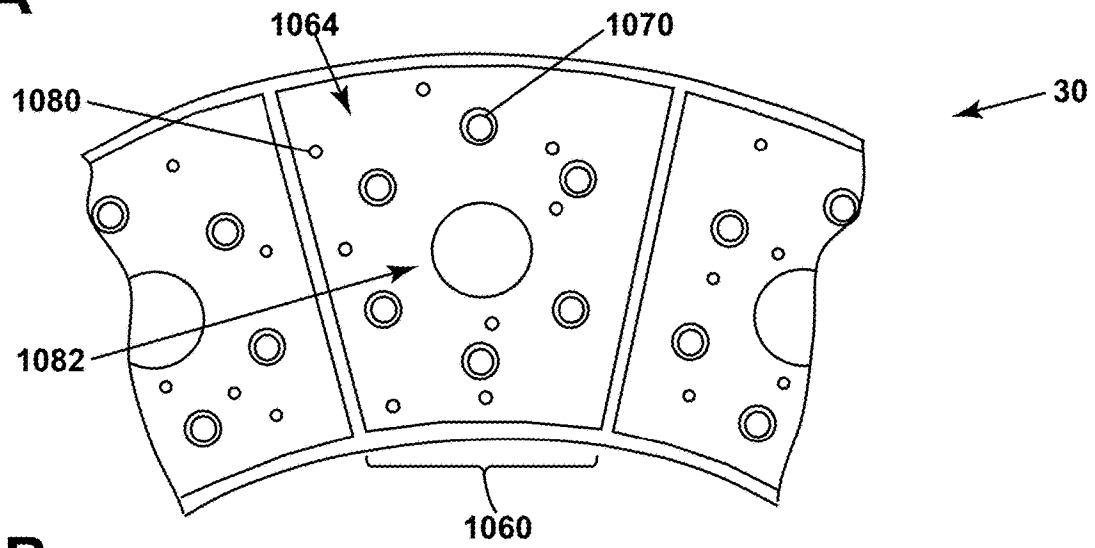

Referring to FIG. 34, with some aspects, the dome wall 1046 can include a nut 1077*d* and a seal 1077*b* (e.g., a spring seal). The nut 1077*d* and the seal 1077*b* may cooperate to provide a fluid seal between (e.g., prevent or restrict fluid flow between) the outer surface of the second portion 1072 of an air tube 1070 and the plate 1062. For example, the seal 1077*b* may contact the second portion 1072, the forward surface 1062*c* of the plate 1062, or both. The nut 1077*d* may engage the second portion 1072 (e.g., threads 1072*c* thereof), such as to limit axial movement of the seal 1077*b*, to adjust a preload on the seal 1077*b*, or a combination thereof.

Referring to FIGS. 36-39B, a dome wall 1146 that can be utilized for a combustor 30 is illustrated. The dome wall 1146 can include aspects similar to those of the dome wall 46 (FIG. 3), 146 (FIGS. 4 and 5), 246 (FIGS. 6 and 7), 346 (FIGS. 8-9B), 446 (FIGS. 10-11B), 546 (FIGS. 12-13C), 646 (FIGS. 14-17B), 746 (FIGS. 18-23B), 846 (FIGS. 24-29B), 946 (FIGS. 30-31B), 1046 (FIGS. 32-35B); therefore, like parts will be described with like numerals further increased by 100, with it being understood that the description of the like parts of the dome wall 46, 146, 246, 346, 446, 546, 646, 746, 846, 946, 1046 can apply to the dome wall 1146, except where noted.

The dome wall 1146 can include a fuel cup 1131, a dome wall section 1160, a plate 1162, a heat shield 1164, and a fuel inlet 1182. The fuel cup 1131 and the dome wall section 1160 can include at least portions of the plate 1162 and the heat shield 1164. The fuel cup 1131 can include a fuel cup centerline 1131*a*. The plate 1162 can be coupled to the combustor liner 40, and the heat shield 1164 can be coupled to the plate 1162. The dome wall 1146 can include a set of fasteners 1161 and a set of air tubes 1170. The set of fasteners 1161 can, for example, fasten the heat shield 1164 to the plate 1162. In some configurations, the heat shield 1164 can be fixed to the plate 1162 exclusively via the set of fasteners 1161, but can be fixed to the plate 1162 in additional or alternative manners in other configurations. In some examples, the plate 1162 can include a first fuel inlet portion 1182*a*, and the heat shield 1164 can include a second fuel inlet portion 1182*b*. At least some of the second fuel inlet portion 1182*b* can be disposed in the first fuel inlet portion 1182*a*. The outer surface of second fuel inlet portion 1182*b* may be in tight contact with the inner surface of the first fuel inlet portion 1182*a*, which may or may not include a press-fit. The first and second fuel inlet portions 1182*a*, 1182*b* may or may not be fixed together via welding, brazing, or both.

In some examples, the set of fasteners 1161 may at least partially define the set of air tubes 1170. For example, the set of air tubes 1170 can extend through the set of fasteners 1161. The set of fasteners 1161 can include a head 1161*a* and a body 1161*b* (e.g., be configured as a bolt). The head 1161*a* can be disposed at least partially (e.g., countersunk) in the heat shield 1164. The body 1161*b* can extend from the heat shield 1164 into and through the plate 1162. The body 1161*b* can be at least partially threaded and engage a nut 1161*c* to fasten the heat shield 1164 with the plate 1162.

With some aspects, the heat shield 1164 can include a set of protrusions 1168 that can extend forward from the heat shield 1164 toward or to the plate 1162. The set of fasteners 1161 can extend through the protrusions 1168. For example, the set of protrusions 1168 may cover or shield the portions of the fasteners 1161 between the heat shield 1164 and the plate 1162. The set of protrusions 1168 can include a protrusion 1168 for each air tube 1170 and can include tubular configurations. Additionally or alternatively, the set of protrusions 1168 can include a protrusion for groups/subsets of the set of air tubes 1170 (e.g., multiple air tubes per protrusion). Alternatively, the set of protrusions 1168 can include a single protrusion for all of the set of air tubes 1170. In some configurations, an axial extent of the set of protrusions 1168 defines an axial separation between the plate 1162 and the heat shield 1164.

In some examples, one or more of the set of air tubes 1170 can include a first portion 1171 and a second portion 1172 upstream of the first portion 1171. The first portion 1171 can extend to a rear end 1170*c* of the one or more of the set of air tubes 1170. The rear end 1170*c* can be configured as the outlet of the air tube 1170. A centerline 1171*a* of the first portion 1171 may extend through a center of the rear end 1170*c* of the air tube 1170. At least one of the set of fasteners 1161 (e.g., a first fastener) can include a rear surface 1161*d*, which can be provided by the head 1161*a*, and the first portion 1171 can extend from the second portion 1172 rearward to the rear surface 1161*d*. The center of the first portion 1171 at the rear end/outlet 1170*c* (and the centerline 1171*a*) may be offset from the center of the rear surface 1161*d*, which may be aligned with a centerline 1172*a* of the second portion 1172. The heat shield 1164 can include a set of cooling holes 1180. The plate 1162 can include a set of impingement holes 1190, such as for impingement cooling of the heat shield 1164.

Figure 36:
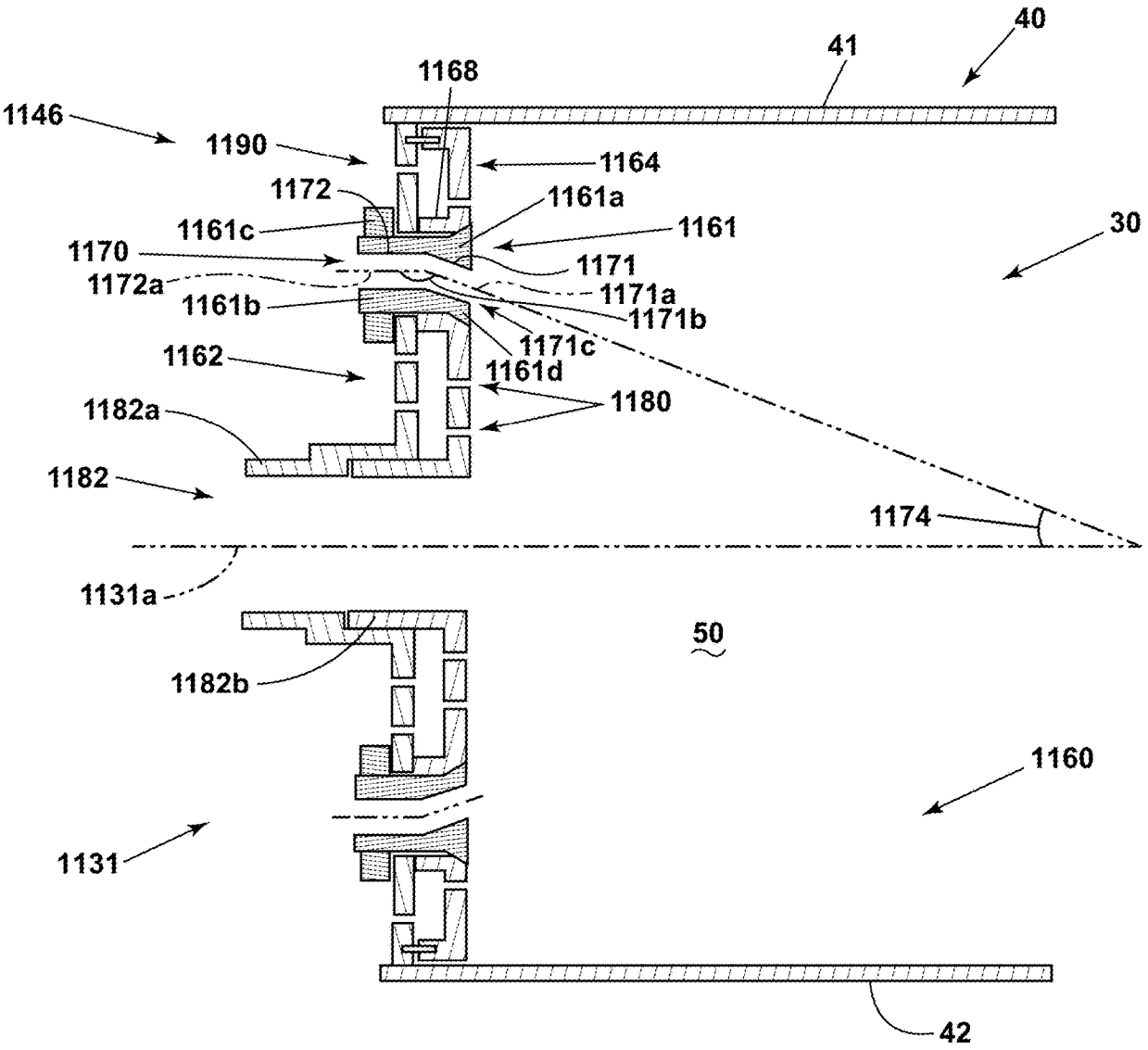
FIG. 36 is a schematic view illustrating portions of a combustor in accordance with various aspects described herein.
Figure 37A:
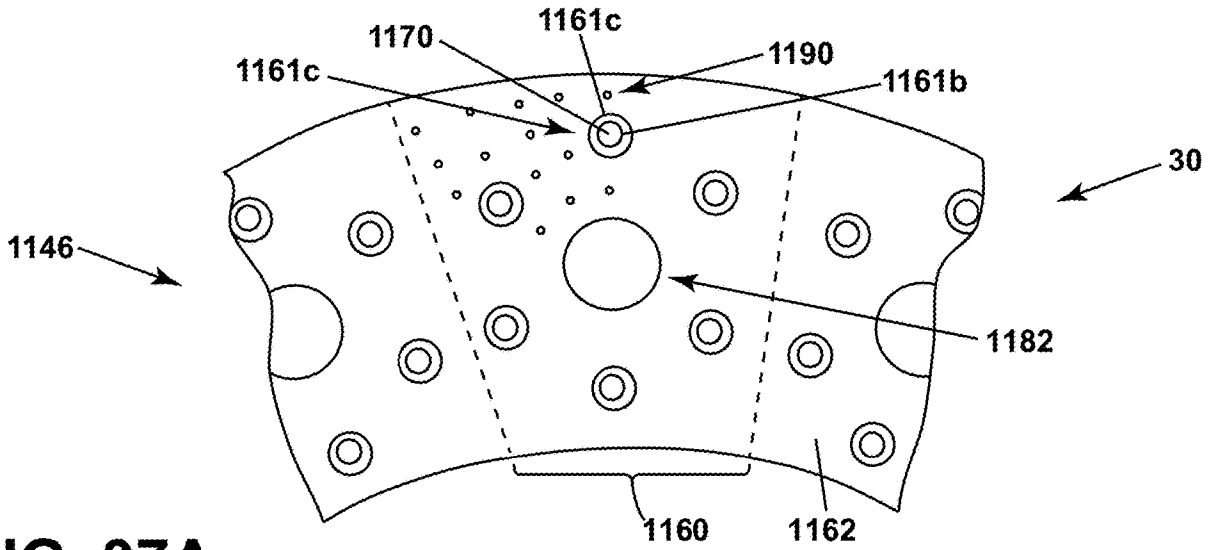
FIGS. 37A and 37B are schematic views illustrating portions of the combustor of FIG. 36, from forward looking aft, and from aft looking forward, respectively, in accordance with various aspects described herein.
Figure 37B:
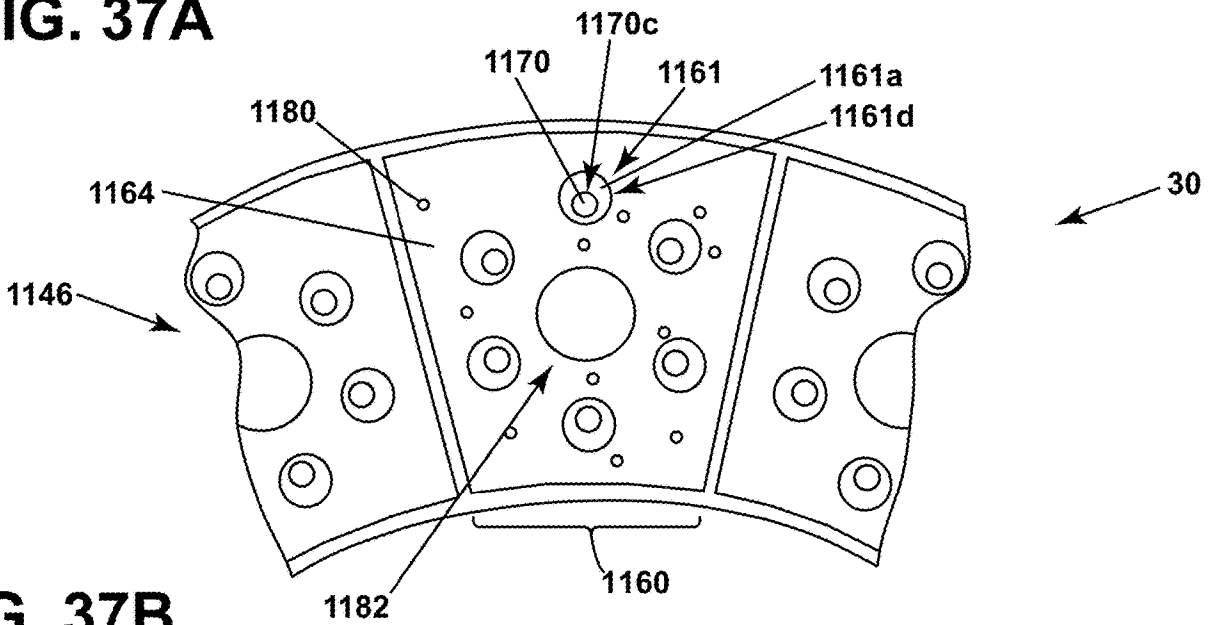

Referring to FIG. 36, the second portion centerline 1172*a* of the second portion 1172 of at least one of the set of air tubes 1170 can be parallel to the fuel cup centerline 1131*a*. The first portion centerline 1171*a* may be disposed at an oblique angle 1171*b* to the second portion centerline 1172*a*. For example, one or more of the set of air tubes 1170 can have an angled or bent configuration within a fastener 1161. The second portion 1172 having the centerline 1172*a* parallel with the fuel cup centerline 1131*a* may facilitate assembly of the dome wall 1146. A nut 1161*c* can be threaded onto the fastener 1161 and can be disposed parallel to the plate 1162, the heat shield 1164, or both. The first portion centerline 1171*a* can be disposed at an angle 1174 (e.g., an oblique angle) relative to the fuel cup centerline 1131*a*.

Figure 38:
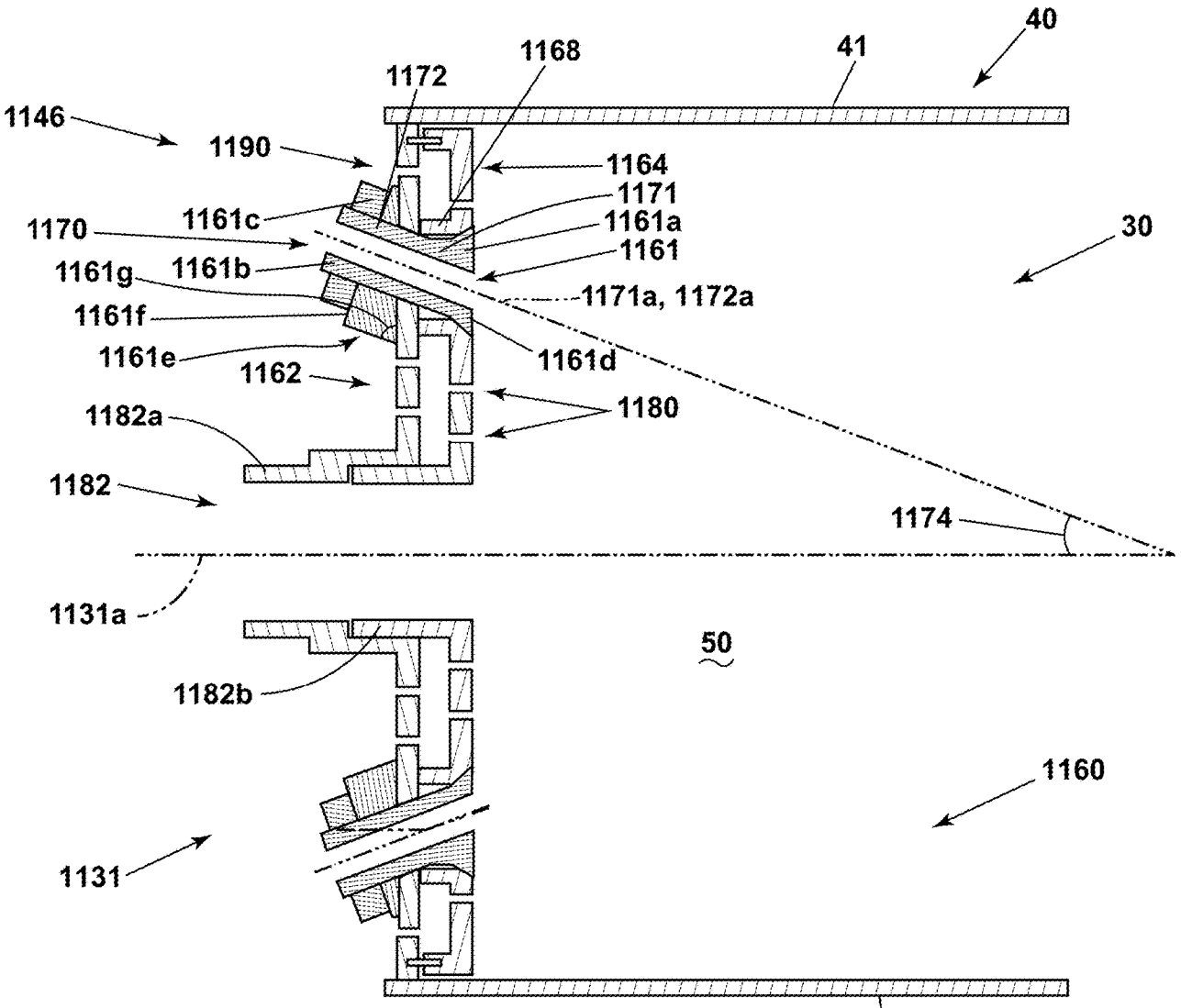
FIG. 38 is a schematic view illustrating portions of a combustor in accordance with various aspects described herein.
Figure 39A:
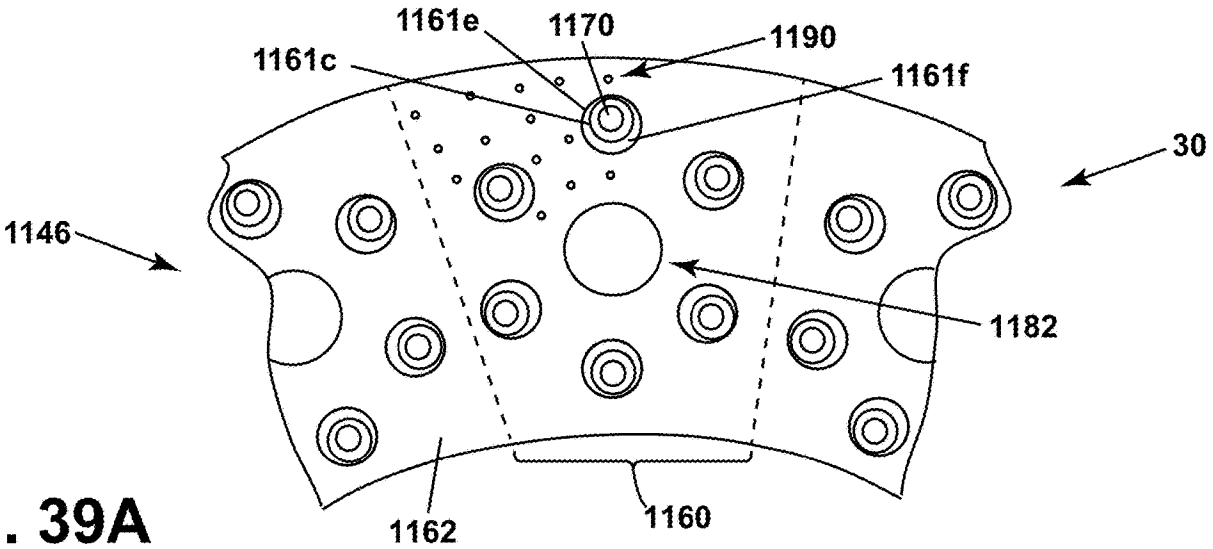
FIGS. 39A and 39B are schematic views illustrating portions of the combustor of FIG. 38, from forward looking aft, and from aft looking forward, respectively, in accordance with various aspects described herein.
Figure 39B:
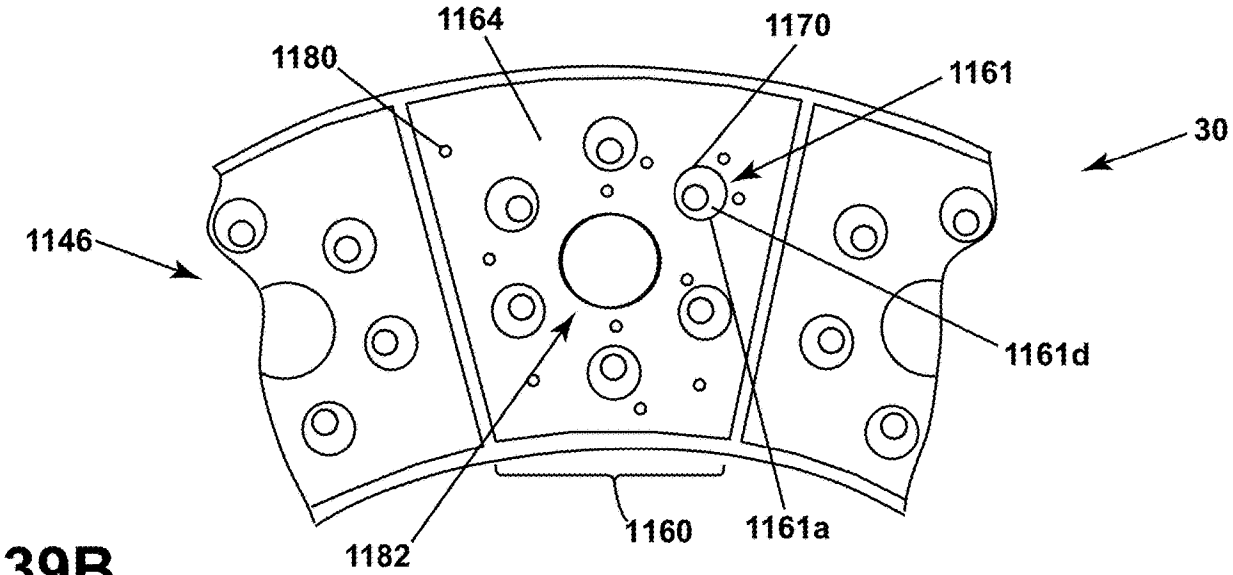

Referring to FIG. 38, at least one of the set of air tubes 1170 provided in the set of fasteners 1161 can include the first and second portions 1171, 1172, and the centerlines 1171*a*, 1172*a* can be parallel to each other and disposed at the angle 1174 relative to the fuel cup centerline 1131*a*. For example, at least some of the set of air tubes 1170 may be straight. The dome wall 1146 can include a nut 1161*c* and a wedge washer 1161*e*. The wedge washer 1161*e* can be disposed at least partially between and in contact with the plate 1162 and the nut 1161*c*. The nut 1161*c* can be engaged with the fastener 1161, which can be configured as a bolt. A shape of the wedge washer 1161*e* can correspond to the angle 1174. For example, the wedge washer 1161*e* may be angled to provide a fastening surface 1161*f* that contacts a nut 1161*c* that is perpendicular to one or both of the centerlines 1171*a*, 1172*a*. Additionally or alternatively, the wedge washer 1161*e* can include a triangular cross-sectional shape having a plurality of wedge washer angles 1161*g*, at least one of which can be equal to the angle 1174. In some configurations, the wedge washer 1161*e* can be integrally formed with the plate 1162. In other configurations, the wedge washer 1161*e* can be formed separately from the plate 1162. With the wedge washer 1161*e*, the corresponding nut 1161*c* can be disposed in contact with the fastening surface 1161*f* such that the nut 1161*c* is angled relative to the fuel cup centerline 1131 and perpendicular to the centerlines 1171*a*, 1172*a*.

Figure 40:
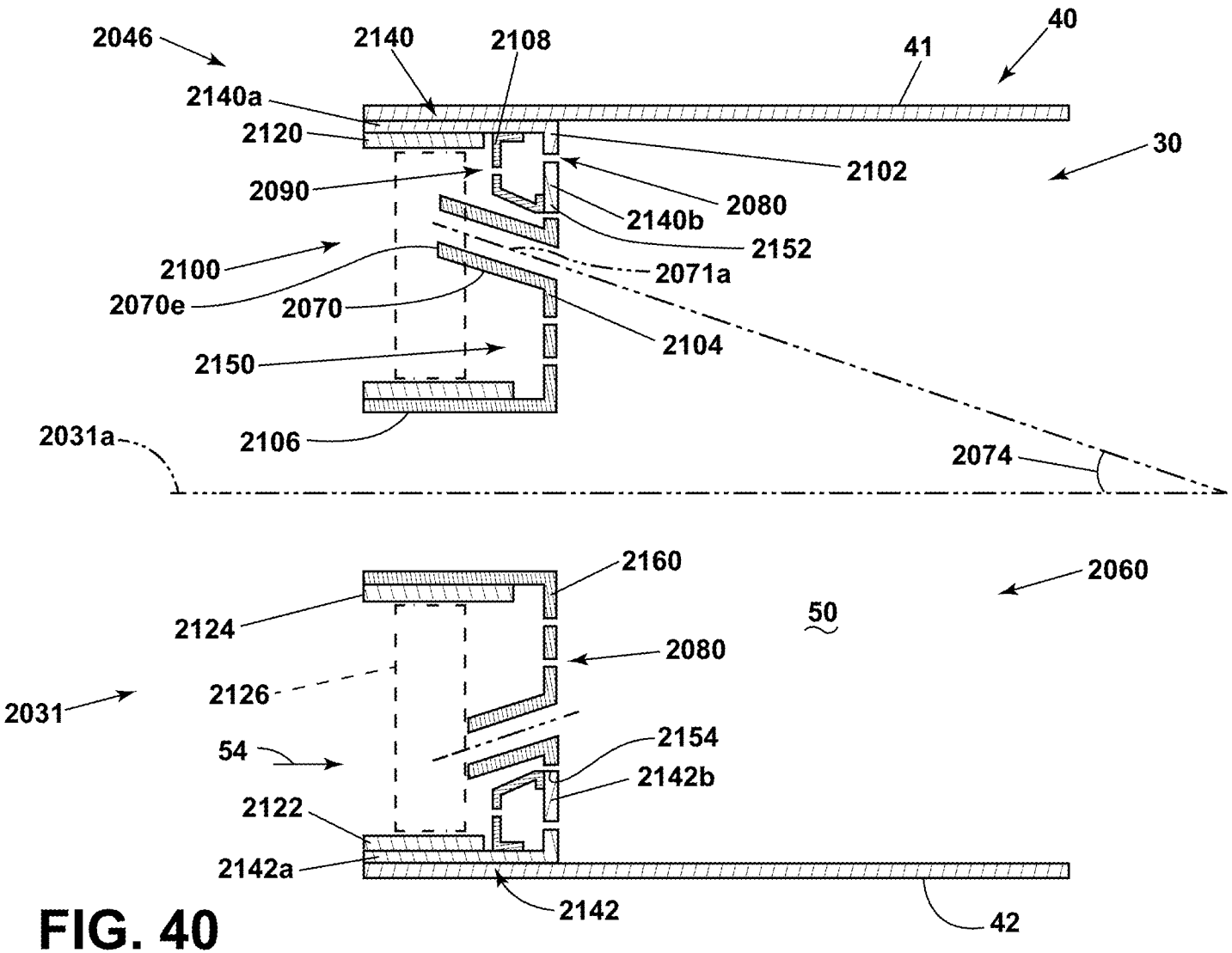
FIG. 40 is a schematic view illustrating portions of a combustor in accordance with various aspects described herein.
Figure 41A:
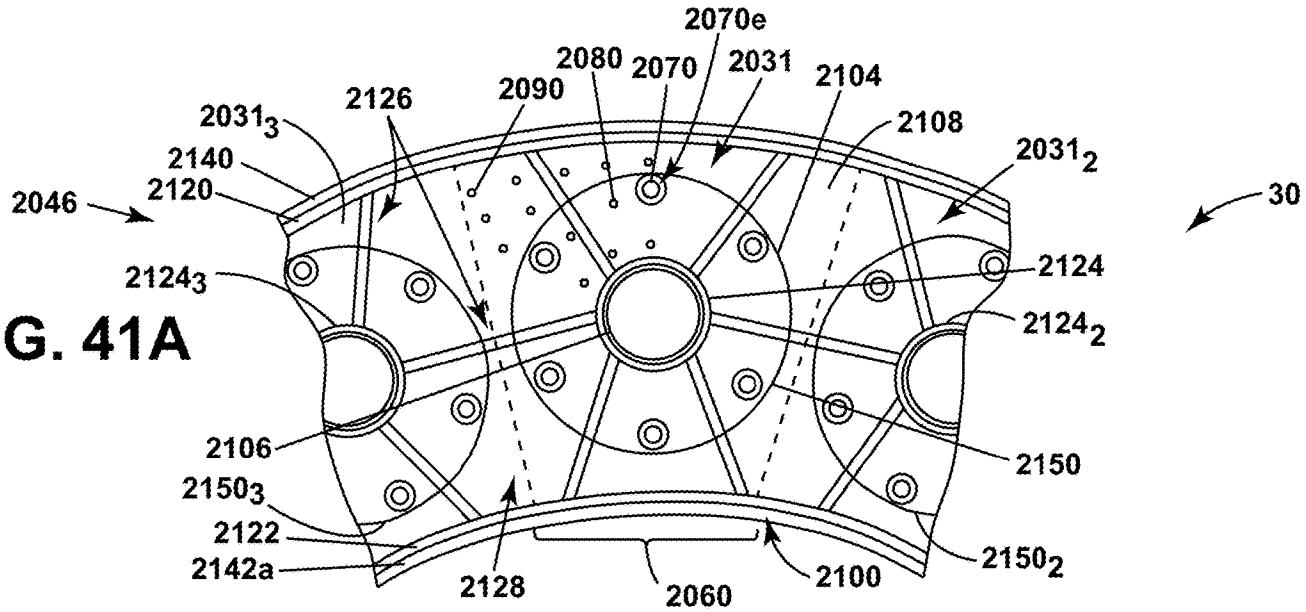
FIGS. 41A and 41B are schematic views illustrating portions of the combustor of FIG. 40, from forward looking aft, and from aft looking forward, respectively, in accordance with various aspects described herein.
Figure 41B:
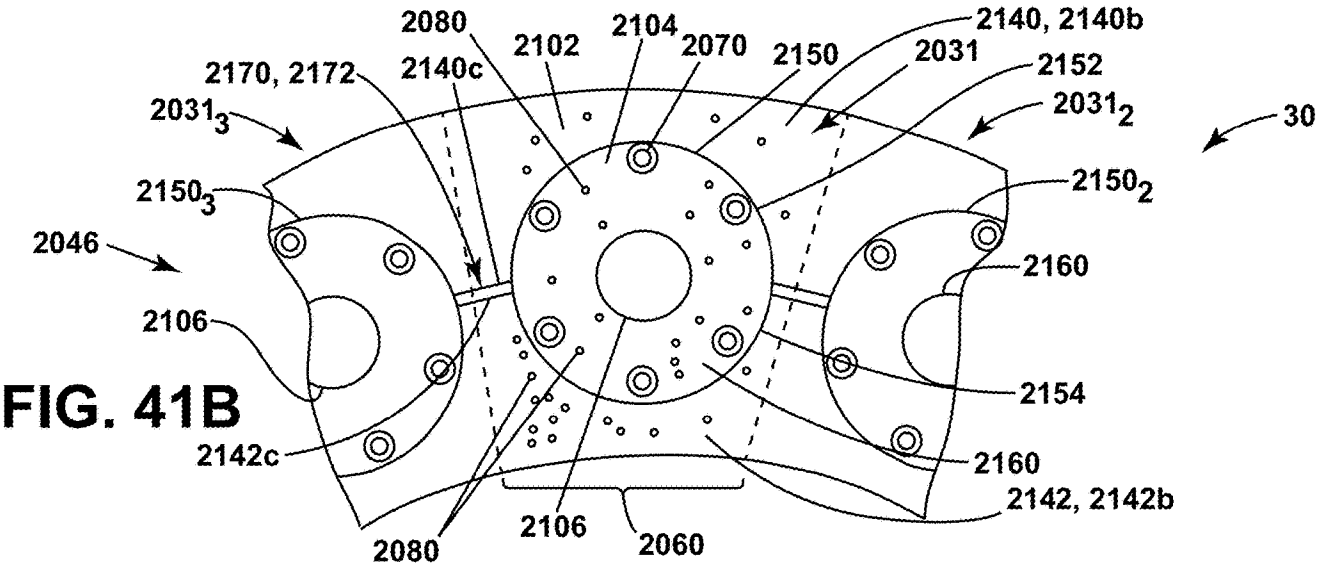

Referring to FIGS. 40, 41A, and 41B, a dome wall 2046 that can be utilized for a combustor 30 is illustrated. The dome wall 2046 can include a fuel cup 2031, a dome wall section 2060, a dome frame 2100, a first heat shield 2102, a second heat shield 2104, a fuel inlet 2106, and an impingement baffle 2108. The fuel cup 2031 and the dome wall section 2060 can include at least portions of the dome frame 2100, the first heat shield 2102, the second heat shield 2104, and the impingement baffle 2108. The fuel cup 2031 can include a fuel cup centerline 2031*a*. The first heat shield 2102 can be coupled to the combustor liner 40. The dome frame 2100 can be coupled to the first heat shield 2102. The second heat shield 2104 can be coupled to the dome frame 2100. The second heat shield 2104 can include a set of air tubes 2070. The set of air tubes 2070 can include centerlines 2071*a* that can be disposed at angles 2074 relative to the centerline 2031*a*.

Referring to FIGS. 40 and 41A, the dome frame 2100 can include an outer frame wall 2120, an inner frame wall 2122, a set of frame hubs 2124, and a plurality of frame struts 2126. The plurality of frame struts 2126 connect the outer frame wall 2120, the inner frame wall 2122, and the set of frame hubs 2124. In some configurations, one or more frame struts 2126 can connect (e.g., indirectly) the outer frame wall 2120 with the inner frame wall 2122 via the set of frame hubs 2124. Additionally or alternatively, one or more frame struts 2126 can extend from the outer frame wall 2120 to the inner frame wall 2122 to directly connect the walls 2120, 2122. The dome frame 2100 can, for example, be cast, forged and machined, stamped, fabricated from pieces joined together (e.g., via welding, brazing, riveting, among others), additively manufactured, or a combination thereof. The frame struts 2126 can extend between and connect (i) the outer frame wall 2120 and the set of frame hubs 2124, (ii) the inner frame wall 2122 and the set of frame hubs 2124, (iii) the outer frame wall 2120 and the inner frame wall 2122, (iv) multiple of the set of frame hubs 2124, or a combination thereof. Respective frame hubs of the set of frame hubs 2124 can be fixed to respective fuel inlets 2106. For example, one or more frame hubs 2124 can be brazed, welded, threaded, or a combination thereof with a respective fuel inlet 2106.

The dome frame 2100 can include a plurality of voids 2128 (FIG. 41A) disposed between and separating the frame struts 2126. The dome frame 2100 may be configured to provide structural support for the first heat shield 2102, the second heat shield 2104, the impingement baffle 2108, or a combination thereof, without materially affecting fluid flow (e.g., air 54) to other parts of the dome wall 2046, such as the first heat shield 2102, the second heat shield 2104, the impingement baffle 2108, or a combination thereof (FIG. 40). For example, the size of the frame struts 2126 may be minimized to provide sufficient structural support while providing minimized obstruction to the flow of air 54. The frame struts 2126 can be disposed such that they are offset from front ends/inlets 2070*e* of the air tubes 2070, and such that the front ends/inlets 2070*e* are aligned with one or more voids 2128. For example and without limitation, the frame struts 2126 may not overlap with the front ends/inlets 2070*e* in the axial direction. In some configurations, at least one air tube 2070 may extend forward from the second heat shield into a void of the one or more voids 2128.

The first heat shield 2102 can include a first section 2140 and a second section 2142. The first section 2140 may be disposed radially outward from the second section 2142, relative to the centerline 30*a* (FIG. 2) of the combustor 30. The first section 2140 and the second section 2142 can be formed separately from each other. The first section 2140 can be connected (e.g., fixed) to the outer liner 41. The first section 2140 can include a first portion 2140*a* that may extend in an axial direction (e.g., forward), and a second portion 2140*b* that may extend in a radial direction (e.g., relative to and inward toward the fuel cup centerline 2031*a*). The first portion 2140*a* may be fixed (e.g., brazed, welded, press-fit, bolted, among others) with the outer liner 41. The second portion 2140*b* may extend radially inward from a rear end of the first portion 2140*a*.

The second section 2142 can be connected (e.g., fixed) to the inner liner 42. The second section 2142 can include a first portion 2142*a* that may extend in the axial direction (e.g., forward) and a second portion 2142*b* that may extend in the radial direction (e.g., relative to and inward toward to the fuel cup centerline 2031*a*). The first portion 2142*a* may be fixed (e.g., brazed, welded, press-fit, among others) with the inner liner 42. The second portion 2142*b* may extend radially inward from a rear end of the first portion 2142*a*. The outer frame wall 2120 can be adjacent, connected to, or adjacent and connected to the first portion 2140*a* (e.g., a first section axial portion). The inner frame wall 2122 can be adjacent, connected to, or adjacent and connected to the first portion 2142*a* (e.g., a second section axial portion).

Referring to FIGS. 40 and 41B, in some examples, the first section 2140 and the second section 2142 define one or more apertures 2150. The second heat shield 2104 can be aligned (e.g., axially) with, disposed partially in, or aligned with and disposed at least partially in an aperture of the one or more apertures 2150. The first section 2140 can include a first recess 2152. The second section 2142 can include a second recess 2154. The first section 2140 and the second section 2142 can be disposed such that the recesses 2152, 2154 are aligned with each other to at least partially define an aperture 2150. In some configurations, at least one of the one or more apertures 2150 is circular and the recesses 2152, 2154 are semicircular. For example, the heat shield sections 2140, 2142 may include generally C-shaped configurations that open toward each other. Additionally or alternatively, a second heat shield wall 2160 of the second heat shield 2104 can be circular. The apertures 2150, recesses 2152, 2154, and second heat shield wall 2160 can include corresponding shapes other than circular or semi-circular.

Referring to FIG. 40, with some aspects, the second heat shield 2104 can include a second heat shield wall 2160 and the fuel inlet 2106. The fuel inlet 2106 can extend forward from the second heat shield wall 2160 and be adapted for connection with the fuel nozzle 38 (FIG. 2), the swirler 52 (FIG. 2), or the fuel nozzle 38 (FIG. 2) and the swirler 52 (FIG. 2). The second heat shield wall 2160 can be perpendicular to the fuel cup centerline 2031*a*. The second heat shield wall 2160 can be at least partially axially aligned with the first section second portion 2140*b*, the second section second portion 2142*b*, or the first section second portion 2140*b* and the second section second portion 2142*b*.

In some examples, the dome wall 2046 includes a set of cooling holes 2080. The first section second portion 2140*b*, the second section second portion 2142*b*, the second heat shield wall 2160, or a combination thereof can include one or more of the set of cooling holes 2080.

With some aspects, the impingement baffle 2108 can be connected to the first heat shield 2102, such as to facilitate cooling of the first heat shield 2102 (e.g., the second portions 2140*b*, 2142*b*). The impingement baffle 2108 can be disposed adjacent the first section first portion 2140*a*, the first section second portion 2140*b*, the second section first portion 2142*a*, the second section second portion 2142*b*, or a combination thereof. Cooling holes of the set of cooling holes 2080 that are covered by the impingement baffle 2108 (e.g., cooling holes in the first section second portion 2140*b* and the second section second portion 2142*b*) can have a lower pressure drop than other cooling holes of the set of cooling holes 2080, such as those in the second heat shield 2104.

In some configurations, the first heat shield 2102 and the second heat shield 2104 can each include one or more of the set of cooling holes 2080, and the impingement baffle 2108 can include a set of impingement holes 2090. For example, the first section second portion 2140*b* of the first heat shield 2102 can include a first cooling hole of the set of cooling holes 2080, the second heat shield wall 2160 can include a second cooling hole of the set of cooling holes 2080, and the impingement baffle 2108 can include at least one of the set of impingement holes 2090. The at least one of the set of impingement holes 2090 may, with some aspects, be offset from the first cooling hole 2080 of the first section second portion 2140*b* in a radial direction, a circumferential direction, or both, relative to the fuel cup centerline 2031*a*. Such a configuration may direct fluid through the impingement hole(s) 2090 into contact with the first section second portion 2140*b* (e.g., and not directly through a cooling hole 2080) to provide impingement cooling of the first heat shield 2102. The impingement baffle 2108 may, with some aspects, cover parts or substantially all of the forward surface of the first section second portion 2140*b*, the forward surface of the second section second portion 2142*b*, or both. Additionally or alternatively, the impingement baffle 2108 may not cover the forward surface of the second heat shield wall 2160. For example, the impingement baffle 2108 may not overlap with the aperture 2150.

In some examples, one or more of the set of air tubes 2070 can at least partially overlap with the impingement baffle 2108, the first section second portion 2140*b*, the second section second portion 2142*b*, or a combination thereof, when viewed from an axial direction. For example, an outer radial dimension of one or more air tubes 2070, relative to the fuel cup centerline 2031*a*, can be larger than an inner radial dimension of (i) the impingement baffle 2108, (ii) the first section second portion 2140*b*, (iii) the second section second portion 2142*b*, or a combination thereof. The one or more overlapping air tubes of the set of air tubes 2070 may not overlap with impingement holes 2090, such as to not restrict fluid flow (e.g., air 54) into the impingement holes 2090.

Referring to FIGS. 41A and 41B, the dome wall 2046 can include the fuel cup 2031 and one or more additional fuel cups, such as fuel cups $\mathbf{2031}_2$, $\mathbf{2031}_3$. The fuel cups 2031, $\mathbf{2031}_2$, $\mathbf{2031}_3$ can be circumferentially spaced relative to the centerline 30*a* (FIG. 2) of the combustor 30. The first and second sections 2140, 2142 of the first heat shield 2102 can cooperate to define the aperture 2150 and an additional aperture, such as apertures $\mathbf{2150}_2$, $\mathbf{2150}_3$, for each additional fuel cup $\mathbf{2031}_2$, $\mathbf{2031}_3$. For example, the first and second sections 2140, 2142 can include corresponding pairs of recesses 2152, 2154 for each fuel cup $\mathbf{2031}_2$, $\mathbf{2031}_3$.

Referring to FIG. 41A, the set of frame hubs 2124 can include a plurality of frame hubs 2124, including a respective frame hub 2124 for each fuel cup 2031, $\mathbf{2031}_2$, $\mathbf{2031}_3$, such as frame hubs 2124, $\mathbf{2124}_2$, $\mathbf{2124}_3$. The plurality of frame struts 2126 can connect the outer frame wall 2120, the inner frame wall 2122, and the plurality of frame hubs 2124. In some configurations, the dome wall 2046 can include an additional second heat shield 2104 for each additional fuel cup 2031.

Referring to FIG. 41B, with some aspects, the first and second sections 2140, 2142 can be disposed such that a set of cooling slots 2170 are present between the first section 2140 and the second section 2142. The cooling slots 2170 may (i) be disposed at an interface 2172 between the inner ends 2140*c*, 2142*c* of the sections 2140, 2142, (ii) extend generally in the circumferential direction, relative to the combustor centerline 31*a*, (iii) extend between adjacent fuel cups 2031, (iv) extend between second heat shields 2104 of adjacent fuel cups 2031, or a combination thereof. Additionally or alternatively, at least some of the inner ends 2140*c*, 2142*c* can be sealed together, such as via a seal (e.g., spline seal, leaf seal, others), welding, brazing, other methods, or a combination thereof, such that the interface 2172 is fluidly sealed.

With some aspects, an engine 10 (FIG. 1) can include a dome wall having one or more dome wall sections that have different configurations than one or more other dome sections of the dome wall. For example and without limitation, a dome wall can include a combination of dome wall sections 60, 160, 260, 360, 460, 560, 660, 760, 860, 960, 1060, 1160, 2060, as shown in FIGS. 3-41B, respectively.

Additionally or alternatively, a dome wall section can have various combinations of aspects of dome wall sections 60, 160, 260, 360, 460, 560, 660, 760, 860, 960, 1060, 1160, 2060, as shown in FIGS. 3-41B, respectively. For example and without limitation, a dome wall section can include various combinations of a plate having a first air tube, a heat shield having a second air tube, an impingement baffle having an air tube, a separately formed air tube fixed to one of the plate and the heat shield, an air tube with portions disposed at oblique angles relative to each other, an air tube that extends from the heat shield through the plate, an air tube that extends from the heat shield short of a forward surface of the plate, an impingement baffle having impingement holes, an air tube provided in a fastener, a dome frame, a dual-wall heat shield, a C-shaped heat shield, an H-shaped heat shield, a circular heat shield, a rectangular heat shield, a trapezoidal heat shield, a plate having offset plate sections, a protrusion having a cooling passage, or an air tube sealed to a plate, among others.

Many other possible aspects and configurations in addition to those shown in the above figures are contemplated by the present disclosure. The aspects disclosed herein can provide jets of air into a combustion chamber. Additionally or alternatively, aspects disclosed herein can improve cooling of a dome wall. The technical effects can include improved flame distribution, longer service time of the dome wall, or a combination thereof.

With some aspects, the disclosed combustors can allow for driving air flow through a set of air tubes with full dome pressure drop. At least some configurations can allow for driving air flow through the set of air tubes with full dome pressure drop and can allow for more effective, double pressure drop cooling of the dome wall. For example, the first part of the pressure drop can be provided via an impingement baffle and the second part can be provided on the hot face (e.g., downstream/rear face) of the dome wall.

With some aspects, the disclosed combustors can be utilized with gaseous fuel, such as hydrogen. Gaseous fuel, including hydrogen, spreads/disperses at a faster rate than atomized liquid fuel, which can involve less mixing time for the gaseous fuel, fuel mixing tube lengths can be shorter, and the flame from the gaseous fuel may be more likely to spread farther and faster, which can increase the risk of blowout and increase the impact of controlling the flame and limiting flame spread by controlling the dispersion of the gaseous fuel. Flame shaping formations, such as air tubes and flame shaping holes, can help contain gaseous fuel-air mixtures that have lower densities and higher velocities than with liquid fuels. For example, flame shaping formations can contain the gaseous fuel-air mixtures such that the flame velocity matches the flow velocity to provide a stable flame.

In some aspects, the gaseous fuel exits the fuel nozzle with a given speed and then mixes with air for combustion. As the fuel/air mixture burns, the flame propagates upstream. It can be desirable to control or maintain a constant flame in the combustor for ignition of subsequent fuel, and not to continually ignite the fuel with an ignitor.

Further aspects are provided by the subject matter of the following clauses:

A combustor for a turbine engine comprising: a dome wall; a combustor liner extending from the dome wall; and a combustion chamber at least partially defined by the dome wall and the combustor liner; wherein the dome wall includes: a fuel cup disposed at a dome wall section of the dome wall, the fuel cup comprising a fuel cup centerline; a set of air tubes extending at least partially through the dome wall section to direct air into the combustion chamber; and a set of cooling holes extending through the dome wall section.

The combustor of any preceding clause, wherein the set of cooling holes are parallel with the fuel cup centerline.

The combustor of any preceding clause, wherein the set of air tubes includes one or more air tubes including a portion having an air tube centerline disposed at an oblique angle relative to the fuel cup centerline.

The combustor of any preceding clause wherein the oblique angle is an acute angle such that the at least one air tube directs air into the combustion chamber and toward the fuel cup centerline.

The combustor of any preceding clause, wherein an air tube hydraulic diameter of the at least one air tube is at least two times larger than a cooling hole hydraulic diameter of at least one cooling hole of the set of cooling holes.

The combustor of any preceding clause, wherein the dome wall section includes a fuel inlet; and wherein a fuel inlet hydraulic diameter of the fuel inlet is at least twice as large as the air tube hydraulic diameter.

The combustor of any preceding clause, wherein the set of air tubes comprises at least two air tubes.

The combustor of any preceding clause, wherein the dome wall comprises a plate and a heat shield; wherein heat shield includes the set of air tubes; and wherein the set of air tubes extend forward from the heat shield toward or into the plate.

The combustor of any preceding clause wherein the plate includes a second set of air tubes; and wherein the second set of air tubes extend rearward from the plate toward or into the heat shield.

The combustor of any preceding clause, wherein the dome wall comprises a plate and a heat shield; wherein the plate includes the set of air tubes; and wherein the set of air tubes extend rearward from the plate toward or into the heat shield.

The combustor of any preceding clause, wherein the set of cooling holes includes cooling holes disposed radially outward of the set of air tubes and cooling holes disposed radially inward of the set of air tubes.

The combustor of any preceding clause, wherein the dome wall comprises a set of impingement holes.

The combustor of any preceding clause, wherein the set of impingement holes includes impingement holes disposed radially outward of the set of air tubes and impingement holes disposed radially inward of the set of air tubes.

The combustor of any preceding clause wherein the set of impingement holes are radially offset from the set of cooling holes.

The combustor of any preceding clause, wherein the dome wall section includes a plate; and wherein the plate is coupled to the combustor liner; and wherein the plate includes the set of air tubes and the set of cooling holes.

The combustor of any preceding clause, wherein the plate includes a fuel inlet adapted for connection with a fuel nozzle, a swirler, or the fuel nozzle and the swirler.

The combustor of any preceding clause, wherein the set of cooling holes includes cooling holes disposed radially outside of the set of air tubes, relative to the fuel cup centerline.

The combustor of any preceding clause, wherein the set of cooling holes includes cooling holes disposed radially between the set of air tubes and the fuel inlet, relative to the fuel cup centerline, cooling holes disposed circumferentially between the set of air tubes, or a combination thereof.

The combustor of any preceding clause, wherein at least one air tube of the set of air tubes is integrally formed with the plate.

The combustor of any preceding clause, wherein the set of air tubes includes a plurality of air tubes spaced about the dome wall section.

The combustor of any preceding clause, wherein the at least one air tube is not perpendicular to a circumferential direction relative to the fuel cup centerline.

The combustor of any preceding clause, wherein the set of air tubes includes a subset of air tubes disposed at different oblique angles to the circumferential direction relative to the fuel cup centerline.

The combustor of any preceding clause, wherein the set of cooling holes includes cooling holes of different sizes, different shapes, or different sizes and shapes.

The combustor of any preceding clause, wherein the set of cooling holes include cooling holes disposed in an asymmetric arrangement.

The combustor of any preceding clause, wherein the at least one air tube has a hydraulic diameter that converges toward the combustion chamber.

The combustor of any preceding clause, wherein the at least one air tube has a hydraulic diameter that diverges toward the combustion chamber.

The combustor of any preceding clause, wherein the at least one air tube includes a first air tube having a converging hydraulic diameter in a rearward direction; and wherein the at least one air tube includes a second air tube having a diverging hydraulic diameter in the rearward direction.

The combustor of any preceding clause, wherein the set of air tubes direct air radially inward or radially outward.

The combustor of any preceding clause, wherein the air tube centerline does not intersect the fuel cup centerline.

The combustor of any preceding clause, wherein the dome wall section includes an impingement baffle.

The combustor of any preceding clause, wherein the impingement baffle is coupled to the combustor liner, the dome wall, or both, at least partially upstream of the plate.

The combustor of any preceding clause, wherein the set of air tubes extend to or through the impingement baffle.

The combustor of any preceding clause, wherein the impingement baffle includes a plurality of impingement holes.

The combustor of any preceding clause, wherein at least some of the plurality of impingement holes are offset radially, circumferentially, or radially and circumferentially from the set of cooling holes, relative to the fuel cup centerline.

The combustor of any preceding clause, wherein the plurality of impingement holes includes impingement holes disposed radially outside of the set of air tubes, relative to the fuel cup centerline.

The combustor of any preceding clause, wherein the plurality of impingement holes includes impingement holes disposed radially between the set of air tubes and a fuel inlet of the plate, relative to the fuel cup centerline, circumferentially between the set of air tubes, or both.

The combustor of any preceding clause, wherein the plate includes a protrusion extending away from the combustion chamber; and wherein the at least one air tube of the set of air tubes is at least partially defined by the protrusion.

The combustor of any preceding clause, wherein the protrusion includes a cooling passage.

The combustor of any preceding clause, wherein the cooling passage is disposed at a second oblique angle relative to the fuel cup centerline.

The combustor of any preceding clause, wherein the second oblique angle is different than the oblique angle.

The combustor of any preceding clause, wherein the cooling passage fluidly couples a space between the impingement baffle and the plate with the combustion chamber.

The combustor of any preceding clause, wherein the cooling passage has a smaller hydraulic diameter than the at least one air tube of the set of air tubes.

The combustor of any preceding clause, wherein the dome wall section includes a plate and a at least a portion of a heat shield coupled to the plate.

The combustor of any preceding clause, wherein the heat shield is fixedly coupled to the plate; and wherein the plate is coupled to the combustor liner.

The combustor of any preceding clause, wherein the heat shield comprises the set of air tubes; and the at least one air tube of the set of air tubes, a protrusion of the heat shield, or both is fixedly coupled to the plate.

The combustor of any preceding clause, wherein the heat shield comprises a fuel inlet adapted for connection with a fuel nozzle, a swirler, or the fuel nozzle and the swirler.

The combustor of any preceding clause, wherein the heat shield partially overlaps with the plate in an axial direction, relative to the fuel cup centerline; wherein the heat shield is disposed such a radial gap is present between the heat shield and the combustor liner; and wherein a portion of the plate is aligned with the radial gap.

The combustor of any preceding clause, wherein the plate includes a set of impingement holes.

The combustor of any preceding clause, wherein the set of impingement holes are disposed radially inward of the radial gap relative to the fuel cup centerline.

The combustor of any preceding clause, wherein an inner diameter of the plate is fixedly coupled to an outer radial surface of the at least one air tube of the set of air tubes, a protrusion of the heat shield, or both.

The combustor of any preceding clause, wherein the dome wall section includes a plate and at least a portion of a heat shield fixed to the plate.

The combustor of any preceding clause, wherein the heat shield is fixed to an outer radial surface of a rear end of the at least one air tube of the set of air tubes.

The combustor of any preceding clause, wherein the plate includes a first plate section and a second plate section axially offset from the first plate section; and wherein the set of air tubes extend from the second plate section to or beyond the first plate section.

The combustor of any preceding clause, wherein the heat shield partially overlaps with the first plate section in an axial direction, relative to the fuel cup centerline; wherein the heat shield is disposed such a radial gap is present between the heat shield and the combustor liner; and wherein a portion of the first plate section is aligned with the radial gap.

The combustor of any preceding clause, wherein the first plate section includes a set of impingement holes for cooling the heat shield; and the second plate section includes a set of plate cooling holes.

The combustor of any preceding clause, wherein the second plate section includes a fuel inlet that extends axially forward toward or beyond an axial position of the first plate section for connection with a fuel nozzle, a swirler, or the fuel nozzle and the swirler; and the set of cooling holes are disposed radially between outlets of the set of air tubes and the fuel inlet, circumferentially between the set of air tubes, or both.

The combustor of any preceding clause, wherein the plate is monolithic.

The combustor of any preceding clause, wherein the heat shield includes an aperture having an edge; and wherein the edge is fixed to an outer radial surface of a rear end of the at least one air tube of the set of air tubes.

The combustor of any preceding clause, wherein the plate includes a first plate section and a second plate section disposed axially rearward of the first plate section; wherein the set of air tubes extend from the second plate section to or beyond the first plate section; and wherein the heat shield is fixed to the second plate section.

The combustor of any preceding clause, wherein the heat shield is axially aligned with the second plate section.

The combustor of any preceding clause, wherein the heat shield includes a plurality of heat shield segments, including a first heat shield segment and a second heat shield segment; and the dome wall section of the dome wall includes a portion of the first heat shield segment and a portion of the second heat shield segment.

The combustor of any preceding clause, wherein the plurality of heat shield segments are separate components.

The combustor of any preceding clause, wherein the first heat shield segment and the second heat shield segment are axially aligned with the second plate section and are fixed to the first plate section.

The combustor of any preceding clause, wherein the first heat shield segment includes a protrusion that extends forward through the first plate section.

The combustor of any preceding clause, wherein the first heat shield segment includes a first H-shaped configuration defining a first heat shield segment first recess formed in a first circumferential side of the first heat shield segment and a first heat shield segment second recess formed in a second circumferential side of the first heat shield segment; and the second heat shield segment includes a second H-shaped configuration defining a second heat shield segment first recess formed in a first circumferential side of the second heat shield segment and a second heat shield segment second recess formed in a second circumferential side of the second heat shield segment.

The combustor of any preceding clause, wherein the first circumferential side of the first heat shield segment is disposed adjacent the second circumferential side of the second heat shield segment such that the first heat shield segment first recess is aligned with the second heat shield segment second recess to at least partially define an aperture of the heat shield.

The combustor of any preceding clause, wherein a center of the aperture is aligned with the fuel cup centerline.

The combustor of any preceding clause, wherein the aperture is aligned with an unshielded portion of the plate.

The combustor of any preceding clause, wherein the set of air tubes extend forward from the unshielded portion.

The combustor of any preceding clause, wherein the unshielded portion includes a fuel inlet adapted for connection with a fuel nozzle, a swirler, or the fuel nozzle and the swirler.

The combustor of any preceding clause, wherein the dome wall includes a plate and a heat shield; wherein the plate is coupled to the combustor liner; wherein the heat shield is fixed to the plate; and wherein at least one of the plate and the heat shield includes the set of air tubes.

The combustor of any preceding clause, wherein the dome wall includes a seal connected between the plate and the heat shield; and the seal is disposed at an outer edge portion of the heat shield.

The combustor of any preceding clause, wherein the plate includes a first fuel inlet; wherein the heat shield includes a second fuel inlet; and wherein an outer surface of the second fuel inlet is fixed to an inner surface of the first fuel inlet.

The combustor of any preceding clause, wherein the plate includes the at least one air tube; and the at least one air tube extends rearward from the plate into the heat shield.

The combustor of any preceding clause, wherein a plate radial extent is within 10% of a heat shield radial extent at a line extending from a centerline of the combustor through the fuel cup centerline.

The combustor of any preceding clause, wherein the at least one air tube includes a first air tube; wherein the heat shield includes the first air tube; wherein the plate includes at least one flange that extends forward; and wherein the first air tube is partially disposed in the at least one flange.

The combustor of any preceding clause, wherein the first air tube is disposed such that a gap is present between the at least one flange and the first air tube.

The combustor of any preceding clause, wherein the heat shield includes a subset of cooling holes of the set of cooling holes; wherein the subset of cooling holes includes cooling holes disposed radially outward of a rear portion of the first air tube and radially inward of the rear portion of the first air tube; and wherein the plate includes impingement holes disposed radially inward of the flange and radially outward of the flange.

The combustor of any preceding clause, wherein the at least one air tube includes a second air tube; wherein the plate includes the second air tube; and wherein the second air tube extends rearward from the plate into an aperture of the heat shield.

The combustor of any preceding clause, wherein the at least one air tube includes a first air tube; wherein the plate includes the first air tube; and wherein the first air tube extends rearward from the plate into an aperture of the heat shield.

The combustor of any preceding clause, wherein a rear portion of the first air tube is disposed in the aperture such that radial gap is present between the rear portion and the heat shield.

The combustor of any preceding clause, wherein the heat shield includes a subset of cooling holes of the set of cooling holes; and wherein the subset of cooling holes includes cooling holes disposed radially outward of the aperture and radially inward of the aperture.

The combustor of any preceding clause, wherein the dome wall includes a plate and a heat shield; wherein the plate is coupled to the combustor liner; wherein the heat shield is fixed to the plate; and wherein the set of air tubes are formed separately from and connected to the plate, the heat shield, or the plate and the heat shield.

The combustor of any preceding clause, wherein each air tube of the set of air tubes is fixed to one of the plate and the heat shield, and floating relative to the other of the plate and the heat shield.

The combustor of any preceding clause, wherein the plate and the heat shield include corresponding apertures into which the set of air tubes are inserted.

The combustor of any preceding clause, wherein a first air tube of the set of air tubes is connected the plate via a snap ring and a seal.

The combustor of any preceding clause, wherein the seal comprises a spring seal.

The combustor of any preceding clause, wherein the seal restricts fluid flow between an outer surface of the first air tube and the plate.

The combustor of any preceding clause, wherein the first air tube is fixed to the heat shield.

The combustor of any preceding clause, wherein a first air tube of the set of air tubes comprises a discourager seal.

The combustor of any preceding clause, wherein the discourager seal is adjacent a forward surface of the plate.

The combustor of any preceding clause, including ising a seal;

The combustor of any preceding clause, wherein the seal restricts fluid flow at an outer surface of a first air tube of the set of air tubes.

The combustor of any preceding clause, wherein the seal is integrally formed with the first air tube.

The combustor of any preceding clause, wherein the dome wall includes a plate and a heat shield; and wherein the heat shield includes a first air tube of the set of air tubes that extends short of a forward surface of the plate.

The combustor of any preceding clause, wherein the plate includes a set of feeding holes.

The combustor of any preceding clause, wherein a feeding hole hydraulic diameter of the set of feeding holes is larger than an air tube hydraulic diameter of the first air tube; and a cooling hole hydraulic diameter of the set of cooling holes is half or less than the air tube hydraulic diameter.

The combustor of any preceding clause, wherein the heat shield includes a dual-wall configuration comprising a first heat shield wall and a second heat shield wall disposed between the first heat shield wall and the plate.

The combustor of any preceding clause, wherein the heat shield is formed via investment casting, additive manufacturing, or both.

The combustor of any preceding clause, wherein the first heat shield wall comprises the set of cooling holes.

The combustor of any preceding clause, wherein the second heat shield wall comprises a set of impingement holes.

The combustor of any preceding clause, wherein the first air tube extends from the first heat shield wall through the second heat shield wall and partially into the plate.

The combustor of any preceding clause, wherein the first air tube and the heat shield, including the first heat shield wall and the second heat shield wall, are formed as a monolithic component.

The combustor of any preceding clause, further comprising an impingement baffle disposed between the heat shield and the plate.

The combustor of any preceding clause, wherein the first air tube extends forward from the heat shield through the impingement baffle and partially into the plate.

The combustor of any preceding clause, wherein the heat shield includes a protrusion extending away from the combustion chamber; and wherein the first air tube is at least partially defined by the protrusion.

The combustor of any preceding clause, wherein the impingement baffle is in contact with an axial surface of the protrusion.

The combustor of any preceding clause, wherein the impingement baffle is fixed to the heat shield.

The combustor of any preceding clause, wherein the protrusion includes a cooling passage fluidly coupling (i) a space between the impingement baffle and the heat shield, and (ii) the combustion chamber.

The combustor of any preceding clause, wherein the cooling passage extends from a rear surface of the heat shield to an outer radial surface of the protrusion.

The combustor of any preceding clause, wherein the cooling passage is disposed at a second oblique angle relative to the fuel cup centerline.

The combustor of any preceding clause, wherein the dome wall includes a plate, a heat shield, and an impingement baffle disposed at least partially between the plate and heat shield; and wherein the impingement baffle includes a first air tube of the set of air tubes.

The combustor of any preceding clause, wherein the first air tube extends rearward into the heat shield.

The combustor of any preceding clause, wherein the first air tube extends forward toward the plate.

The combustor of any preceding clause, wherein the plate includes an annular extension that extends toward the first air tube.

The combustor of any preceding clause, wherein the annular extension is aligned with the air tube centerline.

The combustor of any preceding clause, wherein the annular extension extends short of the first air tube such that a gap is present between the annular extension and the first air tube.

The combustor of any preceding clause, wherein the dome wall includes a plate and a heat shield; wherein the at least one air tube includes a first air tube; wherein the first air tube includes a second portion connected to the portion; wherein the second portion includes a second portion centerline that is disposed at a second oblique angle relative to the air tube centerline.

The combustor of any preceding clause, wherein the second portion centerline is parallel with the fuel cup centerline.

The combustor of any preceding clause, wherein the portion extends forward from the heat shield to the second portion; and wherein the second portion extends from the portion into the plate.

The combustor of any preceding clause, wherein the second portion extends through the plate.

The combustor of any preceding clause, wherein the dome wall includes a seal in contact with the plate and the second portion.

The combustor of any preceding clause, wherein the dome wall includes a snap ring or a nut engaged with the second portion and in contact with the seal.

The combustor of any preceding clause, wherein the seal comprises a spring seal that restricts fluid flow between an outer surface of the second portion and the plate.

The combustor of any preceding clause, wherein the dome wall includes a set of fasteners; and wherein the set of air tubes are provided in the set of fasteners.

The combustor of any preceding clause, wherein the dome wall includes a plate and a heat shield; and the heat shield is fixed to the plate via the set of fasteners.

The combustor of any preceding clause, wherein the heat shield is fixed to the plate exclusively via the set of fasteners.

The combustor of any preceding clause, wherein the at least one air tube includes a first air tube; wherein the set of fasteners includes a first fastener including the first air tube; and wherein a center of an outlet of the first air tube is disposed at a rear surface of the first fastener and is offset from a center of the rear surface of the first fastener.

The combustor of any preceding clause, wherein the at least one air tube includes a second portion having a second portion centerline that is parallel to the fuel cup centerline.

The combustor of any preceding clause, wherein the dome wall includes a wedge washer and a nut.

The combustor of any preceding clause, wherein the set of fasteners includes a first bolt including a first air tube of the at least one air tube; wherein a nut is engaged with first bolt; and wherein the wedge washer is disposed at least partially between the nut and the plate.

The combustor of any preceding clause, wherein a shape of the wedge washer corresponds to the oblique angle.

The combustor of any preceding clause, wherein the wedge washer includes a triangular cross-sectional shape including a plurality of wedge washer angles; and wherein at least one of the plurality of wedge washer angles is equal to the oblique angle.

The combustor of any preceding clause, wherein the first air tube is straight.

The combustor of any preceding clause, wherein the dome wall includes a dome frame, a first heat shield, and a second heat shield.

The combustor of any preceding clause, wherein the dome frame includes an outer frame wall, an inner frame wall, a frame hub, and a plurality of frame struts connecting the outer frame wall, the inner frame wall, and the frame hub.

The combustor of any preceding clause, wherein the plurality of frame struts are offset from inlets of the set of air tubes.

The combustor of any preceding clause, wherein the second heat shield includes the at least one air tube; wherein plurality of struts are separated by a plurality of voids; wherein the at least one air tube extends forward from the second heat shield into a void of the plurality of voids.

The combustor of any preceding clause, wherein the first heat shield includes a first section connected to an outer liner of the combustor liner and a second section connected to an inner liner of the combustor liner.

The combustor of any preceding clause, wherein the first section and the second section define an aperture; and wherein the second heat shield is aligned with, disposed partially in, or aligned with and disposed at least partially in the aperture.

The combustor of any preceding clause, wherein the first section includes a first section axial portion and a first section radial portion extending radially inward from the first section axial portion; wherein the second section includes a second section axial portion and a second section radial portion extending outward from the second section axial portion; and wherein the second heat shield includes a second heat shield wall and a fuel inlet adapted for connection with a fuel nozzle, a swirler, or the fuel nozzle and the swirler.

The combustor of any preceding clause, wherein the fuel inlet extends into and is connected to the frame hub; wherein the outer frame wall is adjacent the first section axial portion; and wherein the inner frame wall is adjacent the second section axial portion.

The combustor of any preceding clause, wherein the second heat shield wall is at least partially axially aligned with the first section radial portion, the second section radial portion, or the first section radial portion and the second section radial portion.

The combustor of any preceding clause, wherein the second heat shield includes the at least one air tube; and wherein the at least one air tube extends forward from the second heat shield wall.

The combustor of any preceding clause, wherein the second heat shield wall is circular and the aperture is circular.

The combustor of any preceding clause, wherein the first section radial portion, the second section radial portion, and the second heat shield wall include cooling holes of the set of cooling holes.

The combustor of any preceding clause, wherein an impingement baffle is connected to the first heat shield.

The combustor of any preceding clause, wherein the impingement baffle and the at least one air tube partially overlap in an axial direction.

The combustor of any preceding clause, wherein the impingement baffle is disposed adjacent the first section radial portion and the first section axial portion.

The combustor of any preceding clause, wherein the impingement baffle is disposed adjacent the second section radial portion and the second section axial portion.

The combustor of any preceding clause, wherein the first section radial portion includes a first cooling hole of the set of cooling holes; and wherein the impingement baffle includes an impingement hole offset from the first cooling hole in a radial direction, a circumferential direction, or both.

The combustor of any preceding clause, wherein the second heat shield wall includes a second cooling hole of the set of cooling holes.

The combustor of any preceding clause, comprising one or more additional fuel cups circumferentially spaced from the fuel cup relative to a centerline of the combustor; wherein the first heat shield includes a first section connected to the outer liner and a second section connected to the inner liner; and wherein the first section and the second section cooperate to define apertures for the fuel cup and the one or more additional fuel cups.

The combustor of any preceding clause, wherein the dome frame includes an outer frame wall, an inner frame wall, a plurality of frame hubs, and a plurality of frame struts connecting the outer frame wall, the inner frame wall, and the frame hubs.

The combustor of any preceding clause, wherein the plurality of frame hubs includes a respective frame hub for the fuel cup and the one or more additional fuel cups.

The combustor of any preceding clause, wherein the dome wall includes an additional second heat shield for each of the one or more additional fuel cups.

The combustor of any preceding clause, wherein the first section and the second section are disposed such that a cooling slot is present between the first section and the second section.

The combustor of any preceding clause, wherein the cooling slot extends from the second heat shield to a first additional second heat shield of the one or more additional second heat shields.

The combustor of any preceding clause, wherein an interface between the first section and the second section is fluidly sealed.

A gas turbine engine comprising the combustor of any preceding clause.

An aircraft comprising the combustor of any preceding clause.

While described with respect to a turbine engine, it should be appreciated that the combustor as described herein can be for any engine with a having a combustor. It should be appreciated that application of aspects of the disclosure discussed herein are applicable to engines with propeller sections or fan and booster sections along with turbojets, turbo engines, and turboshaft engines in aviation, marine, and stationary applications as well.

To the extent not already described, the different features and structures of the various embodiments can be used in combination, or in substitution with each other as desired. That one feature is not illustrated in all of the embodiments is not meant to be construed that it cannot be so illustrated, but is done for brevity of description. Thus, the various features of the different embodiments can be mixed and matched as desired to form new embodiments, whether or not the new embodiments are expressly described. All combinations or permutations of features described herein are covered by this disclosure.

This written description uses examples to describe aspects of the disclosure described herein, including the best mode, and also to enable any person skilled in the art to practice aspects of the disclosure, including making and using any devices or systems and performing any incorporated methods. The patentable scope of aspects of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A combustor for a turbine engine comprising:

a dome wall having a dome wall section including a plate and a heat shield spaced from the plate to define a cavity, the plate having a set of flanges, each flange of the set of flanges defining an aperture;

a combustor liner extending from the dome wall; and a combustion chamber at least partially defined by the dome wall and the combustor liner;

wherein the dome wall further includes:

a fuel cup disposed at the dome wall section of the dome wall, the fuel cup comprising a fuel cup centerline;

a set of air tubes extending through the dome wall section to direct air into the combustion chamber, each air tube of the set of air tubes extending forward from the heat shield through the aperture of a respective flange of the set of flanges and each air tube of the set of air tubes is spaced from the respective flange of the set of flanges to define a gap between each air tube of the set of air tubes and the respective flange of the set of flanges; and a set of cooling holes extending through the heat shield of the dome wall section.

2. The combustor of claim 1, wherein at least one cooling hole of the set of cooling holes is parallel with the fuel cup centerline.

3. The combustor of claim 1, wherein the set of air tubes includes one or more air tubes including a portion having an air tube centerline disposed at an oblique angle relative to the fuel cup centerline.

4. The combustor of claim 3, wherein the oblique angle is an acute angle such that the one or more air tubes directs air into the combustion chamber and toward the fuel cup centerline.

5. The combustor of claim 4, wherein an air tube hydraulic diameter of the one or more air tubes is at least two times larger than a cooling hole hydraulic diameter of at least one cooling hole of the set of cooling holes.

6. The combustor of claim 5, wherein the dome wall section includes a fuel inlet; and wherein a fuel inlet hydraulic diameter of the fuel inlet is at least twice as large as the air tube hydraulic diameter.

7. The combustor of claim 1, wherein the set of air tubes comprises at least two air tubes.

8. The combustor of claim 1, wherein the set of cooling holes includes cooling holes disposed radially outward of the set of air tubes and cooling holes disposed radially inward of the set of air tubes.

9. The combustor of claim 8, wherein the dome wall comprises a set of impingement holes.

10. The combustor of claim 9, wherein the set of impingement holes includes impingement holes disposed radially outward of the set of air tubes and impingement holes disposed radially inward of the set of air tubes.

11. The combustor of claim 10, wherein at least one impingement hole of the set of impingement holes is radially offset from at least one cooling hole of the set of cooling holes.

12. The combustor of claim 1, wherein the set of air tubes includes a plurality of air tubes spaced about the dome wall section.

13. The combustor of claim 1, further including a seal positioned between the heat shield and the plate, wherein the seal is positioned radially outward of the set of air tubes.

14. The combustor of claim 1, wherein each gap of the set of gaps is configured to accommodate thermal growth between the plate and a respective air tube of the set of air tubes.

15. The combustor of claim 14, wherein each air tube of the set of air tubes is integrally formed with the heat shield.

* * * * *